US011614085B2

(12) United States Patent
Brown et al.

(10) Patent No.: US 11,614,085 B2
(45) Date of Patent: Mar. 28, 2023

(54) PUMP ASSEMBLIES CONFIGURED FOR DRIVE AND PUMP END INTERCHANGEABILITY

(71) Applicant: Rotary Manufacturing, LLC, North Port, FL (US)

(72) Inventors: Jeffrey Scott Brown, Venice, FL (US); Scott Alan McAloon, Nokomis, FL (US); Seth Thomas, Lake Zurich, IL (US)

(73) Assignee: Rotary Manufacturing, LLC, North Port, FL (US)

( * ) Notice: Subject to any disclaimer, the term of this patent is extended or adjusted under 35 U.S.C. 154(b) by 0 days.

(21) Appl. No.: 16/662,722

(22) Filed: Oct. 24, 2019

(65) Prior Publication Data

US 2021/0123433 A1 Apr. 29, 2021

(51) Int. Cl.

| | |
|---|---|
| ***F04B 53/16*** | (2006.01) |
| ***F04B 17/03*** | (2006.01) |
| ***F04C 15/00*** | (2006.01) |

(52) U.S. Cl.

CPC ..... *F04B 53/16* (2013.01); *F04C 15/0069* (2013.01); *F04B 17/03* (2013.01)

(58) Field of Classification Search

CPC .. F04C 15/0069; F04D 13/024–13/027; F04D 13/06; F04D 13/0606; F04D 13/0626; F04D 13/021

See application file for complete search history.

(56) References Cited

U.S. PATENT DOCUMENTS

| | | | | |
|---|---|---|---|---|
| 6,997,688 | B1 * | 2/2006 | Klein | F04D 29/126 417/420 |
| 10,385,860 | B2 * | 8/2019 | Drechsel | F04D 13/026 |
| 2009/0062020 | A1 * | 3/2009 | Edwards | F04D 13/0606 464/89 |
| 2009/0280007 | A1 * | 11/2009 | Ou | F04D 25/08 415/213.1 |
| 2012/0177511 | A1 * | 7/2012 | Sexton | F04D 29/20 417/366 |
| 2016/0108923 | A1 * | 4/2016 | Drechsel | F04D 13/024 417/420 |
| 2018/0172011 | A1 * | 6/2018 | Blankemeier | F04C 15/0069 |

* cited by examiner

*Primary Examiner* — Philip E Stimpert

(74) *Attorney, Agent, or Firm* — Suiter Swantz pc llo

(57) ABSTRACT

A pumping system includes a universal adapter having a back end for attachment to a motor, a forward opening receiving area, an outer magnet assembly rotatable around the receiving area by a motor, and a forward mounting plate surrounding the forward opening receiving area and having mounting features adapted for attachment to the back cover of each of a variety of pump assemblies. The back cover includes mounting features for alignment with the mounting features of the forward mounting plate of the universal adapter.

11 Claims, 63 Drawing Sheets

PUMP ASSEMBLIES CONFIGURED FOR DRIVE AND PUMP END INTERCHANGEABILITY

BACKGROUND

Pumping assemblies can vary in design, materials, and components according to intended use, for example, in pumping fluids such as gases or liquids. Liquids can vary in viscosity. Liquids can also vary in chemical property such as being corrosive or relatively inert. Liquids can also carry solids, which can vary in particle size, and can vary in their concentration or density in the host liquid. Pumping assemblies are therefore provided to suit many different pumping needs. Various impeller types and other material moving components are available, each suited for a particular pumped fluid, rotational speed, and pressure in use.

Dedicated and singly designed pump assemblies intended to each serve a particular use represents an expensive approach if several or many uses are needed by a user.

Accordingly, improvements are needed in interchangeable parts and universal assemblies in pumping systems.

SUMMARY OF THE INVENTIVE ASPECTS

To achieve the foregoing and other advantages, the inventive aspects disclosed herein are generally directed to a mounting for connecting an electric motor or other drive assembly to a variety of pump head configurations or a canned motor to a variety of pump heads, wherein the mounting allows for interchangeability with any pump head to the same mounting or canned motor. More particularly, the inventive aspects disclosed herein are directed to a pumping system including a universal adapter having a back end for attachment to a motor, a forward opening receiving area, an outer magnet assembly rotatable around the receiving area by a motor, and a forward mounting plate surrounding the forward opening receiving area and having mounting features adapted for attachment to the back cover of each of a variety of pump assemblies. The back cover includes mounting features for alignment with the mounting features of the forward mounting plate of the universal adapter.

In another aspect, the inventive concepts disclosed herein are directed to a pumping system including a universal adapter for attachment to a motor, the universal adapter including a forward opening receiving area and an outer magnet assembly rotatable around the receiving area by the motor. A first pump assembly has an inlet and an outlet, a rotatable inner magnet assembly for magnetic coupling to the outer magnet assembly, and a rotatable first impeller coupled to the inner magnet assembly to pump fluid from the inlet to the outlet upon rotation of the inner magnet assembly. A second pump assembly has an inlet, an outlet, a rotatable inner magnet assembly for magnetic coupling to the outer magnet assembly, and a rotatable second impeller coupled to the inner magnet assembly to pump fluid from the inlet to the outlet upon rotation of the inner magnet assembly. The first pump assembly and second pump assembly each have mounting features by which the first pump assembly and second pump assembly can be interchangeably mounted on the universal adapter.

In another aspect, the inventive concepts disclosed herein are directed to a pump assembly for mounting on a universal adapter having a back end for attachment to a motor, a forward opening receiving area, an outer magnet assembly rotatable around the receiving area by a motor, and a forward mounting plate surrounding the forward opening receiving area and having mounting features for attachment to the back cover of each of a variety of pump assemblies. The pump assembly includes a casing having an inlet and an outlet. A back cover attached to the casing has mounting features for alignment with, and attachment to, the mounting features of the forward mounting plate of the universal adapter. A containment shell includes a rearward extending cup for positioning in the receiving area of the universal adapter. An inner magnet assembly is positioned in the cup and rotatable therein by magnetic coupling to the outer magnet assembly through the cup. An impeller is rotatable within the casing by the inner magnet assembly to pump fluid from the inlet to the outlet.

In another aspect, the inventive concepts disclosed herein are directed to a pump assembly for mounting on a universal adapter having a back end for attachment to a motor, a forward opening receiving area, an outer magnet assembly rotatable around the receiving area by a motor, and a forward mounting plate surrounding the forward opening receiving area. The forward opening receiving area has mounting features for attachment to the back cover of each of a variety of pump assemblies. The pump assembly includes a casing having an inlet and an outlet, a back cover attached to the casing, the back cover having mounting features for alignment with, and attachment to, the mounting features of the forward mounting plate of the universal adapter. A containment shell comprising a rearward extending cup for positioning in the receiving area of the universal adapter. An inner magnet assembly is positioned in the cup and rotatable therein by magnetic coupling to the outer magnet assembly through the cup. A driven shaft (e.g. a hex drive) is connected to, and extends forward from, the inner magnet assembly. A first gear is mounted on the driven shaft and a second gear is rotated by the first gear to pump fluid from the inlet to the outlet.

In another aspect, the inventive concepts disclosed herein are directed to a pump assembly for mounting on a universal adapter having a rearward end for attachment to a motor, a forward opening receiving area, an outer magnet assembly rotatable around the receiving area by a motor, and a forward mounting plate surrounding the forward opening receiving area. The mounting plate has mounting features for attachment to the back cover of each of a variety of pump assemblies. The pump assembly includes a casing having an inlet and an outlet. A back cover attached to the casing, the back cover having mounting features for alignment with, and attachment to, the mounting features of the forward mounting plate of the universal adapter. A containment shell includes a rearward extending cup for positioning in the receiving area of the universal adapter. An inner magnet assembly is positioned in the cup and is rotatable therein by magnetic coupling to the outer magnet assembly through the cup. A wobble plate is rotatable within the casing by the inner magnet assembly. Multiple reciprocating diaphragm devices are actuated by the wobble plate upon rotation thereof to pump fluid from the inlet to the outlet.

In another aspect, the inventive concepts disclosed herein are directed to a universal pump assembly for mounting interchangeably, on an adapter or on a canned motor. The adapter has a rearward end for attachment to a motor, a forward opening receiving area, an outer magnet assembly rotatable around the receiving area by a motor, and a forward mounting plate surrounding the forward opening receiving area. The canned motor has a stator, a rotor mounted on a drive shaft, a containment sleeve between the stator and rotor, and a front mounting ring. The universal pump assembly includes a casing having an inlet and an outlet, an impeller rotatable within the casing to pump fluid from the inlet to the outlet; and a mounting ring attached to the casing. The mounting ring has mounting features for attachment to the mounting plate of the adapter or to the mounting ring of the canned motor.

Embodiments of the inventive concepts can include one or more or any combination of the above aspects, features and configurations.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated, and some features may be omitted or may be represented schematically in the interest of clarity. Like reference numbers in the drawings may represent and refer to the same or similar element, feature, or function. In the drawings.

DETAILED DESCRIPTIONS

The description set forth below in connection with the appended drawings is intended to be a description of various, illustrative embodiments of the disclosed subject matter. Specific features and functionalities are described in connection with each illustrative embodiment; however, it will be apparent to those skilled in the art that the disclosed embodiments may be practiced without each of those specific features and functionalities. The aspects, features and functions described below in connection with one embodiment are intended to be applicable to the other embodiments described below except where expressly stated or where an aspect, feature or function is incompatible with an embodiment.

Figure 1:
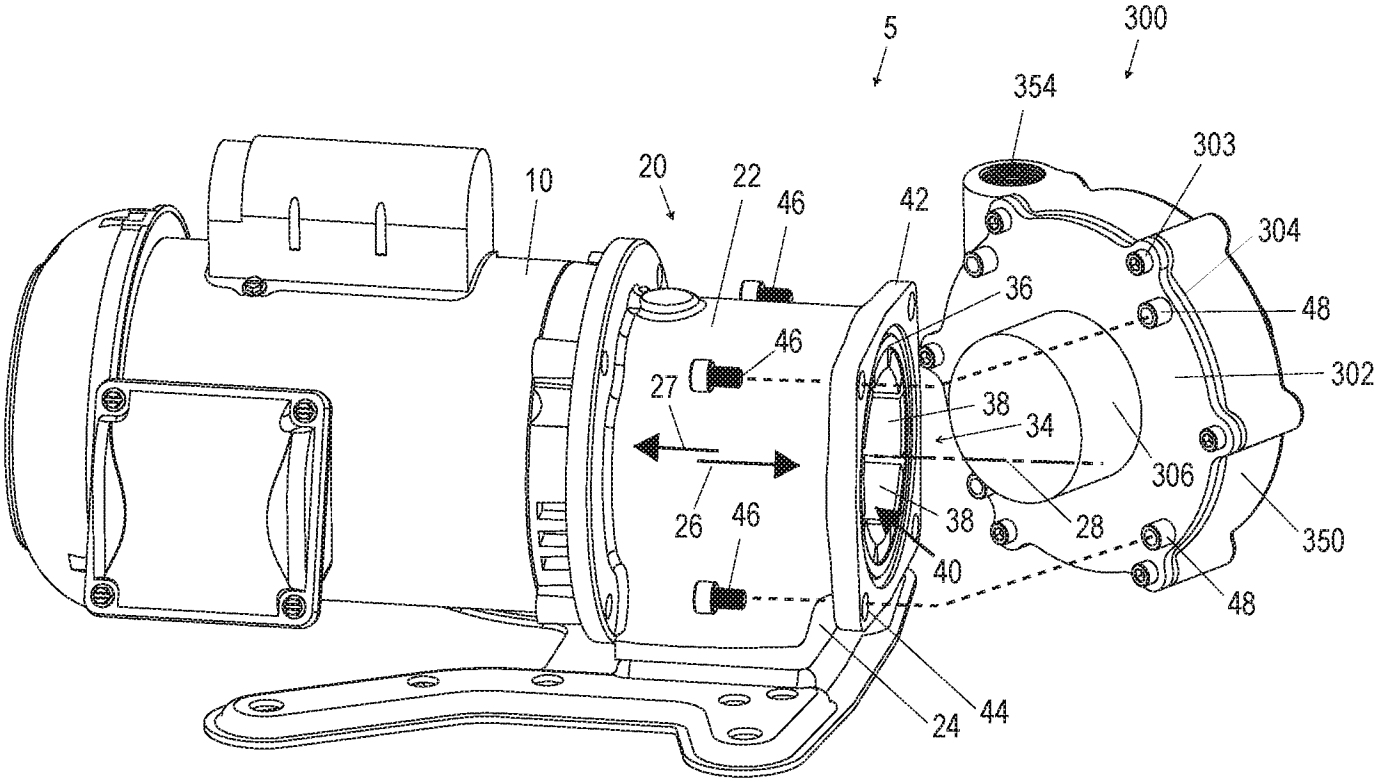
FIG. 1 is a perspective view of a motor and universal adapter, for use with any of the pump assemblies of the present disclosure, shown with the pump assembly of FIG. 5A dismounted therefrom for illustrative example.
Figure 5A:
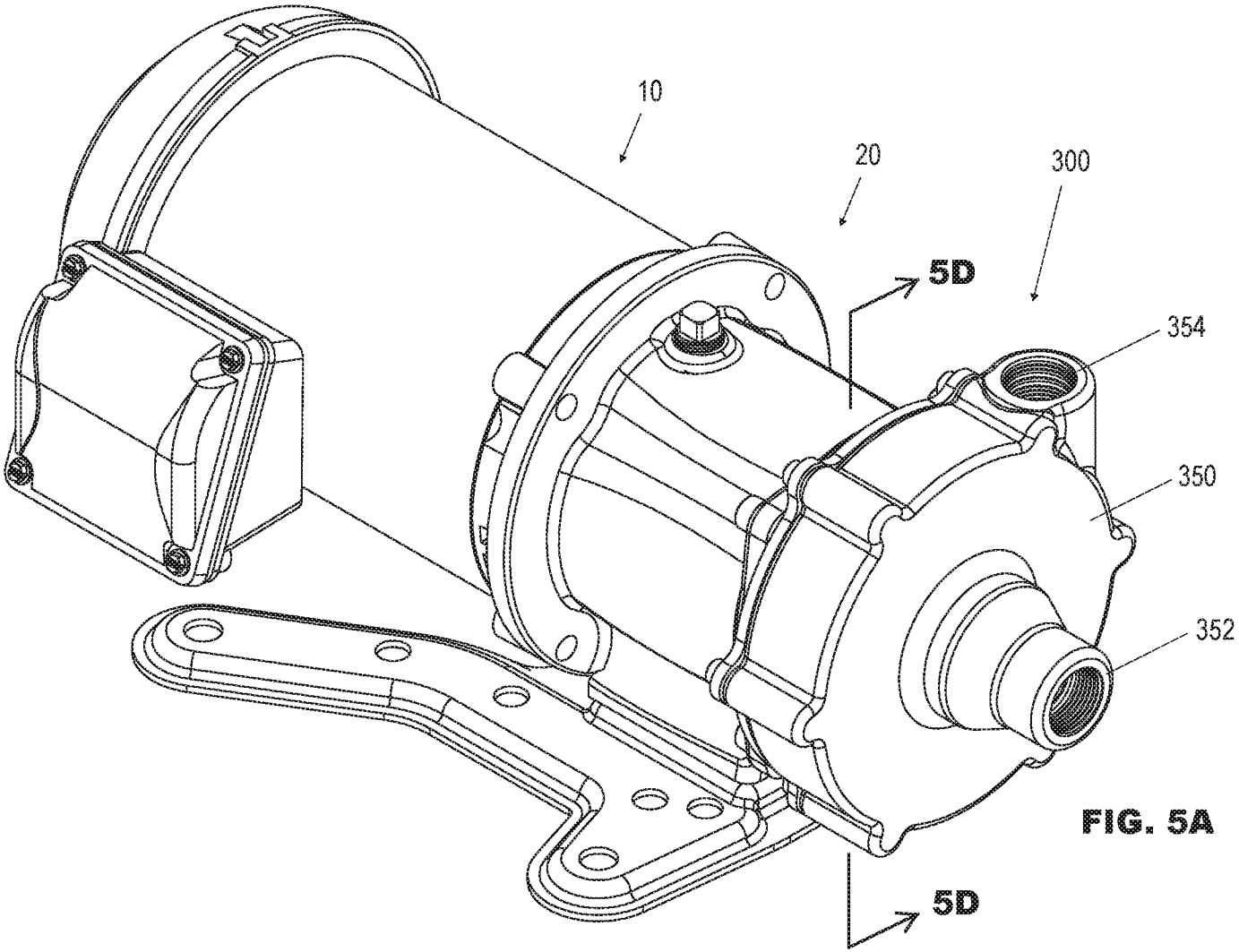
FIG. 5A is a front perspective view of a disc pump assembly according to the present disclosure mounted on the motor and universal adapter of FIG. 1.
Figure 5B:
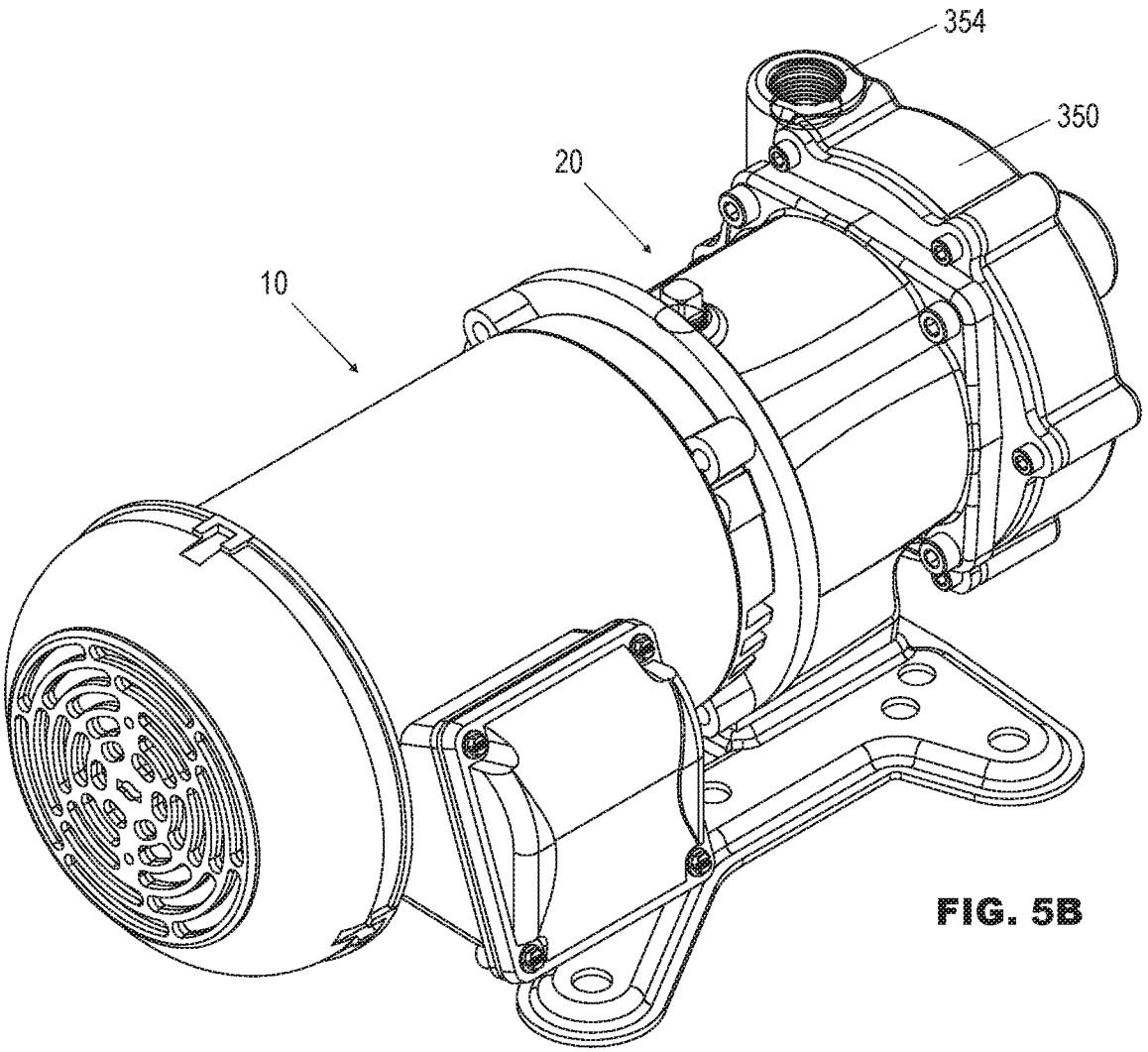
FIG. 5B is a back perspective view of the mounted disc pump assembly of FIG. 5A.

FIG. 1 is a perspective view of a pumping system 5 that includes a motor 10, an attached universal adapter 20, and a pump assembly 300. The motor 10 and adapter 20 can be used with any of the pump assemblies of the present disclosure as shown in some of the other drawings. The pump assembly 300 of FIG. 5A is shown in FIG. 1 as dismounted from the adapter to provide a non-limiting illustrative example. The motor 10 shown is electrically powered and serves to provide rotation to mechanically power drive components within the adapter 20. The cross-sectional view of FIG. 2D for example, and other cross-sectional views of the drawings, show the motor 10 as a whole without illustration of its internal components. An electrically powered motor, suited for use with the adapter and pump assemblies disclosed herein, is within the understanding of those of ordinary skill in arts related to these descriptions, particularly with the benefits of this disclosure in view.

The adapter 20 has a housing 22 that is stationary in typical use. The adapter housing 22 can be constructed of metal for durability, as a non-limiting example. The housing can be affixed to a host structure by a base 24 to which the housing is attached. In the illustrated example, the base 24 has a forward foot and rearward diverging arms that extend longitudinally rearward and laterally outward from the motor for stability and balance. The base and arms have mounting holes to receive bolts or screws or other fasteners to affix the base. These descriptions generally refer to forward features of the pump assemblies of the drawings with respect to a forward direction 26 in which the adapter 20 faces away from the motor 10, and rearward features as directed opposite the forward features and with respect to the rearward direction 27.

The motor 10 and adapter 20 have respective components that rotate around a longitudinal axis 28, along which the forward direction 26 and rearward direction 27 are defined. In particular, the adapter 20 has a rotatable assembly 30 mounted within the housing 22. The rotatable assembly 30 has a rearward barrel 32 for engaging a rotary drive shaft 12 of the motor 10 (see FIG. 2D for example). The rotary assembly has a forward magnet assembly 34 connected to and rotated by the barrel 32. The magnet assembly 34 has a forward opening cylinder 36 and permanent magnets 38 attached at uniformly spaced angular intervals to the interior wall of the cylinder. The magnets 38 are carried by the cylinder 36 to rotate around the longitudinal axis 28 when the motor 10 is active. The magnet assembly 34 of the adapter 20 magnetically couples with magnet assemblies of the various pump assemblies to rotationally drive the pump assemblies.

A forward opening receiving area 40 (FIG. 1), around the longitudinal axis 28, is defined within the rotating cylinder 36 and arrangement of magnets 38 at the forward end of the adapter 20. The adapter has a forward mounting plate, referenced as the front plate 42, surrounding the receiving area 40. The front plate 42 has holes 44 for alignment with corresponding mounting features of the pump assemblies by use of mounting fasteners, such as externally threaded mounting bolts 46 as illustrated in FIG. 1, which are received and retained by bored and internally threaded posts 48 extending from an outer back cover of the illustrated pump assembly. The pump assembly shown, and its back cover, are referenced in FIG. 1 as the pump assembly 300 and back cover 302, according to the non-limiting example shown in which the disc pump assembly 300 of FIGS. 5A-5D is shown. It is understood that other pump assemblies shown in the other drawings and described in the following are interchangeable with the pump assembly 300 for mounting on the adapter 20. Accordingly, the other pump assemblies include similar mounting features as the internally threaded posts 48. For example, internally threaded holes 1048 (FIG. 12C) formed in the back cover can also serve as mounting features instead of, or in combination with, the internally threaded posts 48.

As with some of the other pump assemblies of the drawings, the pump assembly 300 of FIG. 1 has a stationary containment shell 304 that serves as a barrier between any pumped fluids and the adapter 20. The containment shell has a rearward extending cup 306. A magnet assembly is rotatably mounted within the cup to magnetically couple to the magnet assembly 34 of the adapter 20 through the cup. When a pump assembly, such as the disc pump assembly 300 as shown in FIG. 1, is mounted upon the adapter 20, the cup 306 is positioned within the receiving area 40, with the cup and magnet assembly of the pump assembly being surrounded by, and concentric with, the magnet assembly 34 of the adapter. Accordingly, the magnet assembly 34 of the adapter 20 is referenced below as the outer magnet assembly and the magnet assemblies of the pump assemblies are referenced as inner magnet assemblies.

In terminology used in the related industries, the cup 306 of the containment shell is sometimes called a "can." The adapter 20 and motor 10 rearward of the containment shell are called the "dry end" of the pumping system as they are separated from pumped fluids by at least the containment shell. The pump assembly generally forward of the containment shell is correspondingly called the "wet end" of the pumping system, in which fluids are pumped.

The pump assemblies described in the following can generally be interchangeably mounted on the adapter 20 for different uses and pumped fluids. Each includes a respective casing having a back end to which a respective containment shell and back cover 302 are attached. The cup 306 of the containment shell extends through a central hole of the cover 302. Each pump assembly is a distinct but interchangeable unit that is separable from the adapter. Each such pump assembly accordingly has assembly fasteners, such as the back assembly bolts 303 shown in FIG. 1, that are separate from the mounting bolts 46 by which the back cover 302 is attached to the front plate 42 of the adapter 20. Each pump assembly disclosed herein may or may not include a drain.

Figure 5C:
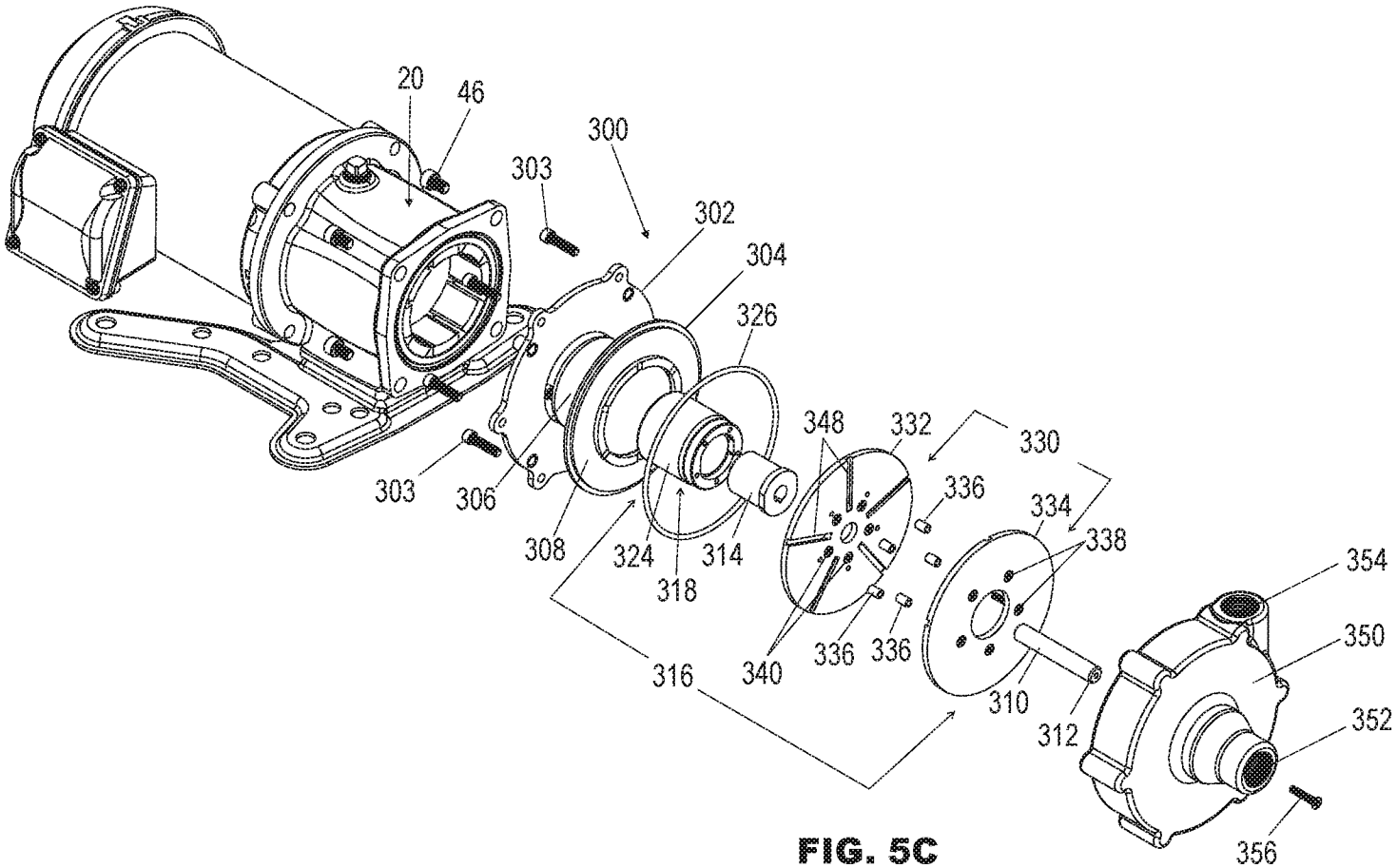
FIG. 5C is an exploded perspective view of the disc pump assembly of FIG. 5A.
Figure 5D:
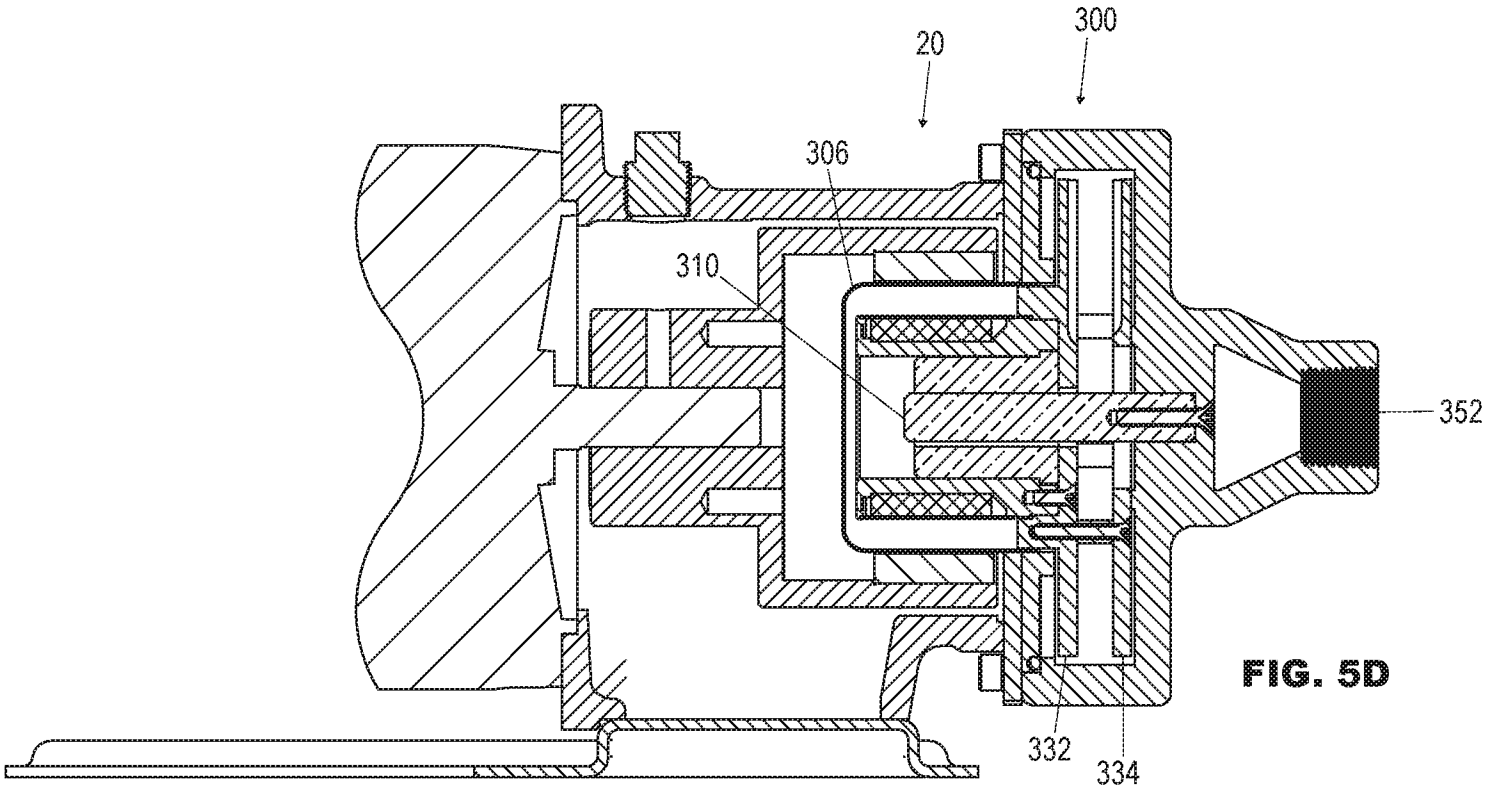
FIG. 5D is a cross-sectional view of the disc pump assembly of FIG. 5A taken along the lines 5D-5D.

The stationary containment shell 304 has a forward flange 308 extending outward at the forward end of the cup 306 (see also FIG. 5C). The flange for example may be integrally formed with the cup to assure sealing. The flange is generally trapped between the back cover 302 and casing 350 by the back assembly bolts 303. The pump assembly is generally to be mounted upon, and removable from, the adapter by use of the mounting bolts 46 without separating the back cover 302 and containment shell 304 from the casing 350.

Figure 2A:
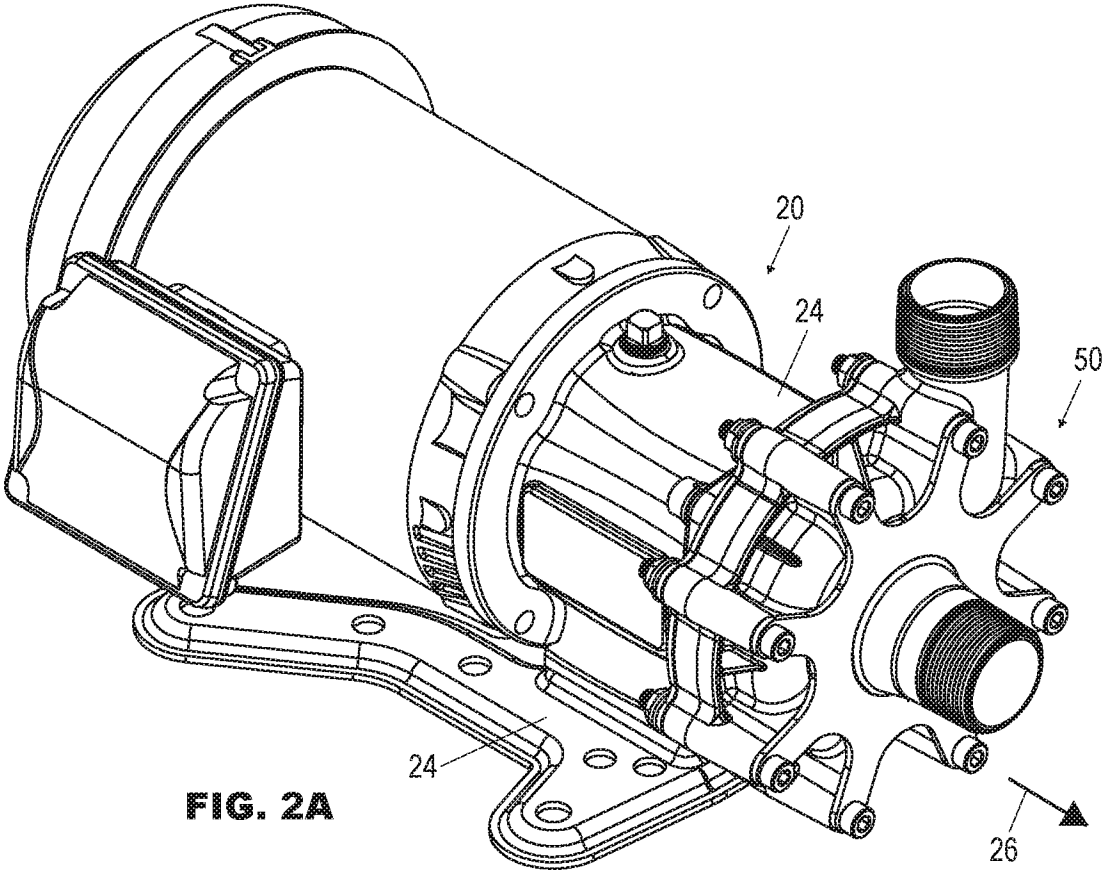
FIG. 2A is a front perspective view of a centrifugal pump assembly according to the present disclosure mounted on the motor and universal adapter of FIG. 1.
Figure 2B:
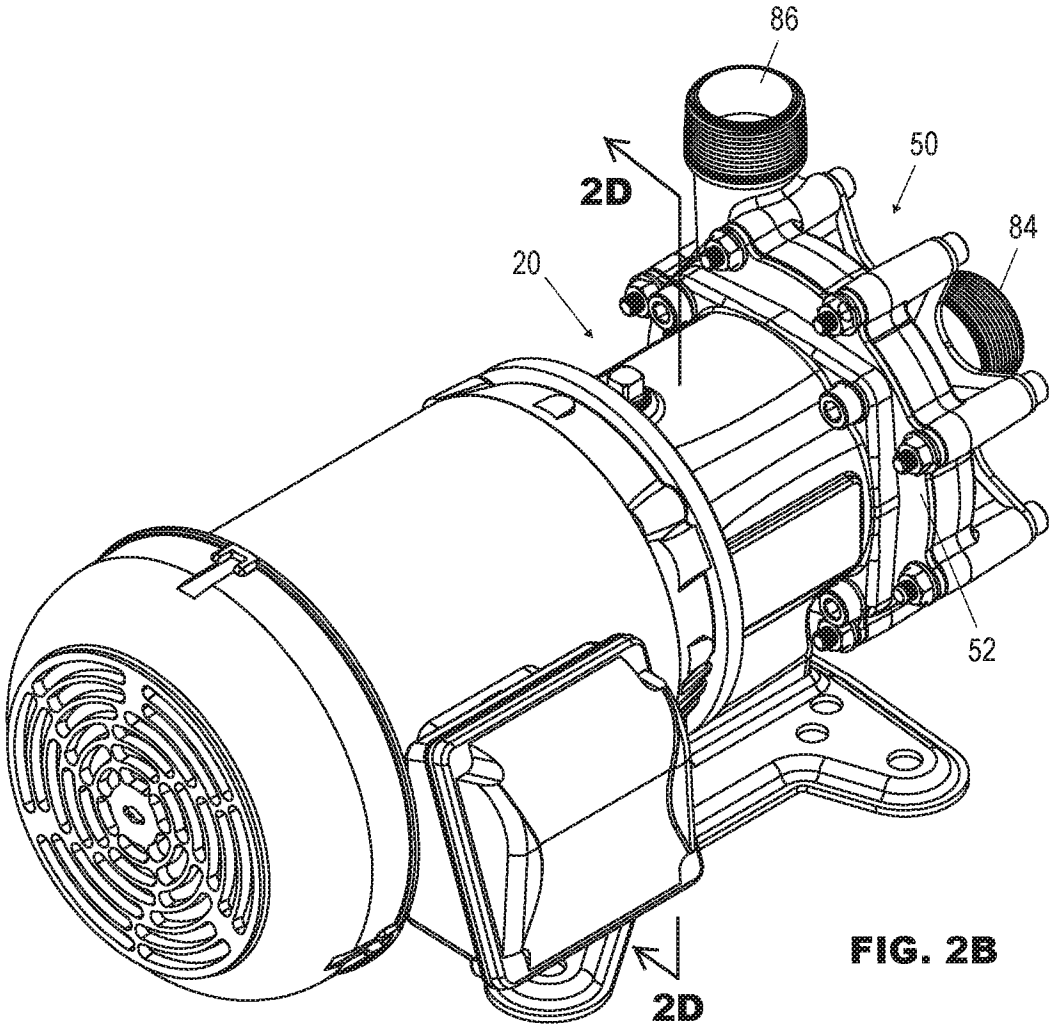
FIG. 2B is a back perspective view of the mounted centrifugal pump assembly of FIG. 2A.
Figure 3A:
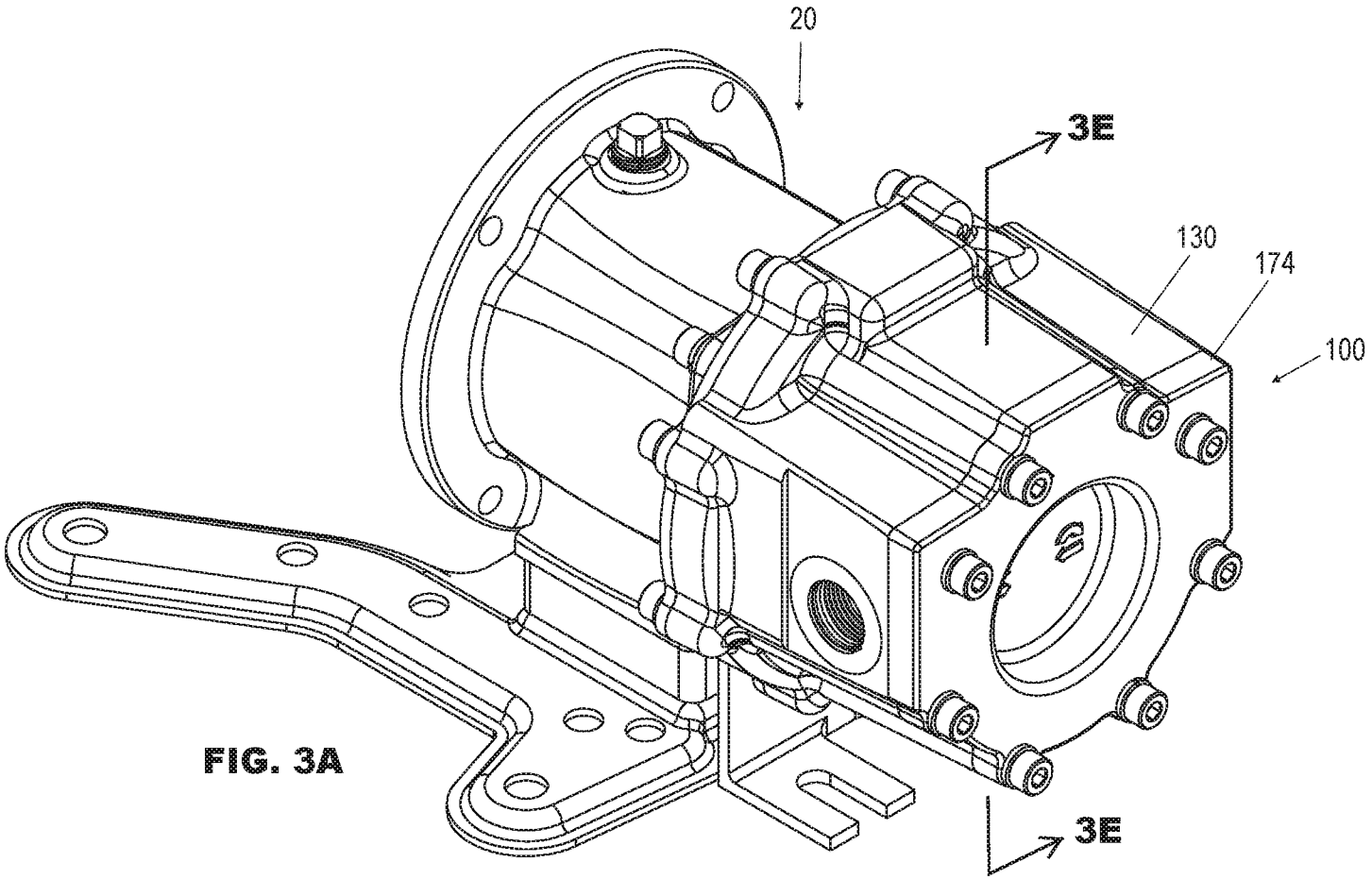
FIG. 3A is a front perspective view of an internal-gear pump assembly according to the present disclosure mounted on the universal adapter of FIG. 1.
Figure 3B:
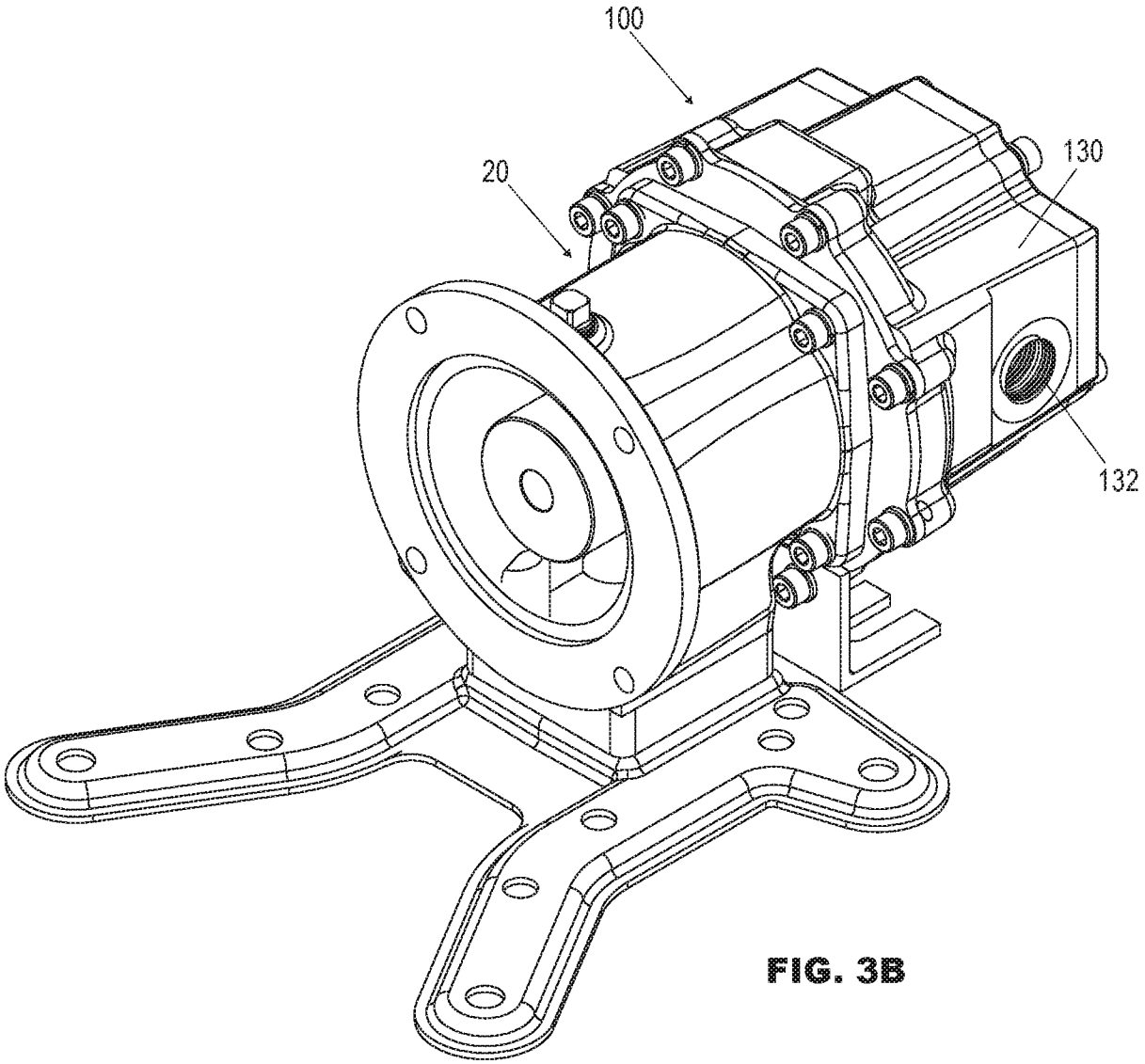
FIG. 3B is a back perspective view of the mounted internal-gear pump assembly of FIG. 3A.

Each pump assembly described herein is given a nominal term to keep the respective description of each as distinct from the others. Such nominal terms used for brevity and clarity impose no limitations on the described pump assemblies. For example, the pump assembly of FIG. 2A is referenced as a centrifugal pump assembly 50, whereas the pump assembly of FIG. 3A is referenced as an internal-gear pump assembly 100. Each distinct pump assembly described and illustrated has features that are unique with respect to the others; and, each may have features similar to, or common with, some of the others. Thus, each pump assembly is separately described and referenced, and each should be understood in view of the descriptions and drawings as a whole, without limitation in view merely of the nominal terms they are assigned.

Figure 2C:
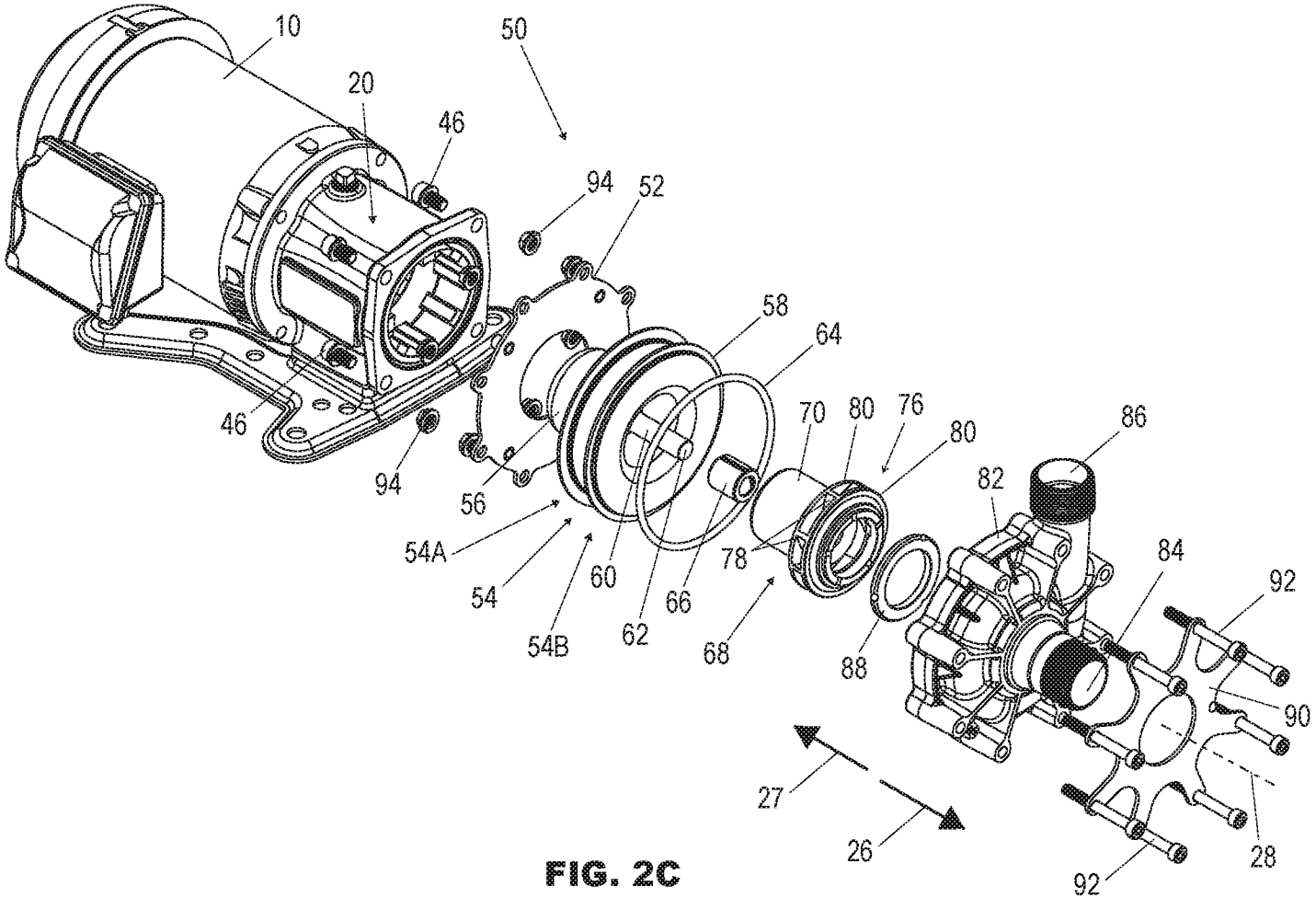
FIG. 2C is an exploded perspective view of the centrifugal pump assembly of FIG. 2A.

Turning now to FIGS. 2A-2D, a particular pump assembly, referenced as a centrifugal pump assembly 50, is shown in FIG. 2A mounted on the universal adapter 20. An outer back cover 52 abuts the flange portion of the containment shell 54, as shown in FIG. 2C. The containment shell 54 in both the cup 56 and flange 58 thereof, has a layered or two-piece construction. Alternatively, the containment shell 54 may be fabricated from a single layer where the material has both strength and chemical resistance to pumped fluid. The back outer shell component 54A, facing outward from the interior of the pump assembly, provides strength and can be made of fiber-filled plastic, composite material, and poly paraphenylene terephthalamide such as Kevlar, as non-limiting examples. The front inner shell component 54B, facing into the interior of the pump assembly 50 and accordingly being wetted by pumped fluids, can be made of chemically resistant plastic to withstand exposure to pumped fluids. Thus, in layered or two-piece containment shell examples, each outer shell component (for example referenced as 54A in FIG. 2C) supports a corresponding inner shell component (referenced as 54B in FIG. 2C) against internal pump pressures, and the inner shell component protects the outer shell component from fluid exposure within the pump assembly, or "wet end."

The outer shell components 54A and inner shell component 54B may be separately fabricated and nested together in assembly. For example, the outer shell component 54A can be fabricated of fiber-filled polypropylene by injection molding, or can be fabricated of Kevlar, to form a strong composite component to be nested with the inner shell component 54B.

The containment shell 54, whether one-piece or layered, can be constructed from any of metallic materials, non-metallic materials, or combinations thereof. For example, non-metallic materials may be used to avoid heating by eddy currents which can be produced in use because the cup 56 of the containment shell 54, for example, is positioned within the rotating outer magnet assembly 34 of the adapter 20. Metal containment shells may be equally suitable for high or low speed applications provided enough cooling of the containment shell surface from eddy current heating. In other non-limiting examples, stainless steel having both strength and resistance against some fluids can be used to construct a one-piece containment shell for lower rotational speed uses or can be used particularly for the strength component thereof in situations of high pressure. In other example, metals may be used for higher rotational speed applications (e.g., 3600 rpm), provided the internal fluid flow properly cools the containment shell 54. Alternative embodiments may include multi-layer metal shells and combinations of non-metallic materials and metals.

Figure 2D:
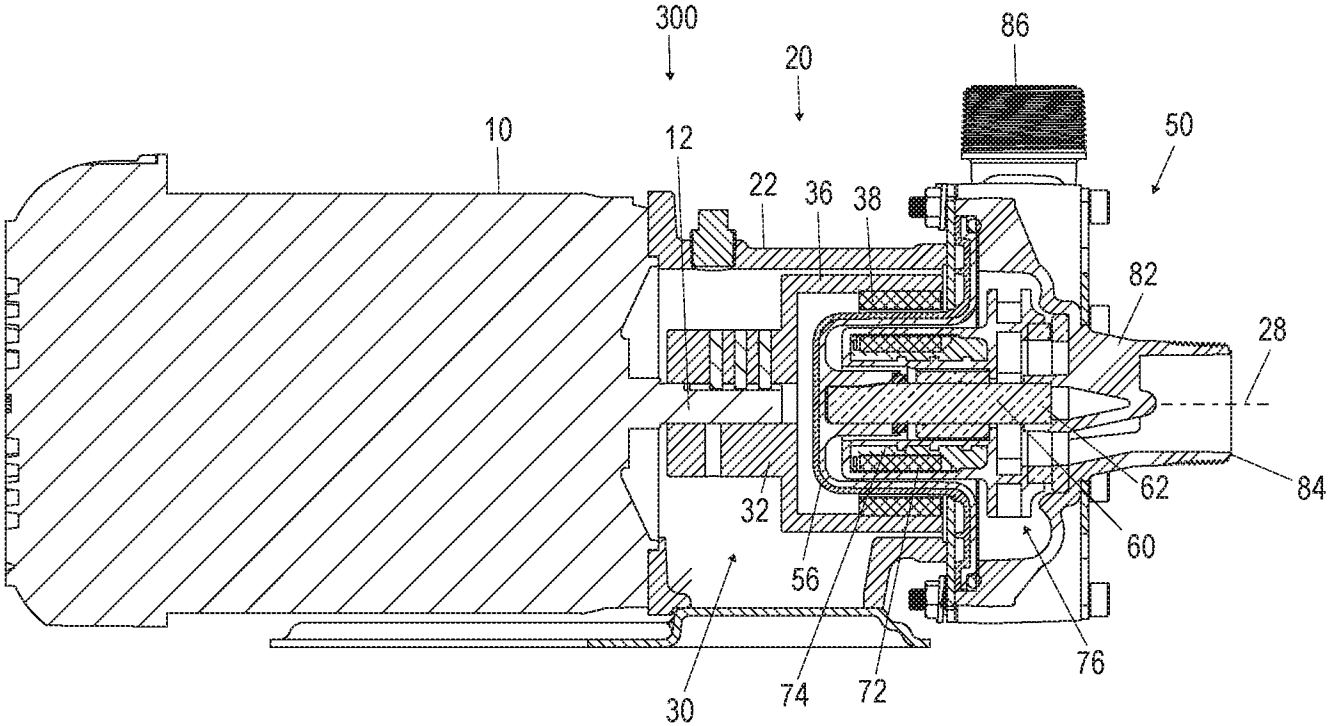
FIG. 2D is a cross-sectional view of the centrifugal pump assembly of FIG. 2B taken along the lines 2D-2D.

A stationary shaft 60 serves as an axle, along the longitudinal axis 28, on which the internal rotating components of the pump assembly 50 rotate. As shown in FIG. 2D, the shaft 60 has a rearward end fixed, for example by a press fit, to the containment shell 54 within the cup 56 and a forward end 62 fixed to a stationary casing 82. The shaft 60 can be constructed of, as a non-limiting example, silicon carbide. A gasket 64, illustrated for example as an O-ring, seals the forward side of the containment shell 54 with the casing 82.

The gasket 64 can be constructed of, as a non-limiting example, an elastomer, polymer, neoprene or other resilient sealing material.

A rotating bushing 66 is rotatably mounted on the shaft 60, and a rotatable driven assembly 68 is mounted on the bushing 66 for rotation on the shaft 60. The driven assembly 68 has a rearward inner magnet assembly 70 in which permanent magnets 72 (FIG. 2D) are attached at uniformly spaced angular intervals to a central hub 74, which may be metal for example. The magnets 72 and hub 74 may be encapsulated in an outer shell, which may be plastic for example. For coupling the inner magnet assembly 70 of the pump assembly 50 to the outer magnet assembly 34 of the adapter 20, the inner and outer magnet assemblies (70, 34) may have the same number of magnets (72, 38), and the magnets of each may be spaced at the same angular intervals.

The driven assembly 68 has a forward centrifugal impeller 76 (FIG. 2C) mounted on a hub connected to the forward end of the inner magnet assembly 70. The centrifugal impeller 76 moves pumped fluid by the transfer of rotational energy from rotatable assembly 34 of the adapter 20, to the driven assembly 68 and impeller 76, to a pumped fluid. The impeller 76 has radially spiraled vanes 78 between a longitudinally spaced pair of annular shrouds such as plates 80, which may or may not be curved. The impeller 76 may be integrally formed with the outer shell of the magnet assembly 70 for a one-piece construction. The impeller 76 may also be integral with the inner hub 74, depending on materials.

The inner magnet assembly 70 is positioned within the cup 56 of the containment shell 54 upon assembly and the centrifugal impeller 76 is positioned within the casing 82. Upon rotation of the driven assembly 68, a pumped fluid enters the interior of the impeller 76 via a central tubular inlet 84 of the casing 82, and is cast radially outward through centrifugal force by the vanes 78 to be tangentially ejected through a peripheral tubular outlet 86 of the casing.

A bushing ring 88 is stationary within the casing 82 and takes any axial load from the rotating impeller 76. A front assembly ring 90 surrounds the inlet 84. Front assembly bolts 92 (threaded) pass through holes in radial arms of the assembly ring 90, in alignment with holes spaced along the periphery of the casing 82, and holes spaced along the periphery of the back cover 52, to engage corresponding back assembly nuts 94 behind the cover 52. The centrifugal pump assembly 50 is maintained as a unit by the front assembly ring 90 and back cover 52.

As non-limiting examples, the centrifugal pump assembly 50 can be used to pump low to medium viscosity (0.1-150 cP) liquids. Clean liquids (free of Iron) can be pumped. Low to high flow rates at low to high pressures can be produced. The centrifugal pump assembly 50 can be used for chemical, industrial, and waste water pumping.

As non-limiting examples, the casing 82 can be plastic. The back cover 52 and front assembly ring 90 can be metal. The containment shell 54 can be two layered. The impeller 76 can be plastic. The bushings and shaft can be SIC.

Turning now to FIGS. 3A-3G, a particular pump assembly, referenced as an internal gear pump assembly 100, is shown in FIG. 3A mounted on the universal adapter 20. An outer back cover 102 (FIG. 3C) abuts the flange portion of the containment shell 104. The containment shell 104, similar to the containment shell 54, has a cup 106 and a flange 108, and may have a single layer, layered or two-piece construction.

A stationary shaft 110 serves as an axle extending longitudinally from the interior of the cup 106. The shaft 110 has a rearward portion fixed to the cup 106, and a forward portion 112 that may be diameter reduced relative to the rearward portion. A first rotating bushing 114 is mounted on the rearward portion of the shaft 110, and a smaller second rotating bushing 115, is mounted on the diameter reduced forward portion 112. A rotatable driven assembly 116 has rearward and forward portions mounted respectively on the first bushing 114 and second bushing 115 for rotation on the shaft 110.

In particular, the rearward portion of the rotatable driven assembly 116 includes a rearward inner magnet assembly 118 in which permanent magnets 120 (FIG. 3E) are attached at uniformly spaced angular intervals to a central hub 122, which may be metal for example. The magnets 120 and hub 122 are encapsulated in an outer shell, which may be plastic for example. The inner magnet assembly 118, by coupling to the outer magnet assembly 34 of the adapter 20, rotates the driven assembly 116.

The forward portion of the driven assembly 116 includes a driven shaft 124 connected to and extending forward from the inner magnet assembly 118. The driven shaft may be, for example, integral with the magnet assembly 118 for a one-piece construction. The driven shaft 124 transfers rotational energy from the inner magnet assembly 118, which is driven by magnetic coupling with the adapter 20, to the fluid or material pumping components of the pump assembly 100. The inner magnet assembly 118 rotates within the cup 106 of the containment shell 104 and the driven shaft 124 rotates within the casing 130. A gasket 138, illustrated for example as an O-ring, seals the forward side of the containment shell 104 with the casing 130. The gasket 138 can be constructed of, as a non-limiting example, an elastomer, polymer, neoprene or other resilient sealing material.

Within the casing 130, a stationary outer liner insert 140 is positioned within a cylindrical inner wall of the casing 130. The cylindrical wall, and the liner insert 140 therewith, are axially offset relative to the longitudinal axis defined by the shaft 110 and about which the driven shaft 124 rotates. The liner insert 140 sets the axially offset positions of other further interior components. A first gear, referenced as an axially centered spur gear 128, is mounted on and rotates with the driven shaft 124.

The driven shaft 124 and spur gear 128 are illustrated as having mutually-engaged respective close-fitting exterior and interior hexagonal engagement surfaces. Other engagement surfaces can include, but are not limited to, a spline, single flat, multiple flats, etc. The spur gear 128, having outward extending gear teeth, rotates a second gear, referenced as an internal gear 144, which has radially inward extending gear teeth of greater number than the teeth of the spur gear 128. The internal gear 144 is radially offset from the concentric shaft 110, driven shaft 124, and spur gear 128. The spur gear 128 and internal gear 144 have mutually engaged teeth and disengaged teeth at any rotational position. An offset interior space is thereby defined for the passage of pumped fluid or material between the disengaged teeth. The spur gear 128 and internal gear 144 together define an internal gear impeller.

A stationary bushing ring 146 maintains the internal gear 144 in its radial offset position, relative to the shaft 110 within the liner insert 140. The spur gear 128, internal gear 114, and stationary bushing ring 146 are trapped between a stationary radially offset inner back plate 150 and a stationary radially offset inner front plate 160. The back plate 150 has a hole 152 in which a rear portion of the driven shaft 124 rotates. The front plate 160 has a hole 168 that receives the forward portion 112 of the shaft 110.

A stationary crescent guide 154 has a forward end engaged in a crescent slot of the front plate 152. As shown in FIG. 3G, the crescent guide 154 divides the radially offset interior space defined between the spur gear 128 and internal gear 144. The crescent guide 154 is positioned between the disengaged teeth of the spur gear 128 and internal gear 144 and thus divides the interior space therebetween. A forward insert 170 engages the forward end of the shaft 110 and maintains the position of the front plate 160. The forward insert 170 can be constructed, for example, of plastic such as that of the encapsulation of the magnet assembly 118 and that of the liner insert 140.

The casing 130 (FIG. 3C) has a lateral side opening first port 132 aligned with each of a first port 142 of the liner insert 140 and a first port 172 of the forward insert 170. Similarly, the casing 130 has an opposite lateral side opening second port 133 aligned with each of a second port 143 of the liner insert 140 and a second port 173 (FIG. 3G) of the forward insert 170. The first ports 132, 142, and 172 serve as inlets in a first rotational direction of the driven shaft 124 and spur gear 128 (counterclockwise in FIG. 3G) and as outlets in an opposite second rotational direction thereof (clockwise). The second ports 133, 143, and 173 serve correspondingly opposite roles with respect to the first ports (132, 142, 172), for example as outlets for counter-clockwise rotation of the driven shaft 124 and spur gear 128 in FIG. 3G.

In either rotational direction of the driven shaft 124, external gear teeth of the first spur gear 128, which is mounted on the driven shaft 124, engage internal gear teeth of the internal gear 144, which is thereby rotated in the same rotational direction. The mutually engaged gear teeth exclude any pumped fluid therebetween as they mesh, forming a seal therebetween, thereby forcing pumped fluid to travel in the spaces between the disengaged teeth of both gears.

Figure 3C:
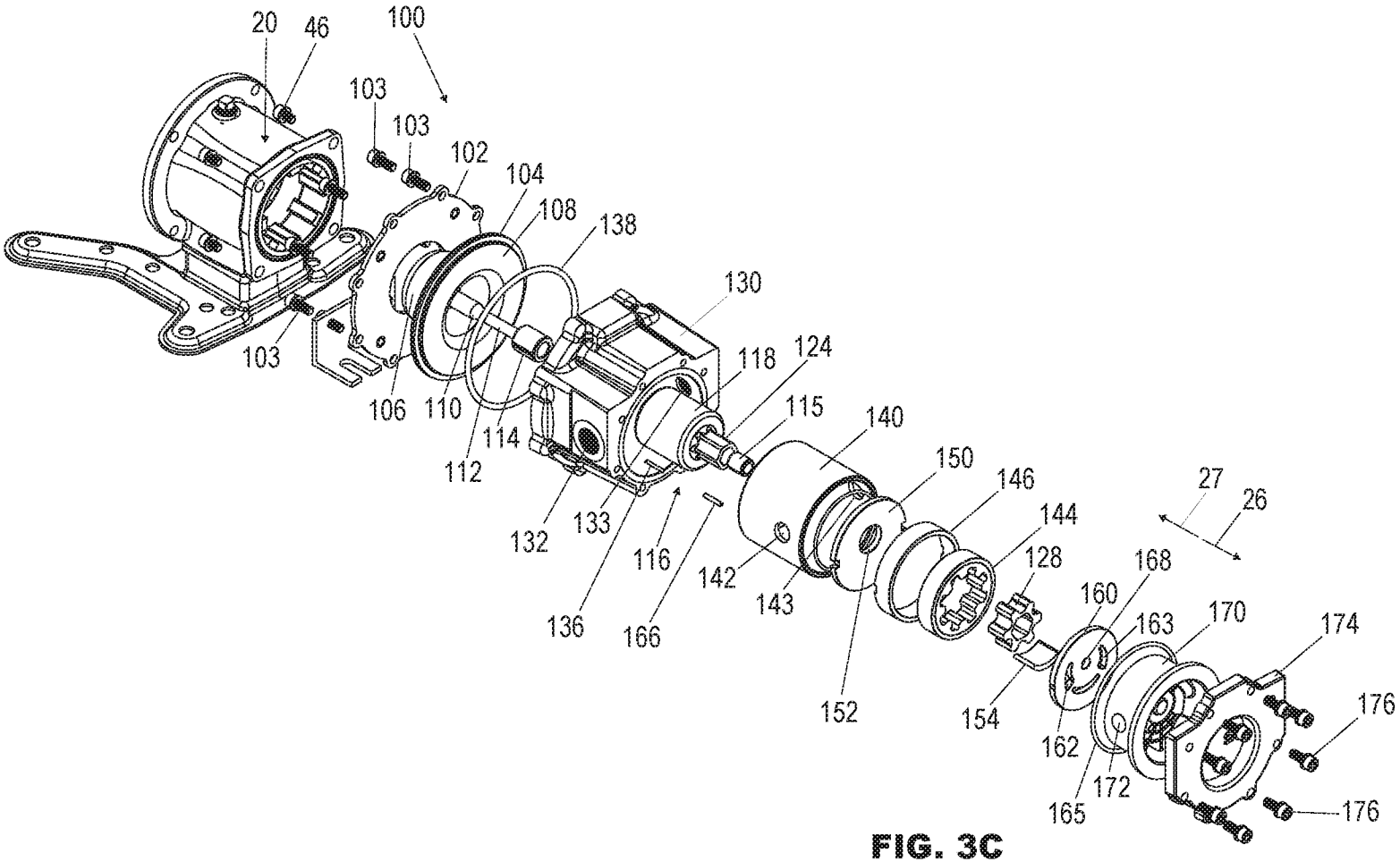
FIG. 3C is an exploded front perspective view of the internal-gear pump assembly of FIG. 3A.
Figure 3D:
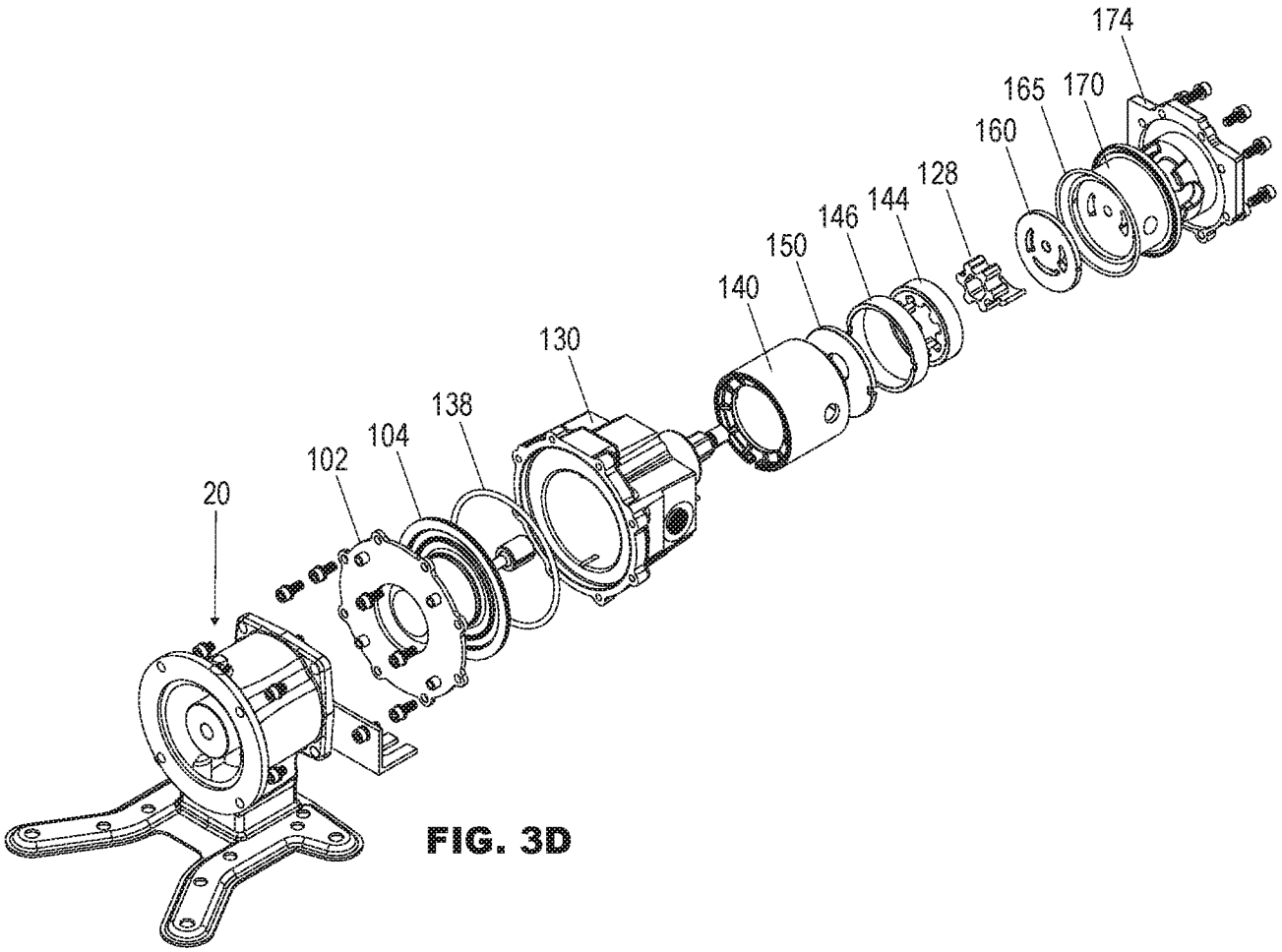
FIG. 3D is an exploded back perspective view of the internal-gear pump assembly of FIG. 3A.
Figure 3E:
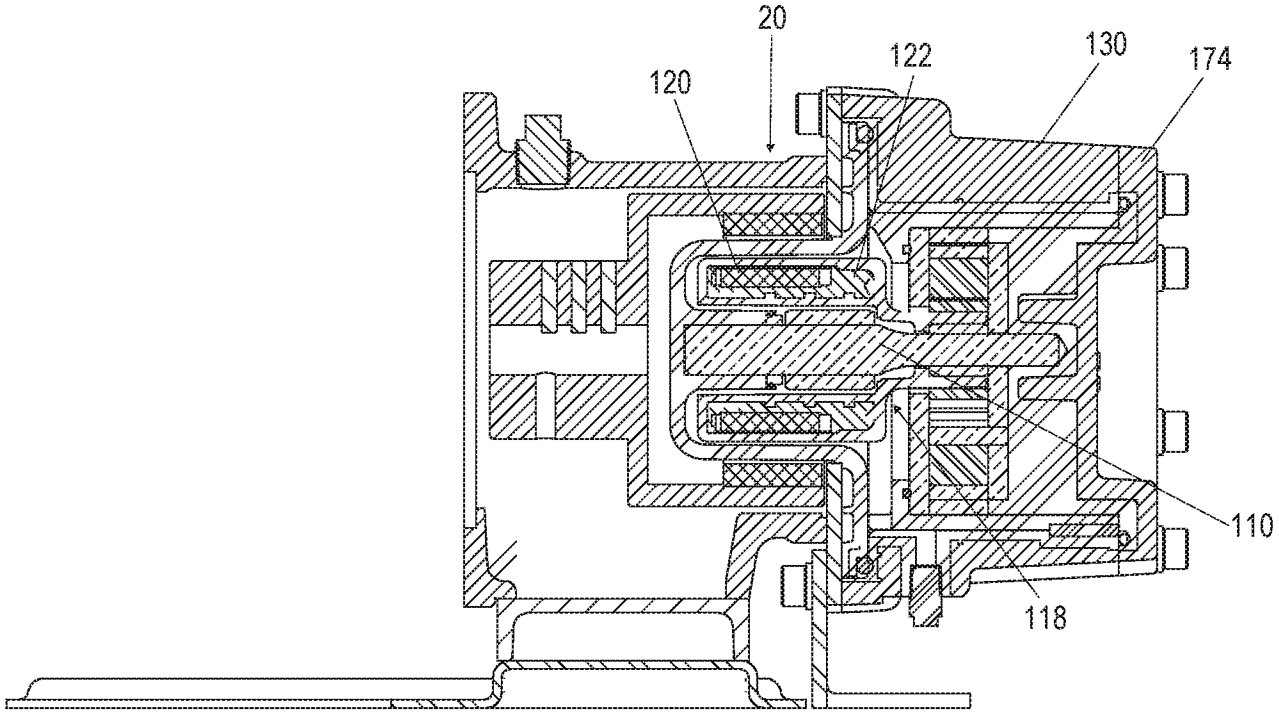
FIG. 3E is a cross-sectional view of the internal-gear assembly of FIG. 3A taken along the lines 3E-3E.
Figure 3G:
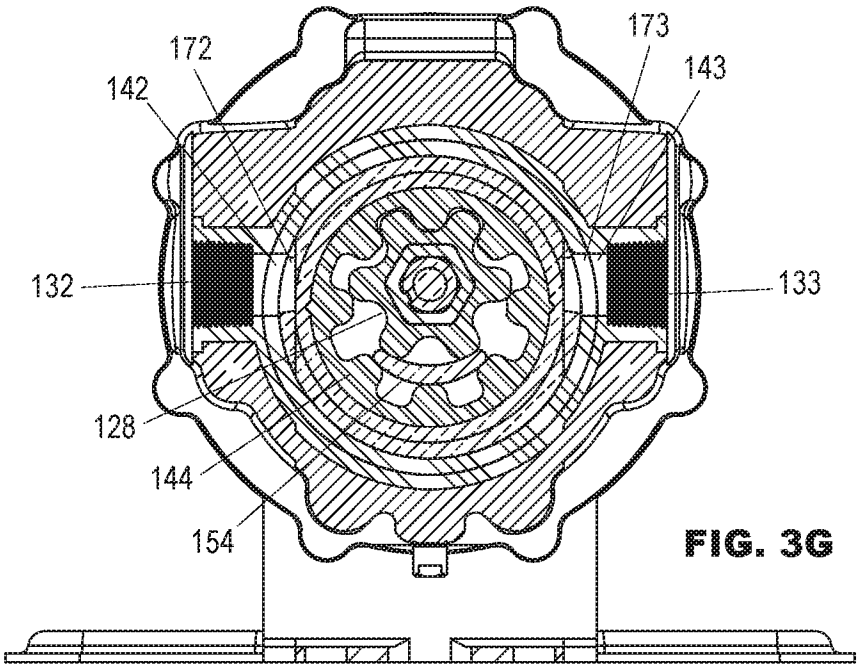
FIG. 3G is a cross-sectional view of the internal-gear assembly of FIG. 3F taken along the lines 3G-3G.
Figure 3F:
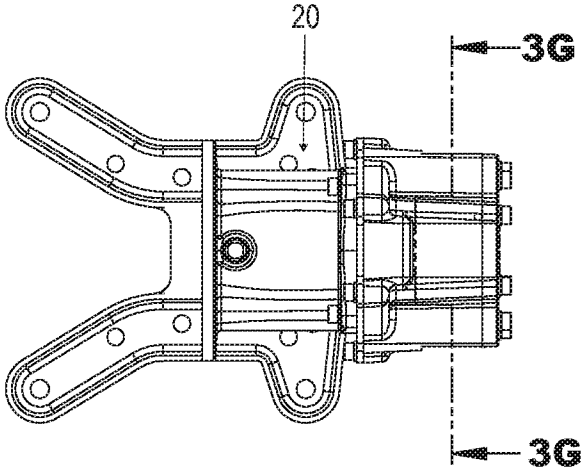
FIG. 3F is a top isometric view of the internal-gear assembly of FIG. 3A.

Assuming counter-clockwise rotation of the driven shaft 124, spur gear 128, and internal gear 144 in FIG. 3C, pumped fluid enters the pump assembly 100 radially or laterally through the first port 132 of the casing 130, and travels in the rearward direction 27 through a first arced slot 162 of the front plate 160 into the interior space between the disengaged teeth of the spur gear 128 and internal gear 144. The material then travels circumferentially with rotation of the spur gear 128 and internal gear 144, then in the forward direction 26 through a second arced slot 163 of the front plate 160, and exits the pump assembly 100 radially or laterally through the second port 133 of the casing 130. Upon opposite rotation of the driven shaft 124, the material travels oppositely through the pump assembly.

A stationary pin 166 engages an interior slot 136 in the casing 130 and an aligned slot in the liner insert 140, preventing relative rotation. The back plate 150 and the bushing ring 146 have aligned slots that engage an interior boss within the liner insert 140 to prevent rotation. The assembly is maintained from the back by fasteners, shown as back assembly bolts 103, attaching the back cover 102 to the back of the casing 130, and from the front by fasteners, shown as front assembly bolts 176, attaching an outer front cover 174 to the front of the casing 130. A forward gasket such as an O-ring 165 can be used to seal the forward portion of the casing 130.

The internal gear pump assembly 100 is generally self-priming. Non-limiting examples of use include chemical and hydraulic oil pumping. The pump assembly 100 can be used for metering purposes and other uses. Medium to high viscosity clean liquids (free of solids) can be pumped with low flow rates and high pressures.

As non-limiting examples, the casing 130 can be lined metal. The liner insert 140, and the forward insert 170 can be plastic. The outer front cover 174 can be plastic lined. The gears can be plastic. The back plate 150 and front plate 160, shaft, and bushings can be SIC. The inner magnet assembly 118 can be encased in plastic.

Figure 4A:
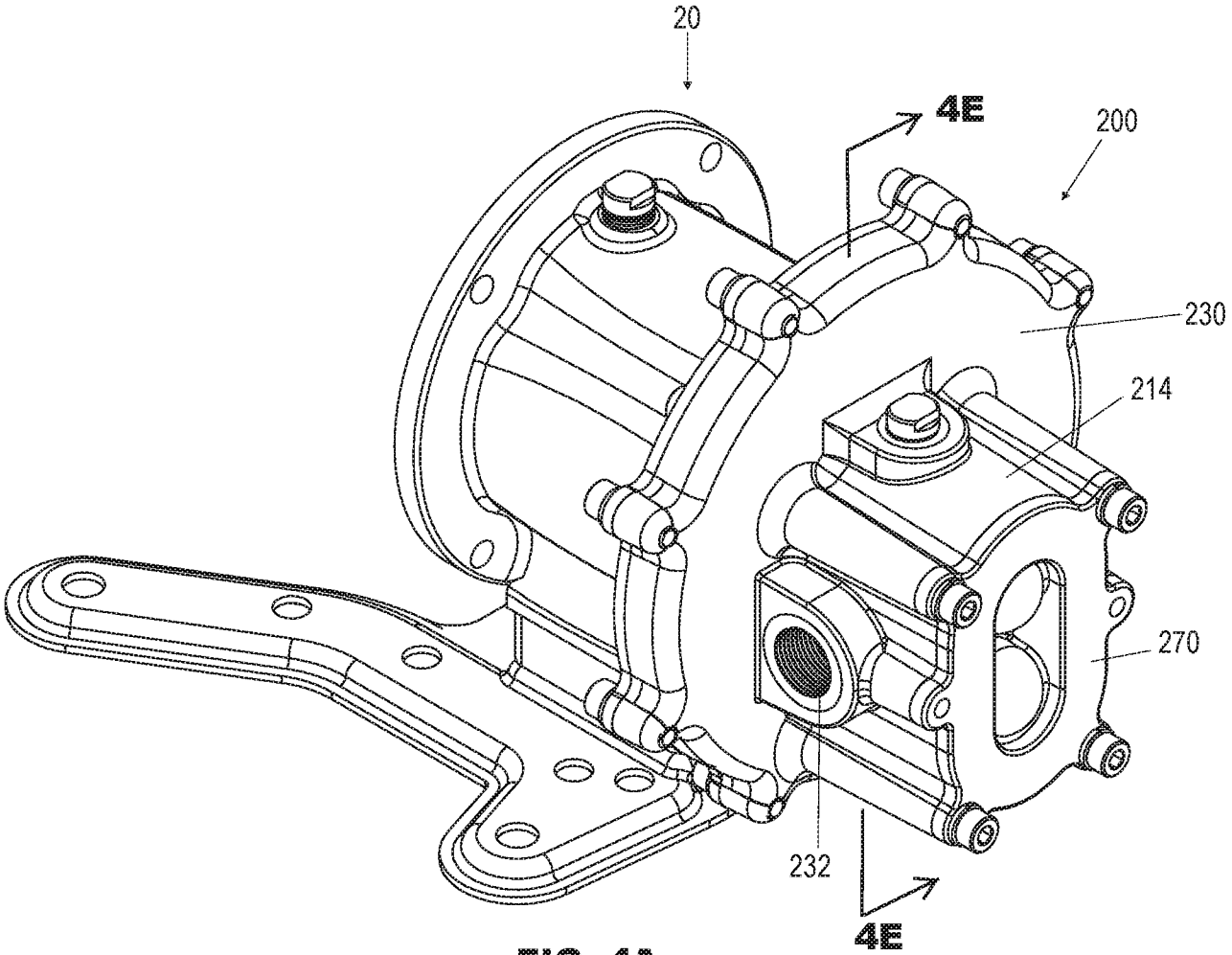
FIG. 4A is a front perspective view of an external-gear pump assembly according to the present disclosure mounted on the universal adapter of FIG. 1.
Figure 4B:
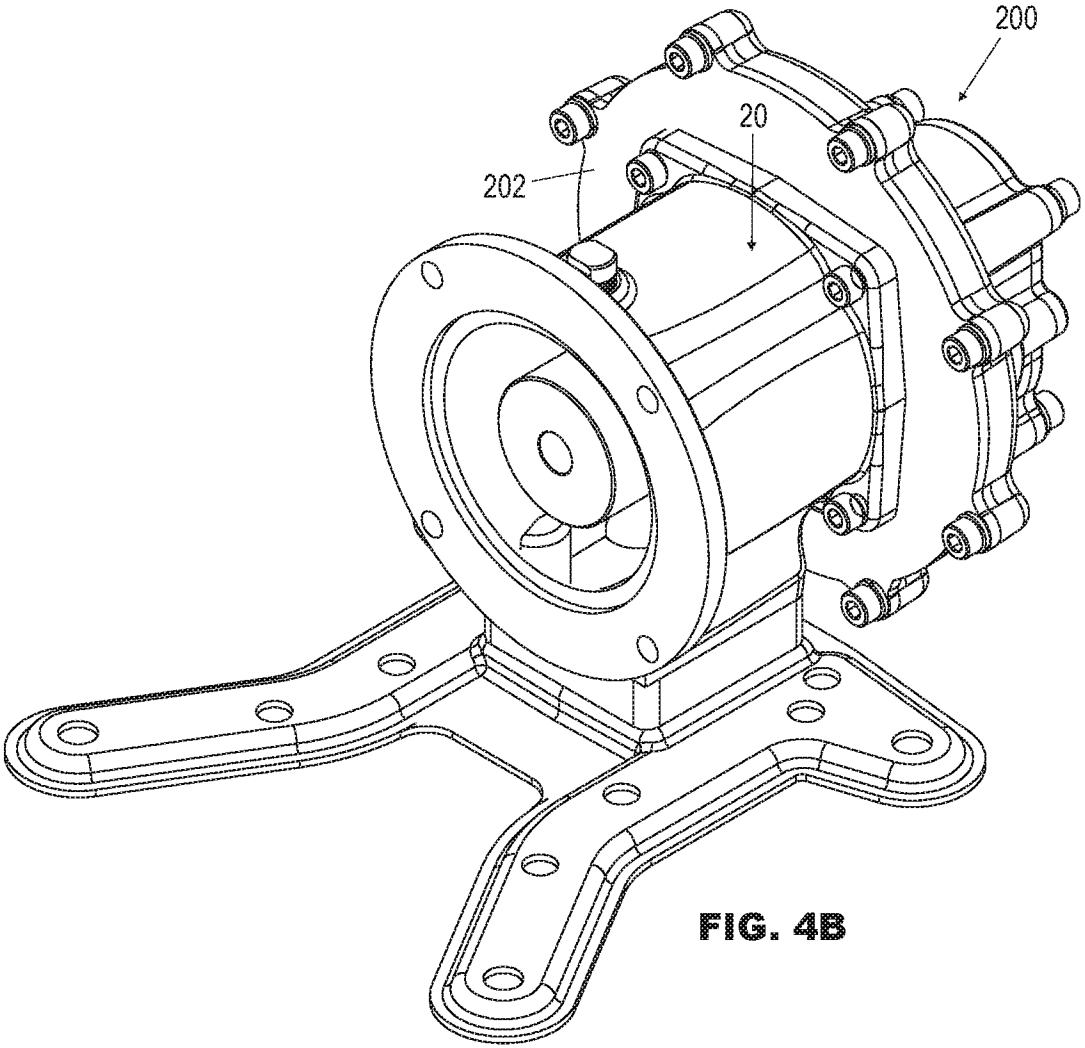
FIG. 4B is a back perspective view of the mounted external-gear pump assembly of FIG. 4A.
Figure 4C:
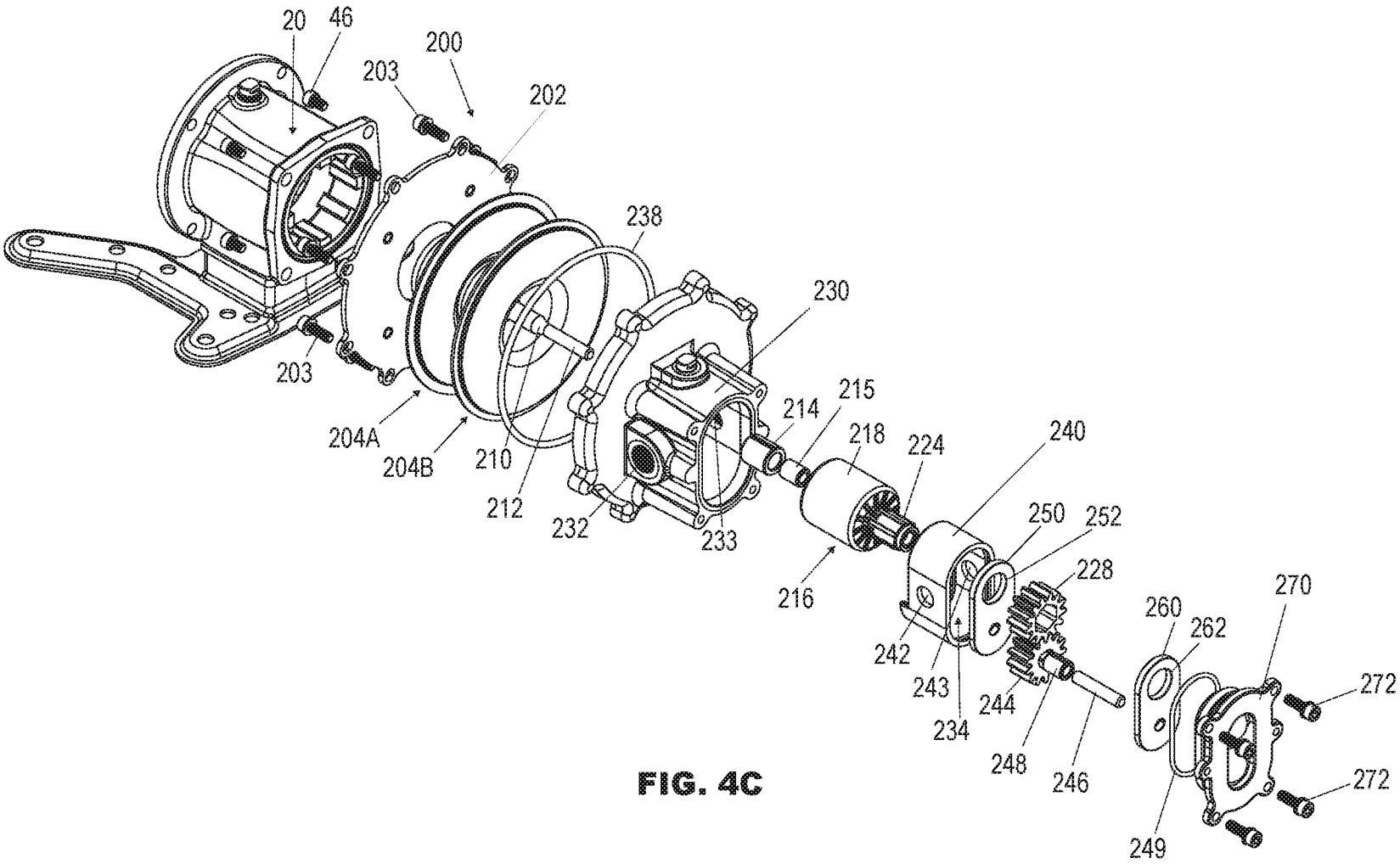
FIG. 4C is an exploded front perspective view of the external-gear pump assembly of FIG. 4A.

Turning now to FIGS. 4A-4G, a particular pump assembly, referenced as an external gear pump assembly 200, is shown in FIG. 4A mounted on the universal adapter 20. An outer back cover 202 (FIG. 4C) abuts the flange portion of the containment shell. The containment shell, similar to the containment shell 54, has a single layer, layered or two-piece construction, represented as a back outer shell component 204A, and a front inner shell component 204B, each having a cup and a flange portion.

Figure 4D:
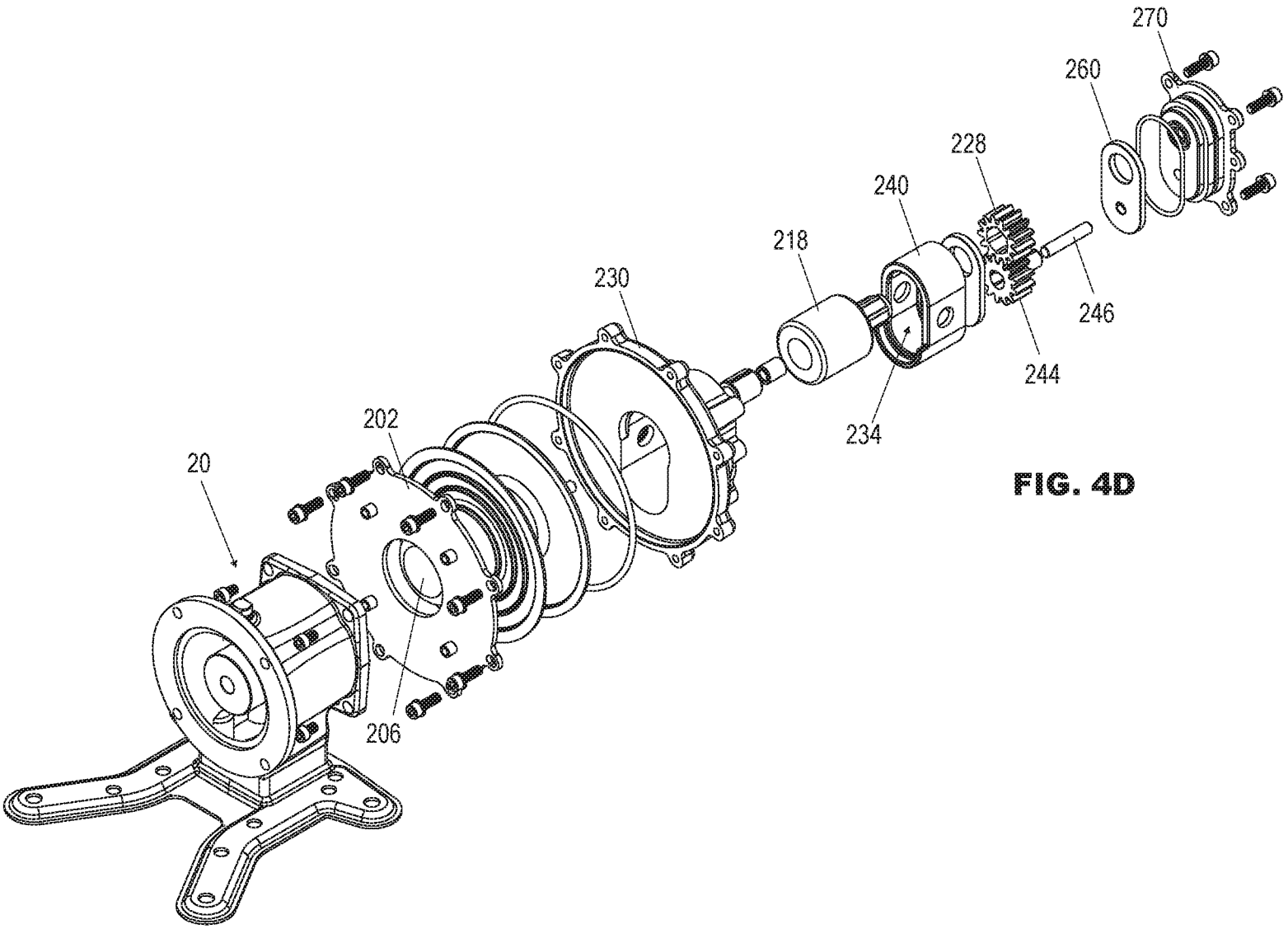
FIG. 4D is an exploded back perspective view of the external-gear pump assembly of FIG. 4A.
Figure 4E:
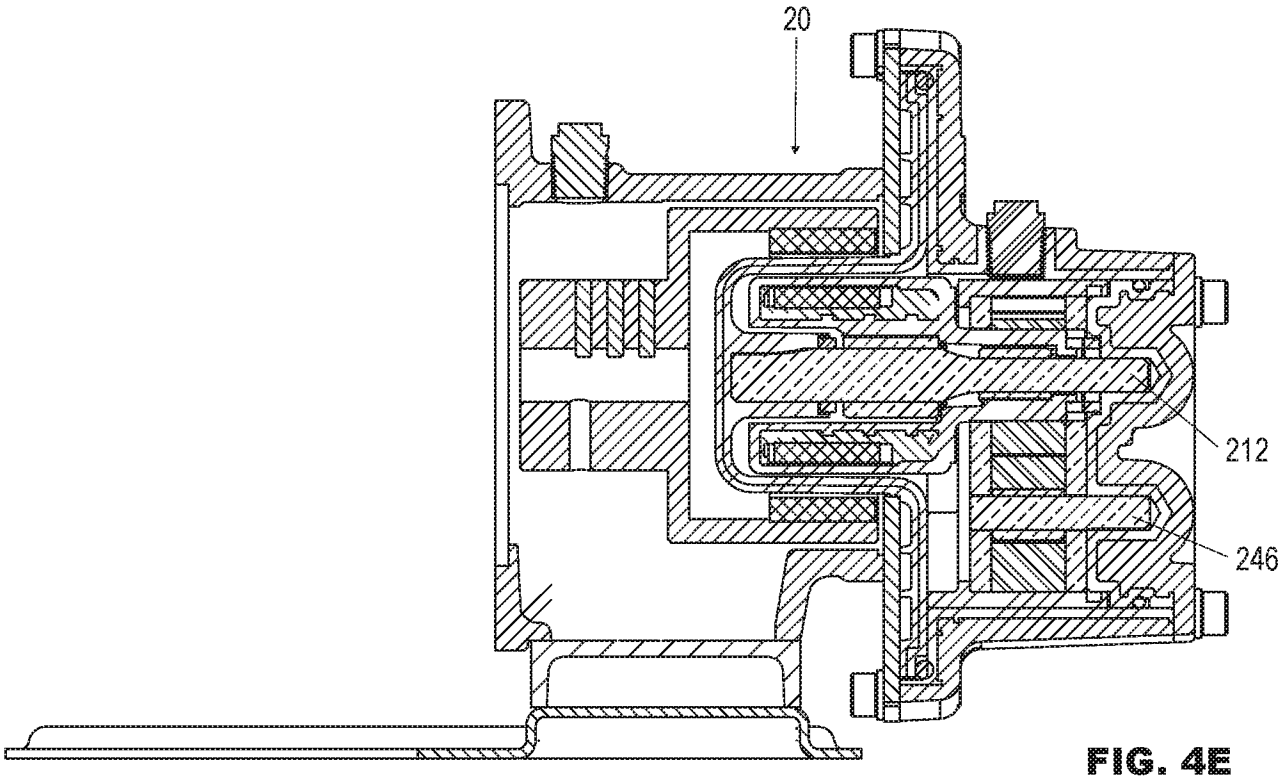
FIG. 4E is a cross-sectional view of the external-gear assembly of FIG. 4A taken along the lines 4E-4E.

A stationary shaft 210 serves as an axle extending longitudinally from the interior of the cup 206 (FIG. 4D). The shaft 210 has a rearward portion fixed to the cup, and a forward portion 212 that may be diameter reduced relative to the rearward portion. A first rotating bushing 214 is mounted on the rearward portion of the shaft 210, and a smaller second rotating bushing 215, is mounted on the diameter reduced forward portion 212. A rotatable driven assembly 216 has rearward and forward portions mounted respectively on the first bushing 214 and second bushing 215 for rotation on the shaft 210.

In particular, the rearward portion of the rotatable driven assembly 216 includes a rearward inner magnet assembly 218 in which permanent magnets are attached at uniformly spaced angular intervals to a central hub, which may be metal for example. The magnets and hub are encapsulated in an outer shell, which may be plastic for example. The inner magnet assembly 218, by coupling to the outer magnet assembly 34 of the adapter 20, rotates the driven assembly 216.

The forward portion of the driven assembly 216 includes a driven shaft 224 connected to and extending forward from the inner magnet assembly 218. The driven shaft 224 may be, for example, integral with the magnet assembly 218 for a one-piece construction. The driven shaft 224 transfers rotational energy from the inner magnet assembly 218, which is driven by magnetic coupling with the adapter 20, to the fluid or material pumping components of the pump assembly 200. The inner magnet assembly 218 rotates within the cup 206 of the containment shell 204 and the driven shaft 224 rotates within the casing 230. A gasket 238, illustrated for example as an O-ring, seals the forward side of the containment shell (204B) with the rearward end of the casing 230. The gasket 238 can be constructed of, as a non-limiting example, an elastomer, polymer, neoprene or other resilient sealing material.

A stationary oblong liner insert 240 is positioned within casing 230. An axially centered first spur gear 228, relative to the shaft 210, is mounted on and rotates with the driven shaft 224. The driven shaft 224 and first spur gear 228 are illustrated as having mutually engaged hexagonal engagement surfaces. An offset second spur gear 244 within an offset portion of the oblong chamber 234 is positioned adjacent, and engages with, the first spur gear 228. The second spur gear 244 is thereby rotated by the first spur gear 228. The second spur gear 244 is mounted on an offset shaft 246 with a bushing 248 therebetween. The first and second spur gears 228 and 244 are positioned between a stationary oblong inner back plate 250 and a stationary oblong inner front plate 260, which are placed respectively at back and front ends of the oblong liner insert 240 in assembly. The first and second spur gears 228 and 244 together define an external gear impeller.

The interior of liner insert 240 serves as an oblong pumping chamber 234 through which pumped fluid travels when the driven shaft 224 is turned, and the first and second spur gears 228 and 244 rotate accordingly. The back plate 250 and front plate 260 define the back and forward walls of the pumping chamber. The liner insert 240 can be constructed, for example, of plastic such as that of the encapsulation of the magnet assembly 218. The back plate 250 and front plate 260 can be constructed of ceramic material.

The back plate 250 has an upper hole 252 in which a rear portion of the driven shaft 224 rotates, and a lower offset hole that holds the back end of the offset shaft 246. Similarly, the front plate 260 has an upper hole 262 in which a rear portion of the driven shaft 224 rotates, and a lower offset hole that holds the front end of the offset shaft 246.

An oblong gasket 249 seals the forward end of the casing 230 with the back end of an outer front cover 270. The assembly is maintained from the back by fasteners, shown as back assembly bolts 203, attaching the back cover 202 to the back end of the casing 230, and from the front by fasteners, shown as front assembly bolts 272, attaching a front cover 270 to the front of the casing 230.

Figure 4G:
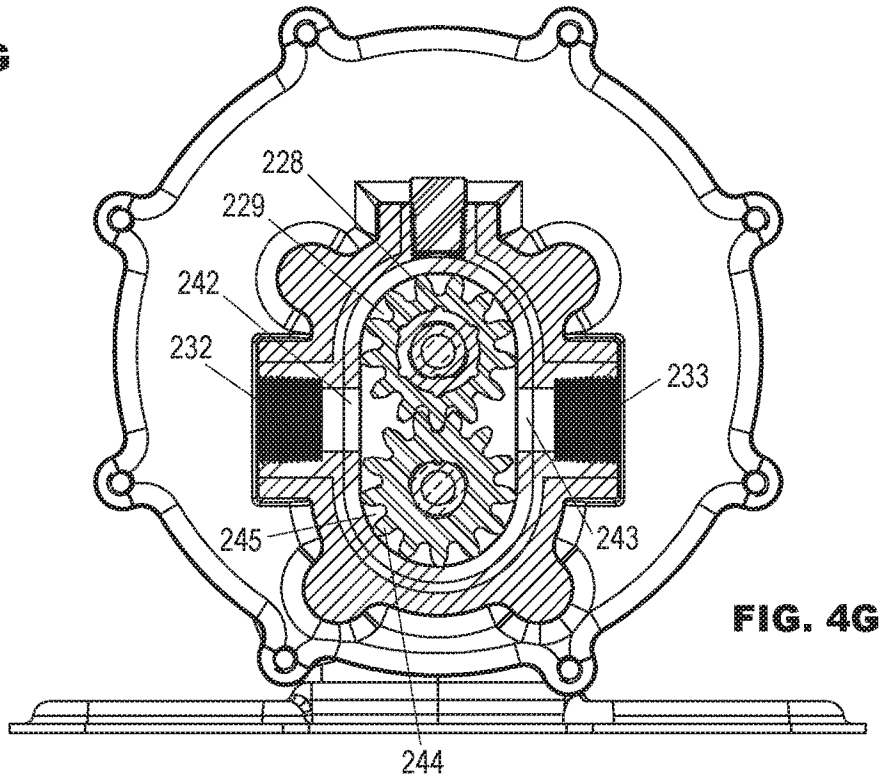
FIG. 4G is a cross-sectional view of the external-gear assembly of FIG. 4F taken along the lines 4G-4G.
Figure 4F:
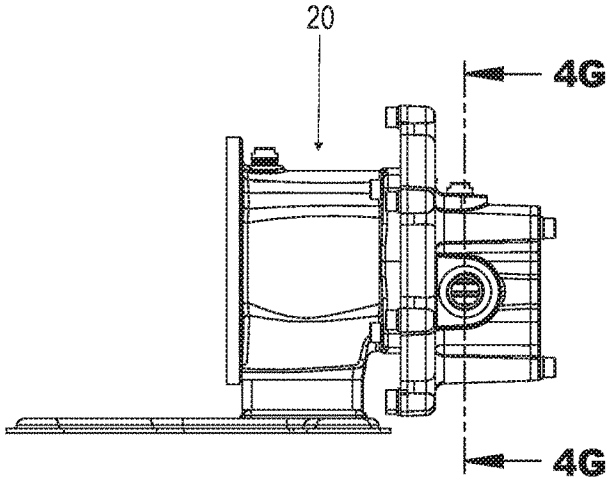
FIG. 4F is a side isometric view of the external-gear assembly of FIG. 4A.

As shown for example in FIG. 4G, the casing 230 has a lateral side opening first port 232 aligned with a first port 242 of the liner insert 240. Similarly, the casing 230 has an opposite lateral side opening second port 233 aligned with a second port 243 of the liner insert 240. The first ports 232 and 242 serve as inlets in one rotational direction of the driven shaft 224 and first spur gear 228 (clockwise in FIG. 4G), and as outlets in an opposite rotational direction thereof (clockwise). The second ports 233 and 243 serve correspondingly opposite roles with respect to the first ports (232, 242), for example as outlets for clockwise rotation of the driven shaft 224 and first spur gear 228 in FIG. 3G.

In either rotational direction of the driven shaft 224, the first spur gear 228 mounted on the driven shaft 224 engages externally engages the second spur gear 244, which is thereby rotated in an opposite rotational direction. The mutually engaged gear teeth exclude any pumped fluid therebetween as they mesh, forming a seal therebetween in a direct line between the first ports (232, 242) and second ports (233, 243) within the oblong pumping chamber 234, and forcing pumped fluid to travel in the spaces between the disengaged teeth of both gears. The non-engaged gear teeth of the oppositely rotating first and second spur gears 228 and 244 each move pumped fluid along the periphery of the pumping chamber.

For example, assuming a clockwise rotation of the driven shaft 224 and first spur gear 228 in FIG. 4G, the second spur gear 244 rotates in a counter-clockwise direction. The first spur gear 228 accordingly carries pumped fluid from the first ports (232, 242) to the second ports second ports (233, 243) in inter-tooth spaces 229 along the upper end or periphery of the oblong pumping chamber 234; and the counter-clockwise rotating second spur gear 244 accordingly carries pumped fluid from the first ports (232, 242) to the second ports (233, 243) in inter-tooth spaces 245 along the lower end or periphery of the oblong pumping chamber 234. Upon opposite rotation of the driven shaft 224, the material travels oppositely through the pump assembly.

The external gear pump assembly 200 is generally self-priming. Non-limiting examples of use include chemical and hydraulic oil pumping. The pump assembly 200 can be used for metering purposes. Medium to high viscosity clean liquids (free of solids) can be pumped with low flow rates and high pressures.

As non-limiting examples, the casing 230 can be lined metal. The liner insert 240 can be plastic. The outer front cover 270 can be plastic lined. The spur gears can be plastic. The back plate 250 and front plate 260, shaft, and bushings can be SIC. The inner magnet assembly 218 can be encased in plastic.

Turning now to FIGS. 5A-5D, a particular pump assembly, referenced as a disc pump assembly 300, is shown in FIG. 5A mounted on the universal adapter 20. An outer back cover 302 abuts the flange portion of the containment shell 304. The pump assembly 300 can be generally of metal construction. For example, the containment shell 304, in both the cup 306 and flange 308 portions thereof, can be a single metal piece, made of stainless steel as a single layer or one-piece construction in at least one example. A distinction of the disc pump assembly 300 with respect to some others described herein is that, in the illustrated embodiment, a stationary shaft 310, fixed at its forward end 312 to the casing 350, extends rearward into the cup 306 without support from, or contact with, the containment shell 304. For a distinct counter example, the stationary shaft 60 in the centrifugal pump assembly 50 of FIG. 2C has a rearward end fixed to the containment shell 54 within the cup 56.

The stationary shaft 310 extends rearward from the casing 350. A rotating bushing 314 is mounted on the shaft 310, and a rotatable driven assembly 316 is mounted on the bushing 314 for rotation on the shaft 310. The rearward portion of the rotatable driven assembly 316 includes a rearward inner magnet assembly 318 in which permanent magnets are attached at uniformly spaced angular intervals to a central hub, which is mounted on the bushing 314. The magnets and hub are encapsulated in an outer shell 324. The inner magnet assembly 318, by coupling to the outer magnet assembly 34 of the adapter 20, rotates the driven assembly 316.

The forward portion of the driven assembly 316 includes a disc impeller 330, which moves pumped fluid by the transfer of rotational energy thereto. The disc impeller 330 includes, for example, a rear disc 332, a forward disc 334, and spacers 336 therebetween maintaining a space or gap between the mutually parallel discs. Alternative embodiments can include three or more discs. The disc impeller 330 is maintained as a unit by fasteners, illustrated as threaded assembly bolts 338, that attach the forward disc 334 through the spacers 336 to the rear disc 332. The disc impeller 330 is mounted to the front of the inner magnet assembly 318 by fasteners, illustrated as threaded mounting bolts 340.

Upon rotation of the driven assembly 316, a pumped fluid enters the interior of the disc impeller 330 via a central tubular inlet 352 of the casing 350, and is cast radially outward by centrifugal force through the space between the rear disc 332 and forward disc 334. The pumped fluid is tangentially ejected through a peripheral tubular outlet 354 of the casing 350. To engage the pumped fluid within the spacing between the discs 332 and 334, the rear disc 332 and forward disc 334 each has a fluid engagement surface, facing into the spacing maintained therebetween by the spacers 336. The fluid engagement surfaces can be smooth and planar. In such an example, the smooth rotating engagement surface of each engages pumped fluid by surface friction. However, in the illustrated embodiment, radially extending channels 348 are formed in the fluid engagement surfaces to serve as fluid engagement features, which increasing effective fluid engagement and pump pressure, when rotated, relative to a smoothly surfaced rotating disc or plate. The spacing between the discs 332 and 334 can be varied by changing the lengths of the spacers 336. Various fluid engagement features in or on the fluid engagement surfaces of the discs, including detents, ridges, bumps and other types.

The assembly is maintained from the back by fasteners, shown as back assembly bolts 303, attaching the back cover 302 to the back end of the casing 350. A gasket 326, illustrated for example as an O-ring, seals the front side of the containment shell 304 with the back of the casing 350. The forward end 312 of the stationary shaft 310 is fixed to the casing 350 by a fastener 356, illustrated as a threaded bolt or screw received by and engaging a threaded interior bore of the shaft.

As non-limiting examples, the disc pump assembly 300 can be used to pump low to medium viscosity (0.1-150 cP) liquids. Solids-laden liquids (free of Iron) can be pumped. Low to medium flow rates at low pressure can be produced. The disc pump assembly 300 is generally not-self-priming. Liquid carried solids that, for example, may fail to pass through the centrifugal pump assembly 50 or may bind, wear, or damage the internal gear pump assembly 100 and external gear pump assembly 200, can be pumped by the disc pump assembly 300. The disc pump assembly 300 can be used for chemical, industrial, and waste water pumping.

As non-limiting examples: the casing 350 can be metal; the impeller discs can be metal; the containment shell 304 can be metal; the shaft, spacers, and bushings can be SIC. The inner magnet assembly 318 is entirely metal in at least one embodiment.

Figure 6A:
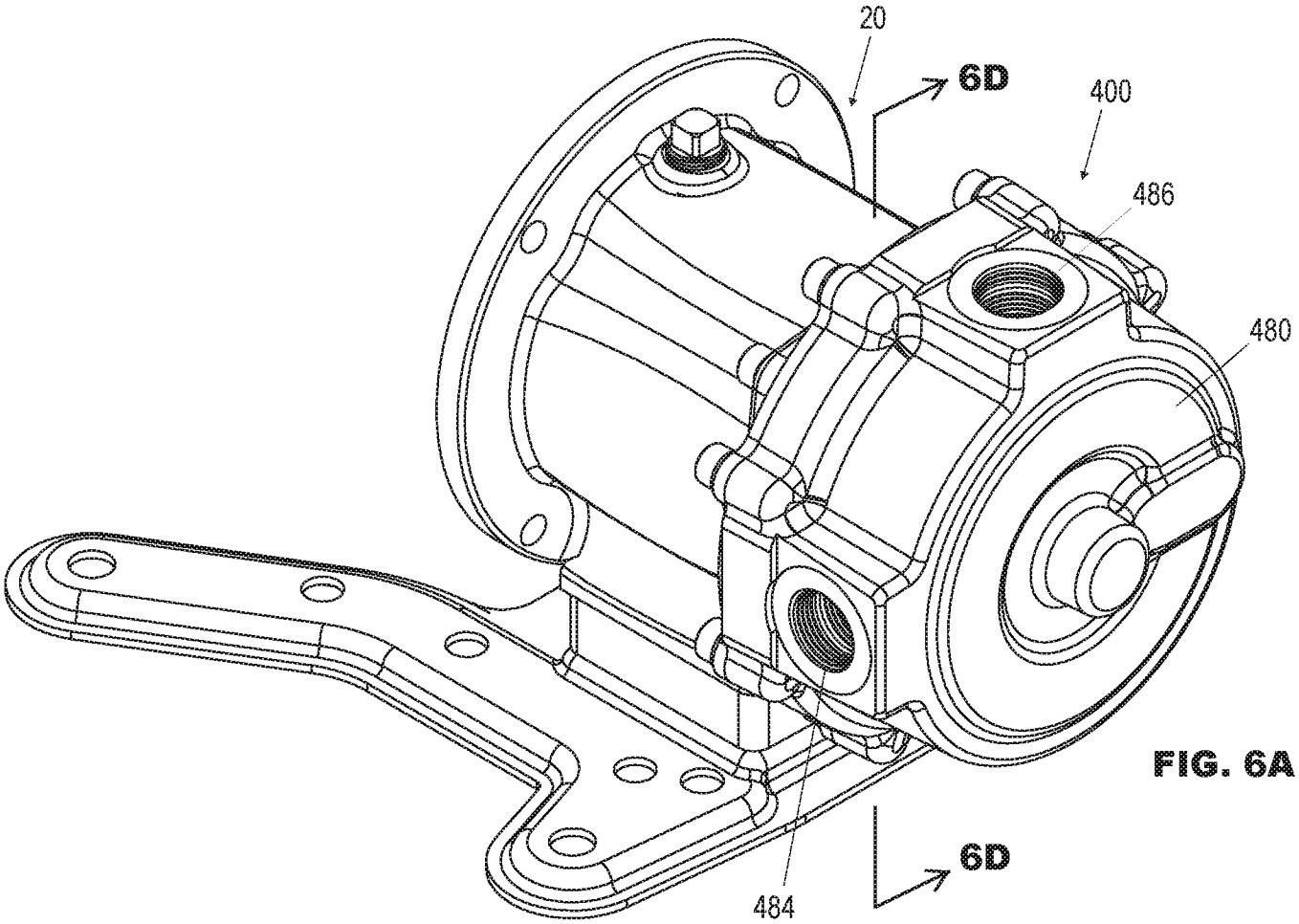
FIG. 6A is a front perspective view of a regenerative turbine pump assembly according to the present disclosure mounted on the universal adapter of FIG. 1.
Figure 6B:
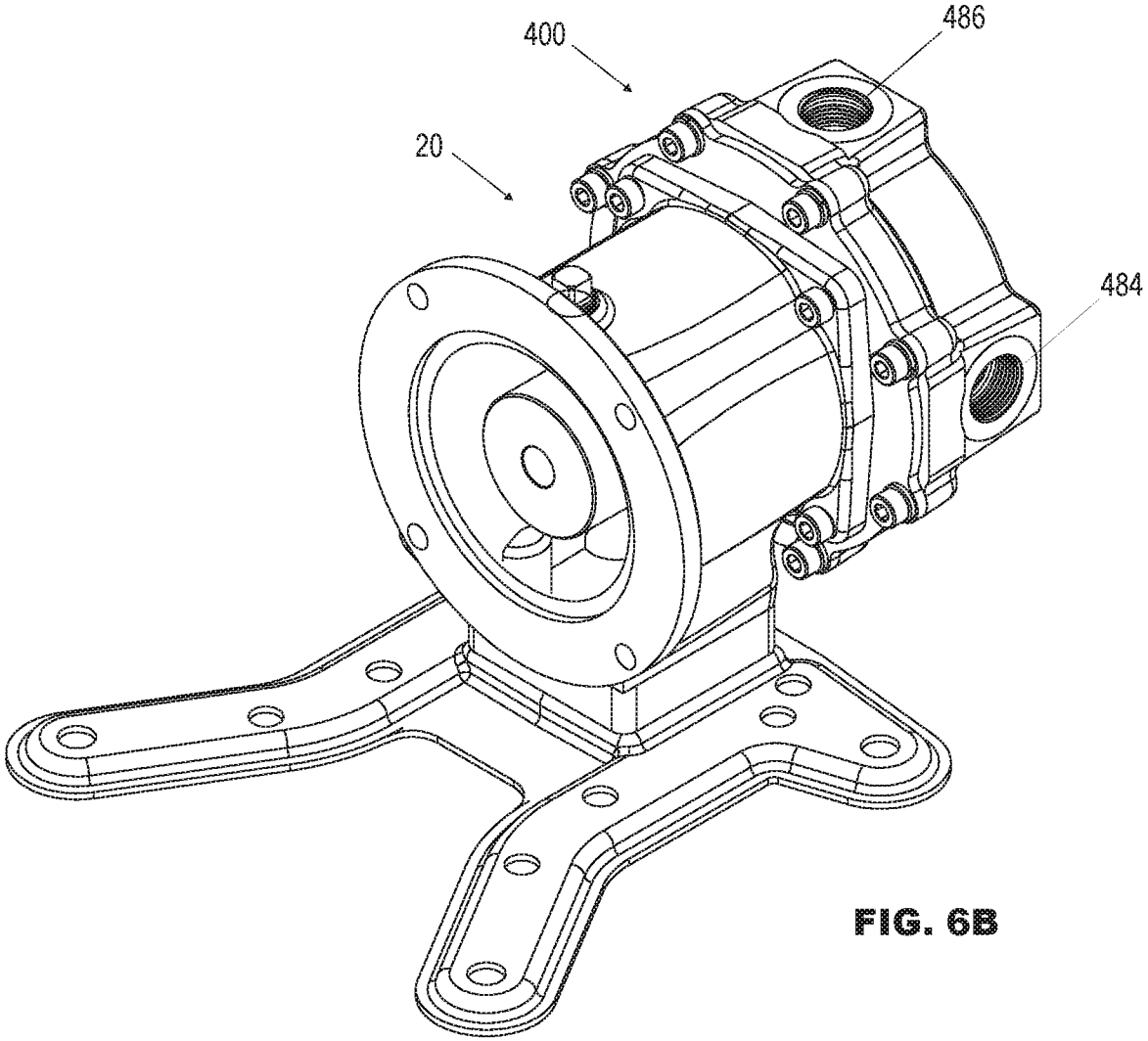
FIG. 6B is a back perspective view of the mounted regenerative turbine pump assembly of FIG. 6A.
Figure 6C:
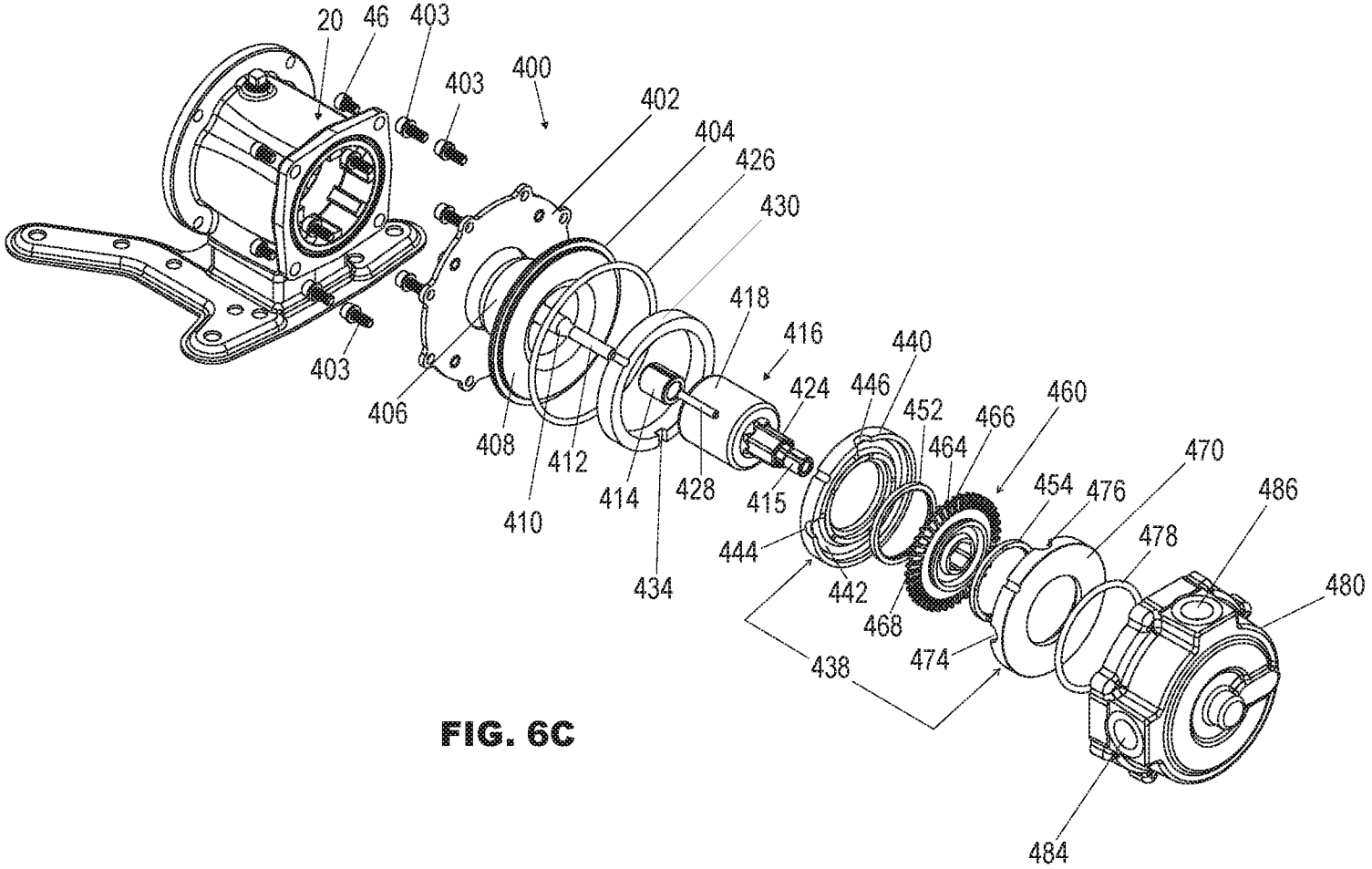
FIG. 6C is an exploded perspective view of the regenerative turbine pump assembly of FIG. 6A.
Figure 6D:
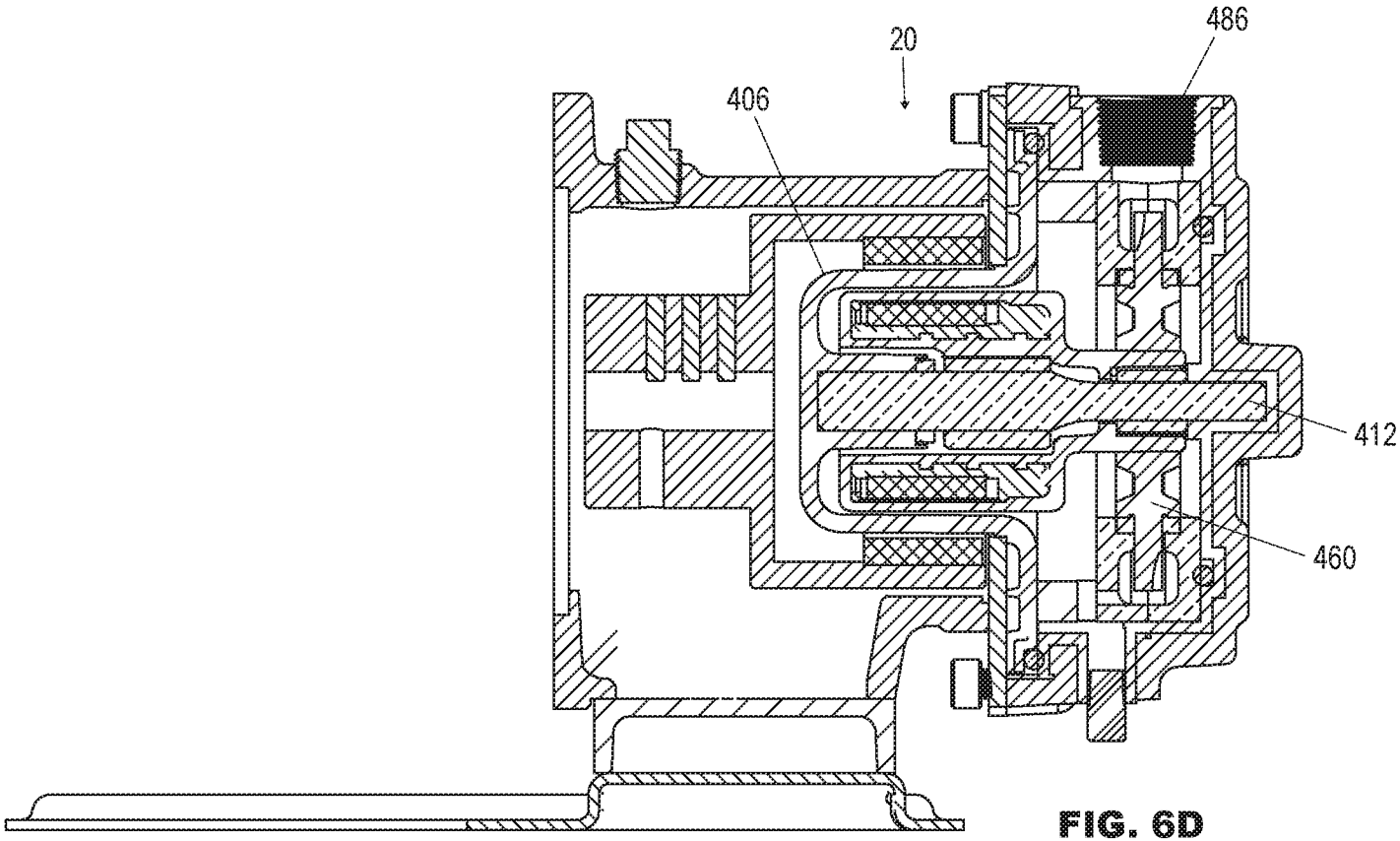
FIG. 6D is a cross-sectional view of the mounted regenerative turbine assembly of FIG. 6A taken along the lines 6D-6D.
Figure 6E:
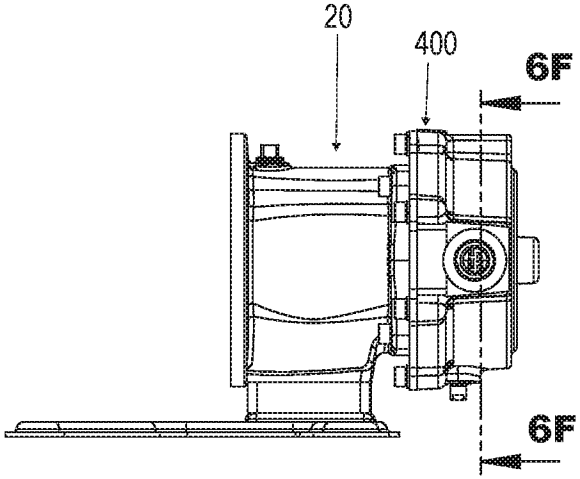
FIG. 6E is a side isometric view of the mounted regenerative turbine assembly of FIG. 6A.
Figure 6F:
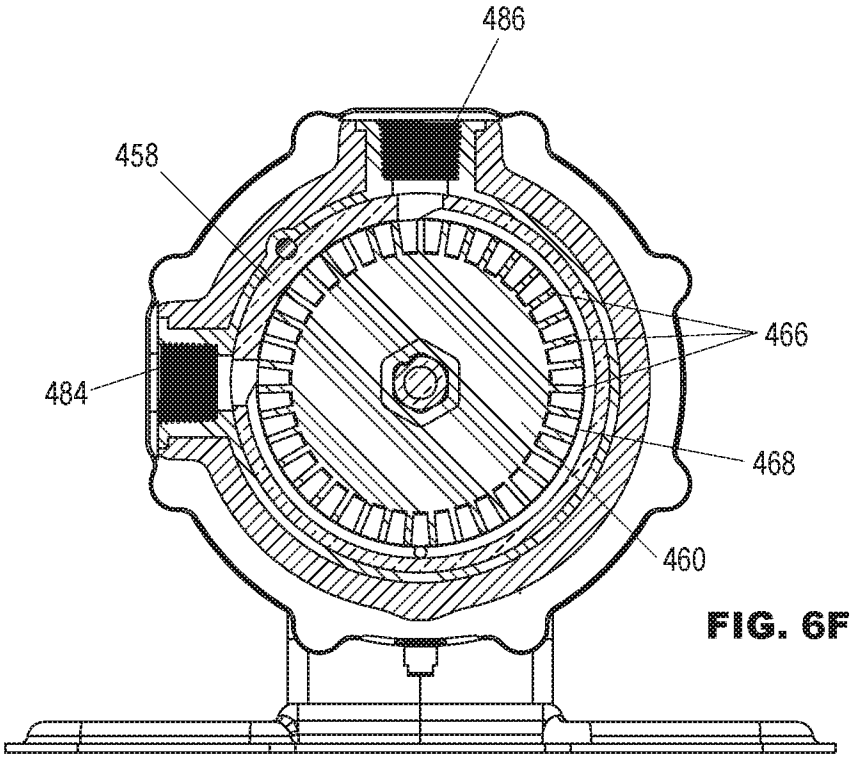
FIG. 6F is a cross-sectional view of the mounted regenerative turbine assembly of FIG. 6D taken along the lines 6F-6F.

Turning now to FIGS. 6A-6F, a particular pump assembly, referenced as a regenerative turbine pump assembly 400, is shown in FIG. 6A mounted on the universal adapter 20. An outer back cover 402 (FIG. 6C) abuts the flange portion of the containment shell 404. The containment shell 404, similar to the containment shell 54, has a cup 406 and a flange 408, and may have a single layer, layered or two-piece construction. A stationary shaft 410 serves as an axle extending longitudinally from the interior of the cup 406. The shaft 410 has a rearward portion fixed to the cup 406, and a forward portion 412 that may be diameter reduced relative to the rearward portion. A first rotating bushing 414 is mounted on the rearward portion of the shaft 410, and a smaller second rotating bushing 415, is mounted on the diameter reduced forward portion 412. A rotatable driven assembly 416 has rearward and forward portions mounted respectively on the first bushing 414 and second bushing 415 for rotation on the shaft 410.

In particular, the rearward portion of the rotatable driven assembly 416 includes a rearward inner magnet assembly 418 in which permanent magnets are attached at uniformly spaced angular intervals to a central hub, which may be metal for example. The magnets and hub are encapsulated in an outer shell, which may be plastic for example. The inner magnet assembly 418, by coupling to the outer magnet assembly 34 of the adapter 20, rotates the driven assembly 416.

The forward portion of the driven assembly 416 includes a driven shaft 424, which may be, for example, integral with the rearward portion of the assembly 416 for a one-piece construction. The forward portion of the driven assembly 416 includes a driven shaft 424 connected to and extending forward from the inner magnet assembly 418. The driven shaft 424 may be, for example, integral with the magnet assembly 418 for a one-piece construction. The inner magnet assembly 418 rotates within the cup 406 and the driven shaft 424 rotates within the outer casing 480. A gasket 426, illustrated for example as an O-ring, seals the forward side of the containment shell 404 with the outer casing 480. The gasket 426 can be constructed of, as a non-limiting example, an elastomer, polymer, neoprene or other resilient sealing material.

Within the outer casing 480, a stationary outer spacer 430 is pressed between the flange 406 and a stationary inner volute casing 438, which is formed by a stationary rear volute plate 440 and a stationary forward volute plate 470. A drain slot 434 formed radially through the forward end of the spacer 430 permits liquid to drain from the pump. A key 428 prevents rotation of the spacer 430, rear volute plate 440, forward volute plate 470, each having a keyway slot that receives the key.

The forward side of the rear volute plate 440 has a circumferentially extending channel 442. The rearward side of the stationary forward volute plate 470, facing the rear volute plate 440, has a circumferentially extending channel, that together with the channel 442 upon assembly, forms a circumferential flow path for pumped fluid. A semicircular notch 444 in the lateral side of the outer wall of the rear volute plate 440 aligns with a semicircular notch 474 in the lateral side of the outer wall of the forward volute plate 470 to define a flow path entry or exit of the inner volute casing 438. Similarly, a semicircular notch 446 in the top side of the outer wall of the rear volute plate 440 aligns with a semicircular notch 476 in the top side of the outer wall of the forward volute plate to define a flow path exit or entry of the inner volute casing 438.

Within the inner volute casing 438, between the rear volute plate 440 and forward volute plate 470, a regenerative turbine impeller 460 has a central hub mounted on the driven shaft 424. A rearward wear ring 452, between the rear volute plate 440 and impeller 460, and forward wear ring 454, between the impeller 460 and forward volute plate 470, take axial loads and maintain the relative axial positions (along the longitudinal axis defined by the shaft 410) in the assembled inner volute casing 438.

The regenerative turbine impeller 460 has angularly offset rear vanes 464 and forward vanes 466 separated by a central web 468 or divider plate extending outward from the hub. When the driven shaft 424 rotates, the vanes travel within the circumferential flow path defined between the volute plates 440 and 470. As the impeller 460 rotates, liquid within the spaces between the vanes 464 and 466 on both sides of the web 468 rotates and builds velocity, in a process termed regeneration, as the liquid is carried in the circumferential flow path between the entry and exit. In the illustrated embodiment, the entry and exit are positioned three-quarters of a turn apart. A stationary stripper 458 (FIG. 6F) extending circumferentially near the outer edge of the impeller 460 blocks or limits regeneration in the remaining one quarter turn. By this arrangement, the entry and exit points for pumped fluid into and out of the inner volute casing 438 are determined according to the rotational direction of the impeller 460. Upon counterclockwise rotation of the impeller in FIG. 6F, the notches 444 and 474 (FIG. 6C) together define an entry, and the notches 446 and 476 together define an exit. Upon opposite rotation of the impeller 460, pumped liquid travels oppositely through the pump assembly.

A compression ring 478, illustrated for example as an O-ring, is positioned between the forward side of the forward volute plate 470 and the interior of the outer casing 480. The ring 478 keeps the components of the inner volute casing 438 in tight assembly even as parts wear. The assembly is maintained from the back by fasteners, shown as back assembly bolts 403, attaching the back cover 402 to the back end of the casing 480.

The casing 480 has a lateral side opening first port 484 that align with the semicircular notches 444 and 474 in assembly. The casing 480 has a top side opening second port 486 aligned with the semicircular notches 446 and 476. The first port 484 serves as an inlet for pumped fluid into the pump assembly 400 and inner volute casing 438 upon rotation of the driven shaft 424 in a first rotational direction (counter-clockwise in FIG. 6F), and as an outlet in an opposite second rotational direction thereof (clockwise). The second port 486 serves correspondingly opposite roles with respect to the first port 484, for example as an outlet for counter-clockwise rotation of the driven shaft 424.

The regenerative turbine pump assembly 400 can be used to pump lower viscosity liquids, and clean liquids free of solids, as non-limiting examples. Low flow rate with high pressure can be produced. The pump assembly 400 is self-priming. Non-limiting examples of use for the regenerative turbine pump assembly 400 include LPG liquefied gas, low viscosity fluids, lubrication control, fluid controls, fluid filtering, booster systems, vapor-laden liquids, HVAC, and fuel.

As non-limiting example, the casing 480 can be lined metal. The volute plates 440 and 470 can be removable, and can be fabricated of SIC. The impeller 460 can be plastic. The containment shell 404 can be two-layered. The inner magnet assembly 418 can be encased in plastic. The shaft, axial spacers, and bushings can be SIC.

Figure 7A:
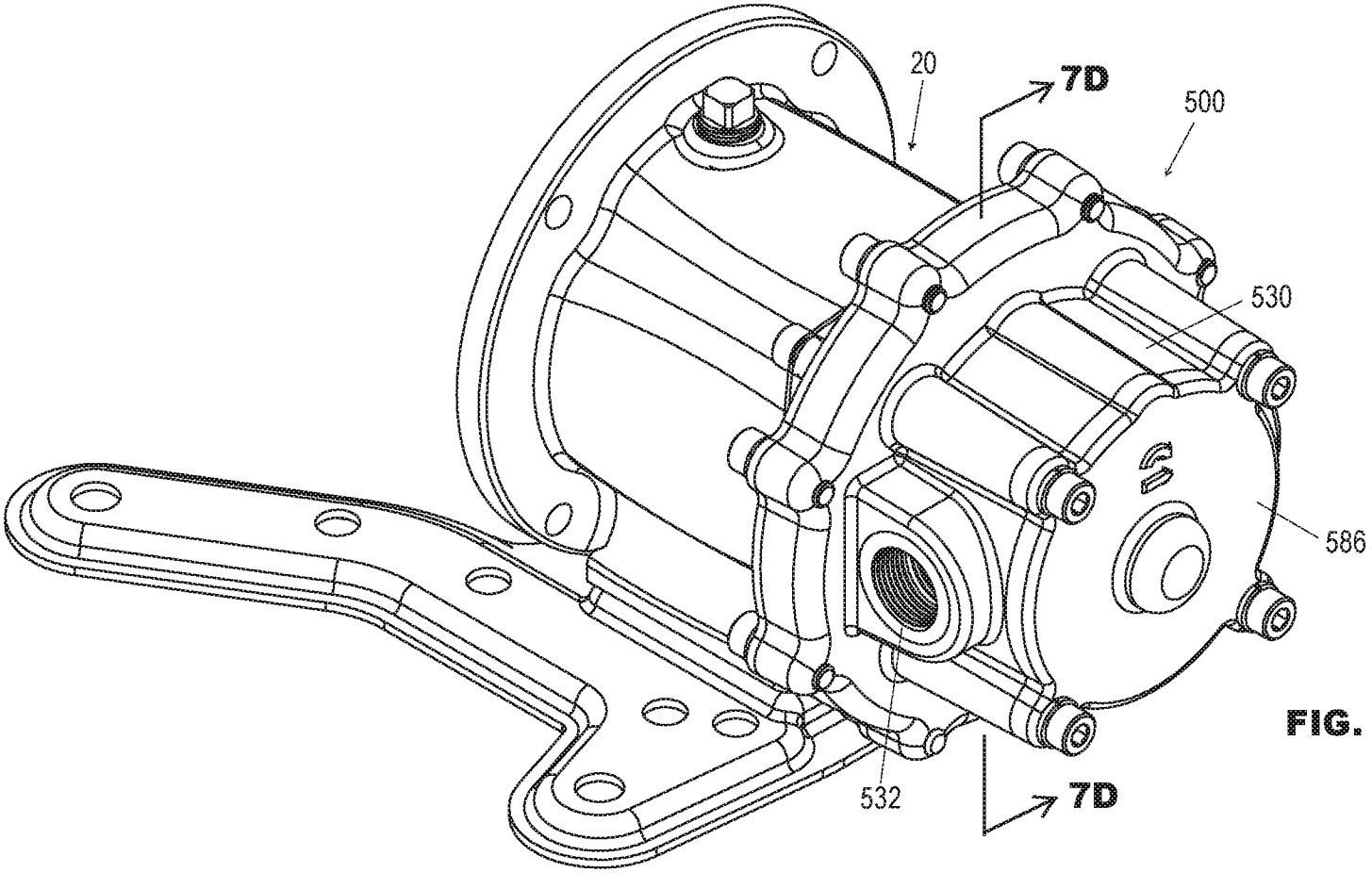
FIG. 7A is a front perspective view of a sliding-vane pump assembly according to the present disclosure mounted on the universal adapter of FIG. 1.
Figure 7B:
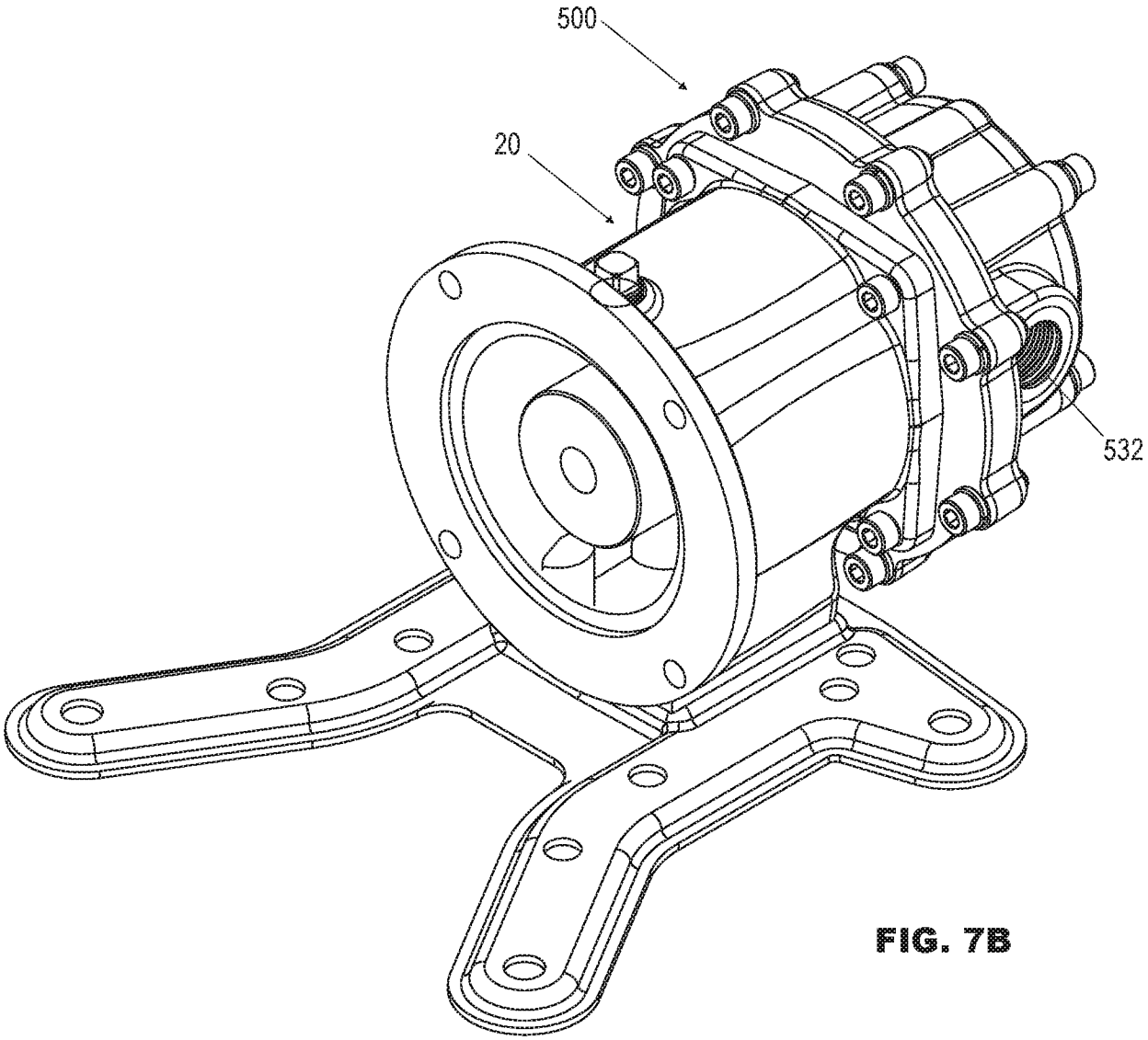
FIG. 7B is a back perspective view of the sliding-vane turbine pump assembly of FIG. 7A.

Turning now to FIGS. 7A-7F, a particular pump assembly, referenced as a sliding vane pump assembly 500, is shown in FIG. 7A mounted on the universal adapter 20. An outer back cover 502 (FIG. 7C) abuts the flange portion of the containment shell 504. The containment shell 504, similar to the containment shell 54, has a cup 506 and a flange 508, and may have a single layer, layered or two-piece construction.

A stationary shaft 510 serves as an axle extending longitudinally from the interior of the cup 506. The shaft 510 has a rearward portion fixed to the cup 506, and a forward portion 512 that may be diameter reduced relative to the rearward portion. A first rotating bushing 514 is mounted on the rearward portion of the shaft 510, and a smaller second rotating bushing 515, is mounted on the diameter reduced forward portion 512 for rotation on the shaft 510. A rotatable driven assembly 516 has rearward and forward portions mounted respectively on the first rotating bushing 514 and second rotating bushing 515 for rotation on the shaft 510.

In particular, the rearward portion of the rotatable driven assembly 516 includes a rearward inner magnet assembly 518 in which permanent magnets are attached at uniformly spaced angular intervals to a central hub, which may be metal for example. The magnets and hub are encapsulated in an outer shell, which may be plastic for example. The inner magnet assembly 518, by coupling to the outer magnet assembly 34 of the adapter 20, rotates the driven assembly 516.

The forward portion of the driven assembly 516 includes a driven shaft 524 connected to and extending forward from the inner magnet assembly 518. The driven shaft 524 may be, for example, integral with the magnet assembly 518 for a one-piece construction. The inner magnet assembly 518 rotates within the cup 506 of the containment shell 504 and the driven shaft 524 rotates within the casing 530. A gasket 538, illustrated for example as an O-ring, seals the forward side of the containment shell 504 with the casing 530.

Within the casing, a stationary axial spacer 540 is positioned forward of the containment shell 504 to set the axial position of a stationary inner back plate 542, which has an offset hole in which the driven shaft 524 rotates. A stationary offset ring 550 receives a sliding vane impeller 560 flanked from behind by the back plate 542 and from ahead by a stationary inner front plate 580, which has an offset hole in which the driven shaft 524 rotates.

The sliding vane impeller 560 has a hub 562 and sliding vanes 564. The hub 562 is mounted on, and rotates with, the driven shaft 524. A space 568 (FIG. 7F) for the travel of pumped fluid is defined between the hub 562 and the internal surface of the offset ring 550. The back plate 542 and front plate 580 define back and front walls, respectively, of the fluid space. The rotating hub 562 carries the sliding vanes 564 that engage the inner surface of the offset ring 550. The hub 562 has non-diametrical linear slots 566 in which the generally planar sliding vanes 564 are trapped by the offset ring 550. The sliding vanes 564 move within the slots 566 as the hub 562 rotates. The sliding vanes 564 are persistently urged outward toward the inner wall of the offset ring 550 by centrifugal force during rotation. Due to the offset position of the ring 550 relative to the hub 562, the sliding vanes 564 reciprocate within the slots 566 as the hub rotates, extending relatively outward at rotational positions where the hub 562 and ring 550 are separated, and forced inward at positions where the hub 562 and ring 550 are close. Pumped fluids within the space 568 are thus swept or move circumferentially within the fluid space as the impeller 560 rotates. Upon rotation of the hub 562 in the intended rotational direction (clockwise in FIG. 7F), pumped fluid is moved within the crescent space (rightward in FIG. 7F).

The slots 566 and vanes 564 are back angled relative to the direction of rotation (clockwise in FIG. 7F), to have trailing outer edges. This prevents binding with the inner wall of the ring 550. The vanes are rigid but movable. The slots 566 are dimensioned to receive full insertion of the vanes 564 as they rotate past the close or contact positions of the hub 562 and ring 550. Circumferential channels 556 (FIG. 7C) formed in the inner wall of the offset ring 550 permit pumped fluid to enter the spaces between vanes as the vanes approach and depart the tapered ends of the fluid space.

The casing 530 has a lateral side opening first port 532 that aligns with a lateral side opening first port 552 of the ring 550 in assembly. The casing 530 has a lateral side opening second port 534, on an opposite side from the first port 552, that aligns with a lateral side opening second port 554 of the ring 550. The first port 552 serves as an inlet for pumped fluid into the pump assembly 500 upon rotation of the driven shaft 524 in the intended rotational direction (clockwise in FIG. 7F), and the second port 554 servers as an outlet. To reverse the roles of the ports 552 and 554, with reversal of the rotational direction of the driven shaft, the hub 562, slots 566, and vanes 564 are to be reoriented or reconfigured to assure trailing outer edges of the vanes.

An axial wear spacer 582 fits within an outer front cover 586 and takes any axial loads from the rotating bushing 515. A forward gasket 584, illustrated as an O-ring, seals the forward end of the casing 530 with the back side of the front cover 586. A key 528 engages a keyway within the casing 530 and prevents rotation of the spacer 540, back plate 542, offset ring 550, and front plate 580, each having a respective aligned keyway. The assembly is maintained from the back by fasteners, shown as back assembly bolts 503, attaching the back cover 502 to the back of the casing 530, and from the front by fasteners, shown as front assembly bolts 588, attaching the front cover 586 to the front of the casing 530.

Non-limiting examples of use for the sliding vane pump assembly 500 include LPG liquefied gas, low viscosity fluids, lubrication fluids, fluid controls, fluid filtering, booster systems, and vapor-laden liquids. Low to high viscosity liquids can be pumped. Low to medium flow rates can be output, with medium pressures, depending on the rotational speed of the pump.

The casing 530 can be lined metal. The offset ring 550 can be SIC. The hub 562 can be plastic. The back plate 542 and front plate 580 can be SIC. The containment shell 504 is two-layered in at least one example. The inner magnet assembly 518 can be encased in plastic. The shaft and bushings can be SIC.

Figure 7C:
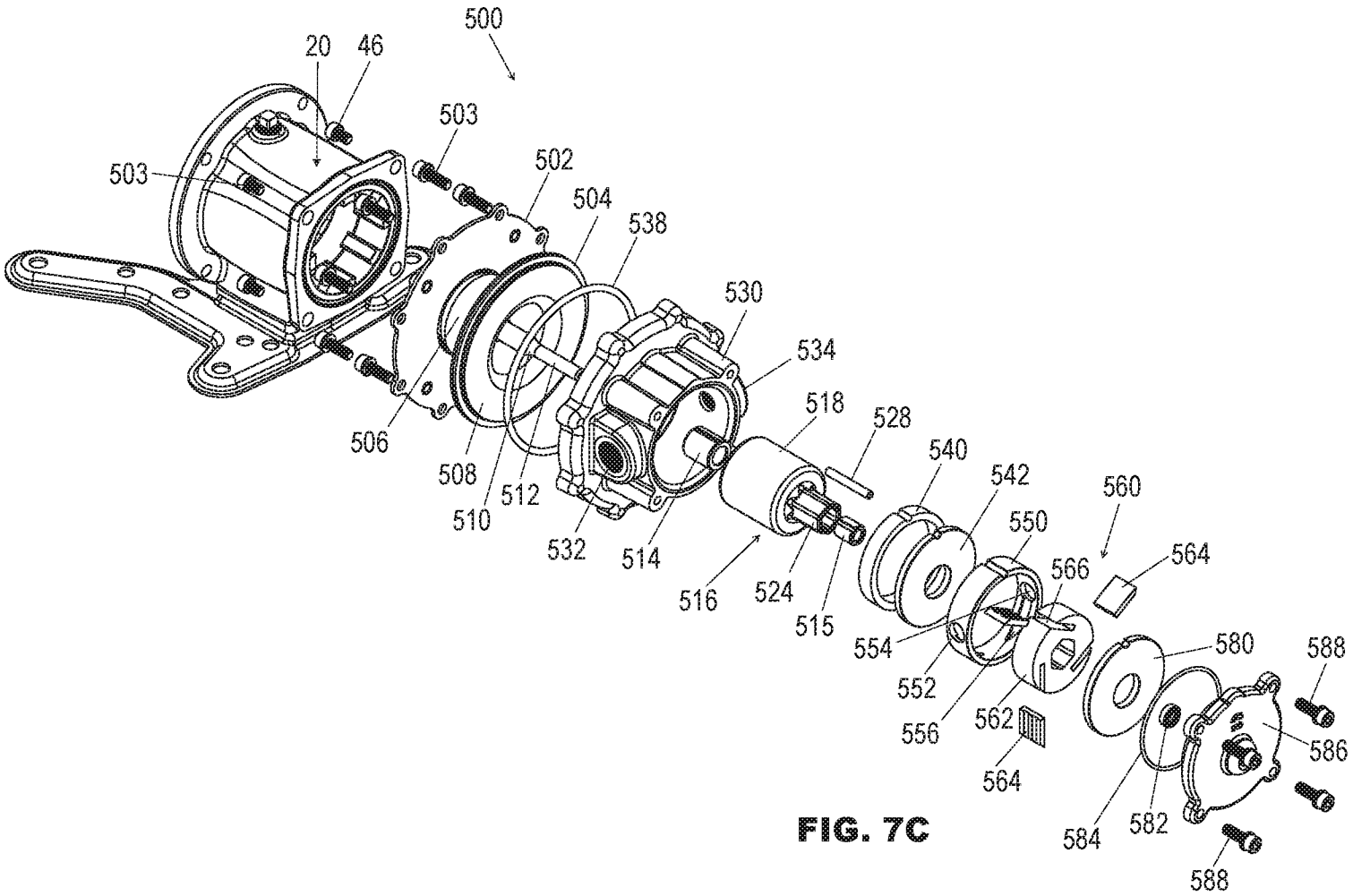
FIG. 7C is an exploded perspective view of the sliding-vane pump assembly of FIG. 7A.
Figure 7D:
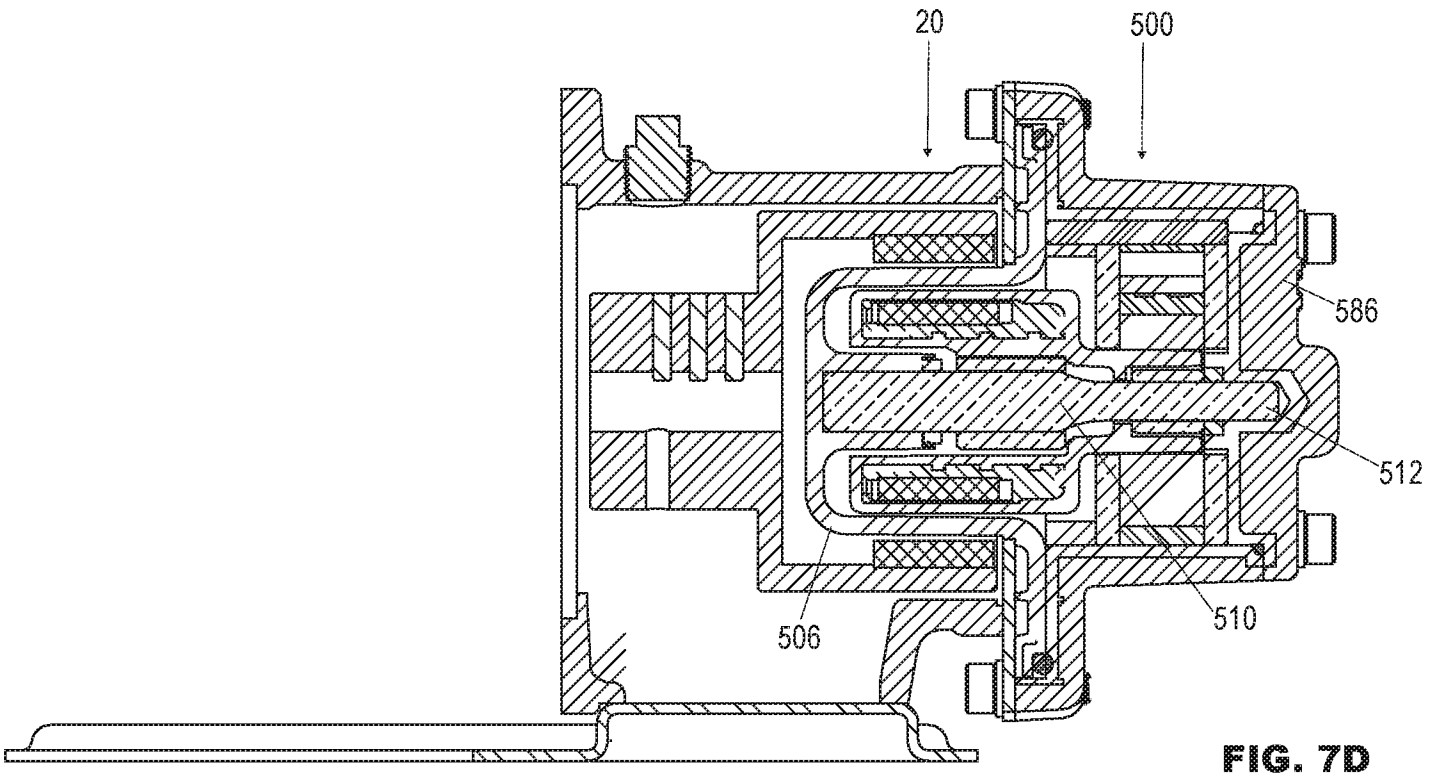
FIG. 7D is a cross-sectional view of the sliding-vane pump assembly of FIG. 7A taken along the lines 7D-7D.
Figure 7E:
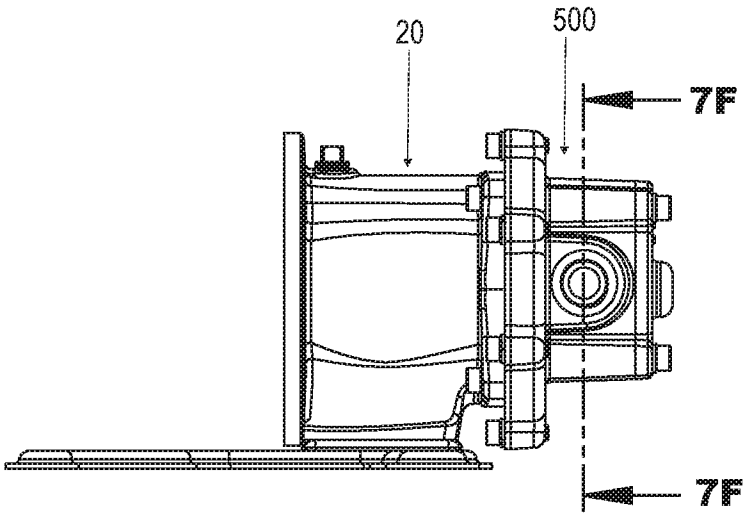
FIG. 7E is a side isometric view of the mounted sliding-vane assembly of FIG. 7A.
Figure 7F:
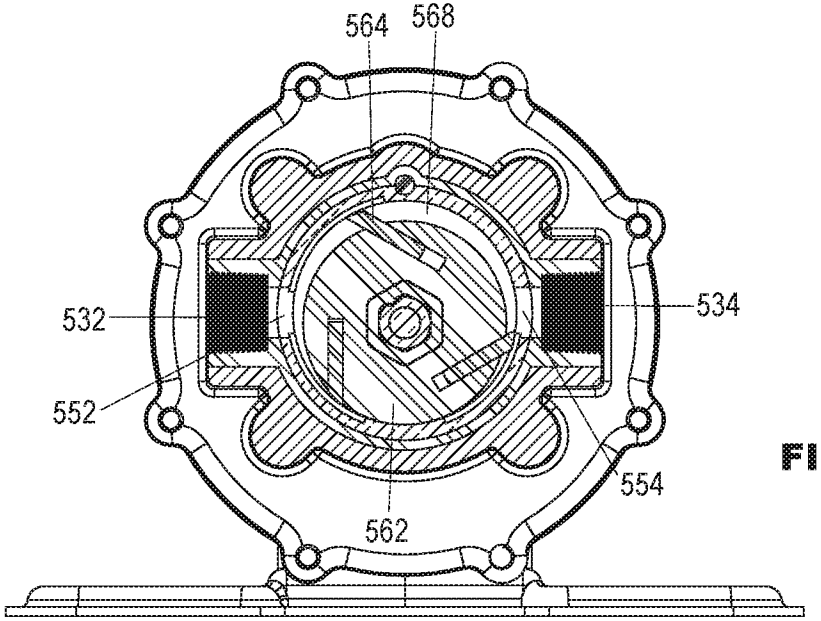
FIG. 7F is a cross-sectional view of the mounted sliding-vane assembly of FIG. 7E taken along the lines 7F-7F.
Figure 8A:
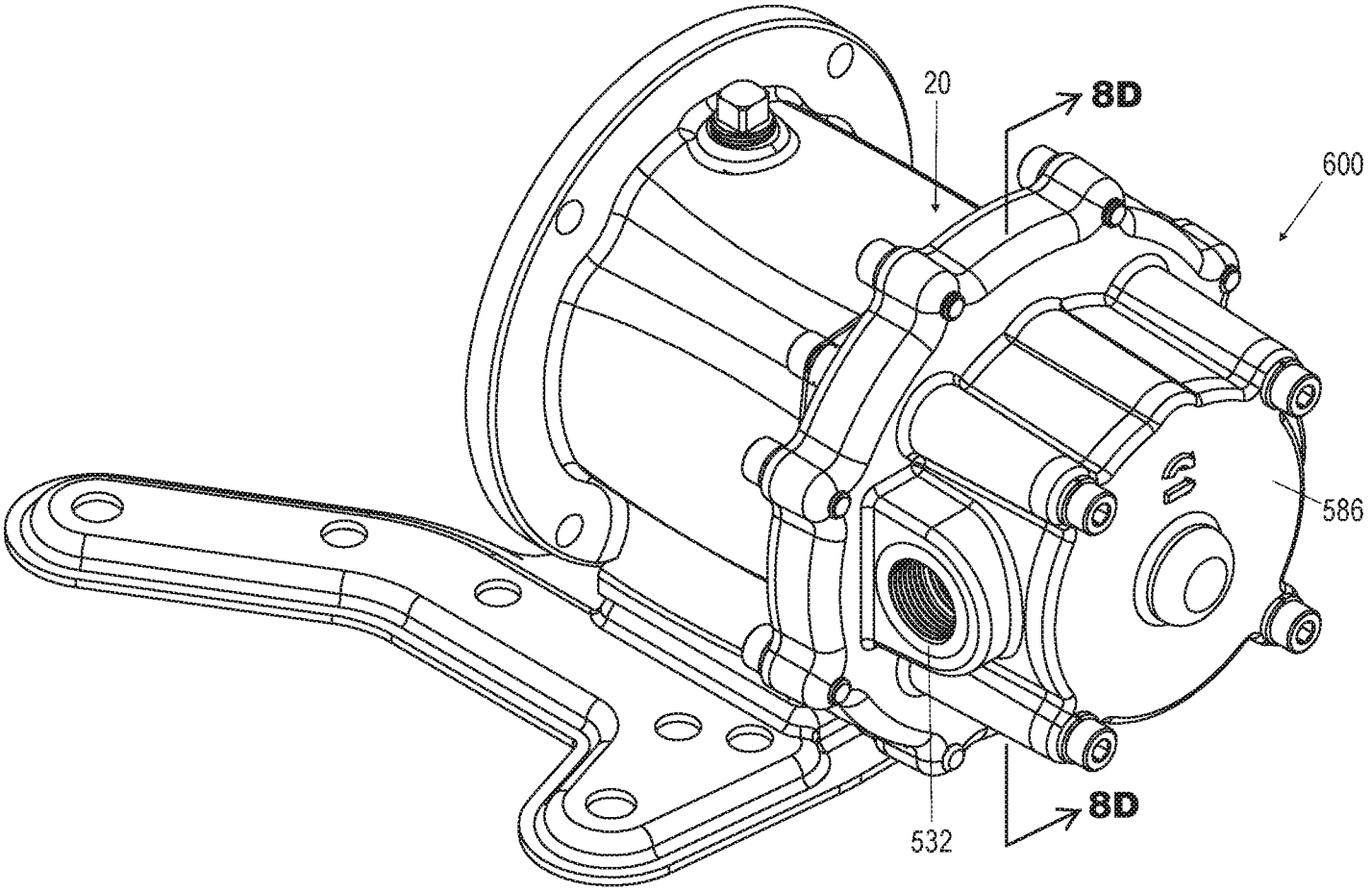
FIG. 8A is a front perspective view of a roller-vane pump assembly according to the present disclosure mounted on the universal adapter of FIG. 1.
Figure 8B:
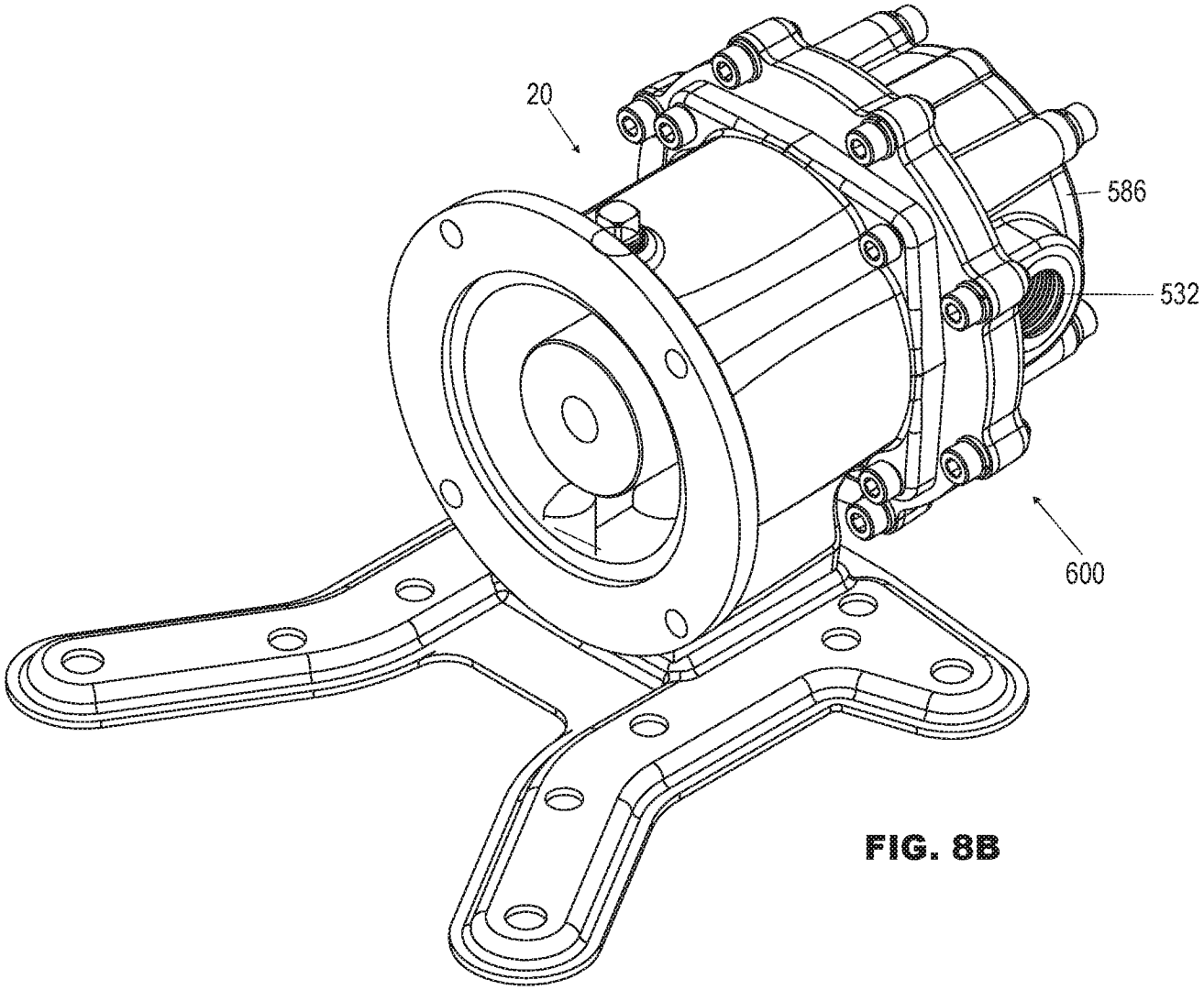
FIG. 8B is a back perspective view of the roller-vane turbine pump assembly of FIG. 8A.
Figure 8C:
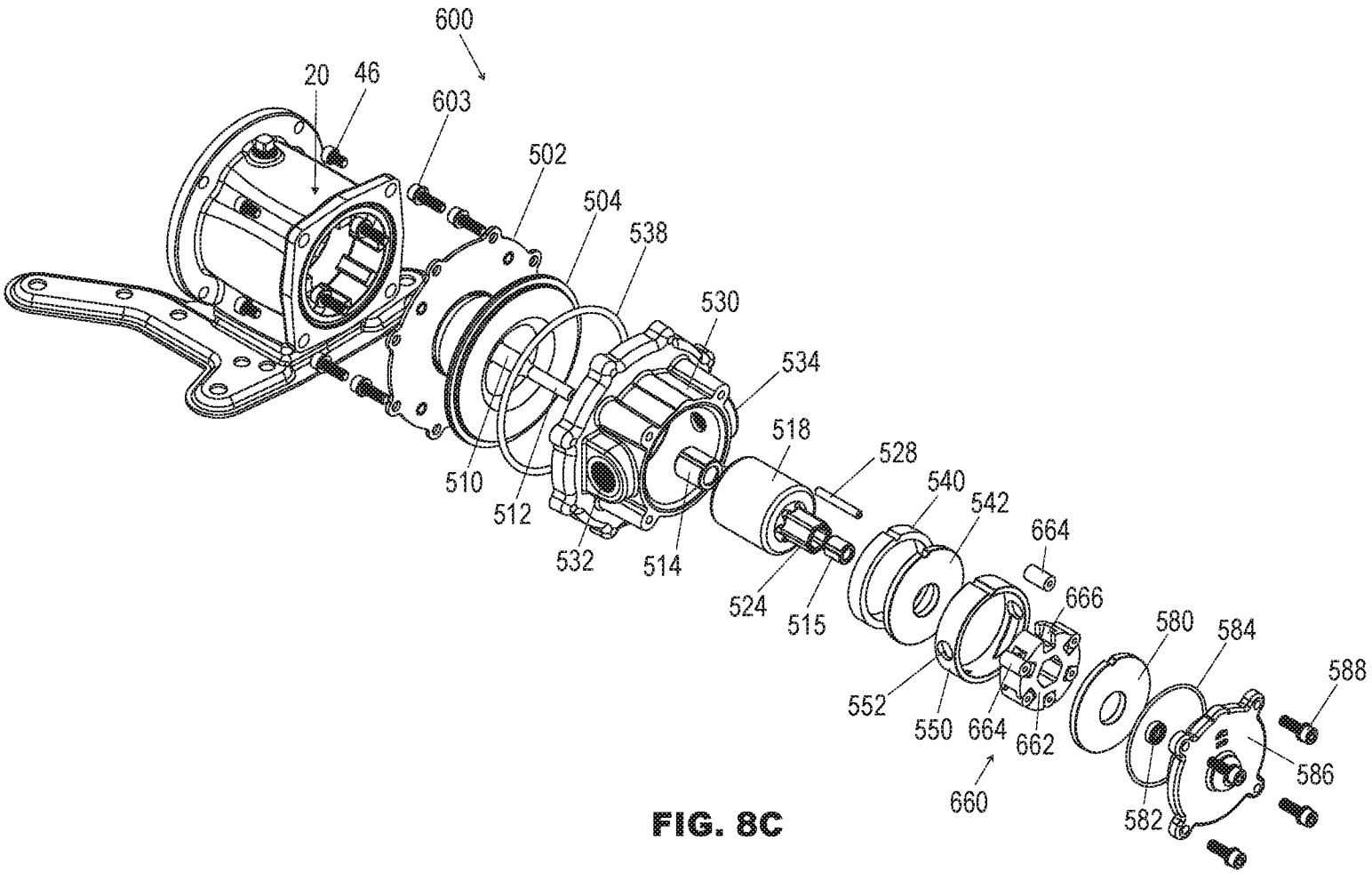
FIG. 8C is an exploded perspective view of the roller-vane pump assembly of FIG. 8A.
Figure 8D:
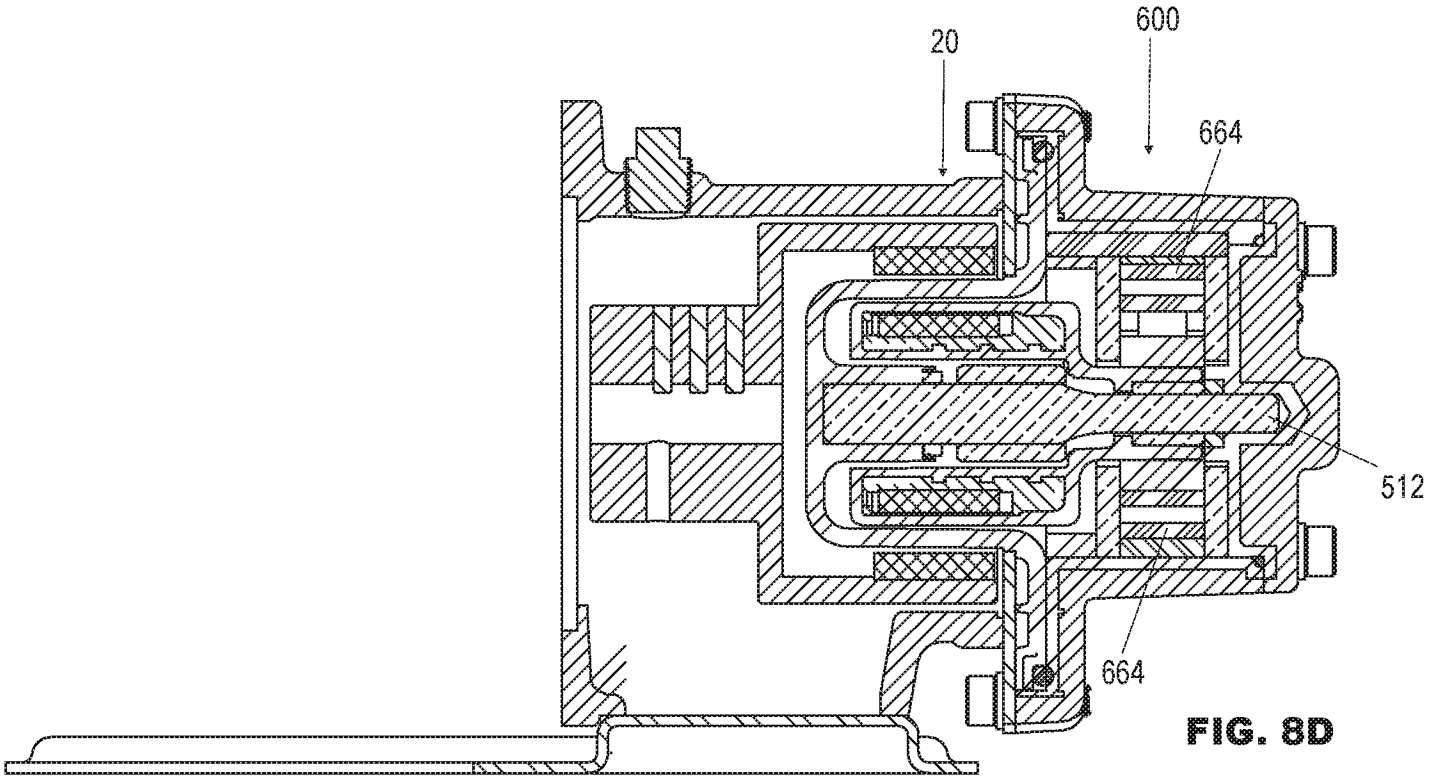
FIG. 8D is a cross-sectional view of the mounted roller-vane assembly of FIG. 8A taken along the lines 8D-8D.
Figure 8F:
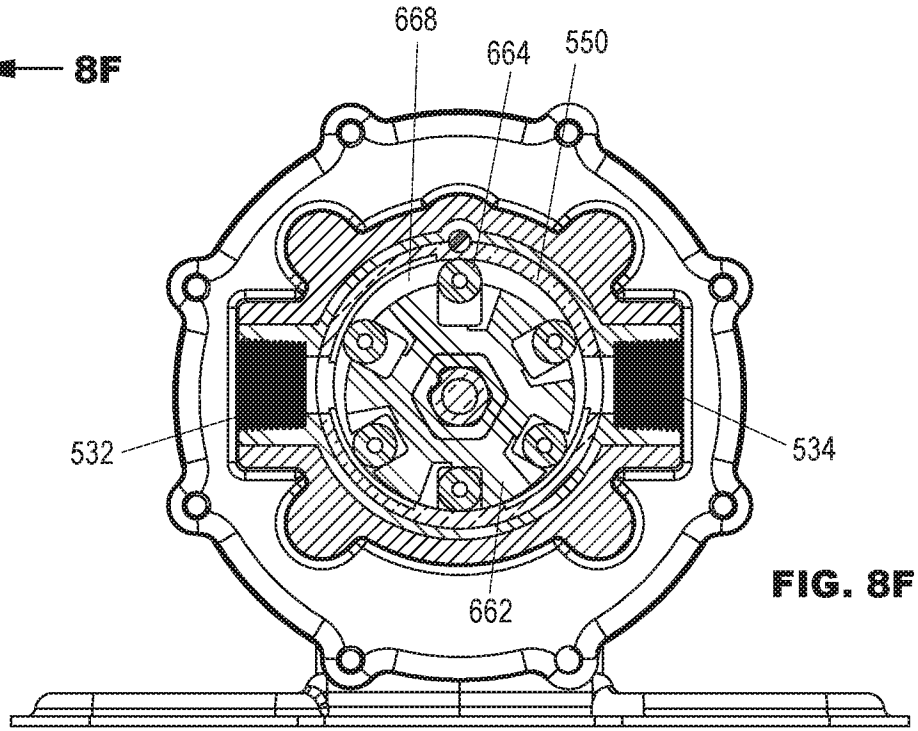
FIG. 8F is a cross-sectional view of the mounted roller-vane assembly of FIG. 8E taken along the lines 8F-8F.
Figure 8E:
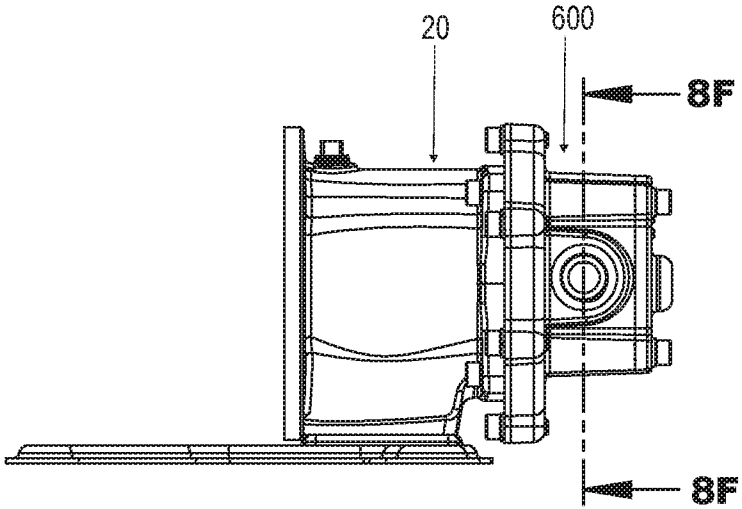
FIG. 8E is a side isometric view of the mounted roller-vane assembly of FIG. 8A.

Turning now to FIGS. 8A-8F, a particular pump assembly, referenced as a roller vane pump assembly 600, is shown in FIG. 8A mounted on the universal adapter 20. The roller vane pump assembly 600 has features and elements in common with the above described sliding vane pump assembly 500 of FIGS. 7A-7F. Accordingly, the above descriptions apply as well to those components of the roller vane pump assembly where like reference numbers in the respective drawings denote like features and elements.

The roller vane pump assembly 600 (FIGS. 8A-8F) differs, for example, by having a roller vane impeller 660 (FIG. 8C) in lieu of the sliding vane impeller 560 (FIG. 7C). The impeller has a hub 662 and roller vanes 664. The hub 662 is mounted on, and rotates with, the driven shaft 524. A space 668 (FIG. 8F) for the travel of pumped fluid is defined between the hub 662 and offset ring 550. The back plate 542 and front plate 580 define back and front walls, respectively, of the fluid space. The rotating hub 662 carries the roller vanes 664 that engage the inner surface of the offset ring 550. The hub 662 has radially outward opening slots 666 in which the roller vanes 664 are trapped by the offset ring 550. The roller vanes 664, which move within the slots 666 as the hub 662 rotates, are persistently urged outward toward the inner wall of the offset ring 550 by centrifugal force during rotation. Due to the offset position of the ring 550 relative to the hub 662, the roller vanes 664 reciprocate radially within the slots 666 as the hub rotates, extending relatively outward at rotational positions where the hub 662 and ring 550 are separated, and forced inward at positions where the hub 662 and ring 550 are close or in contact. Pumped fluids within the fluid space are thus pressed or moved circumferentially within the crescent space as the impeller 660 rotates. Upon rotation of the hub 662, for example clockwise in FIG. 8F, pumped fluid is moved within the crescent space (rightward in FIG. 8F).

The roller vanes 664 are shaped as cylindrical rollers to prevent binding with the inner wall of the ring 550. The vanes are rigid but movable, able to both rotate and travel within the slots 666. The slots 666 are dimensioned to receive full insertion of the roller vanes 664 as they rotate past the close or contact positions of the hub 662 and ring 550.

Non-limiting examples of use for the roller vane pump assembly 600 include of the sliding vane pump assembly 500. The roller vane pump assembly 600 is more tolerant of unintended solids in the pumped liquid. The hub 662 and roller vanes 664 can be plastic.

Turning now to FIGS. 9A-9G, a particular pump assembly, referenced as a flexible impeller pump assembly 700, is shown in FIG. 7A mounted on the universal adapter 20. An outer back cover 702 (FIG. 9C) abuts the flange portion of the containment shell 704. The containment shell 704, similar to the containment shell 54, has a cup 706 and a flange 708, and may have a single layer, layered or two-piece construction.

A stationary shaft 710 serves as an axle extending longitudinally from the interior of the cup 706. The shaft 710 has a rearward portion fixed to the cup 706, and a forward portion 712 that may be diameter reduced relative to the rearward portion. A first rotating bushing 714 is mounted on the rearward portion of the shaft 710, and a smaller second rotating bushing 715, is mounted on the diameter reduced forward portion 712. A rotatable driven assembly 716 has rearward and forward portions mounted respectively on the first bushing 714 and second bushing 715 for rotation on the shaft 710.

In particular, the rearward portion of the rotatable driven assembly 716 includes a rearward inner magnet assembly 718 in which permanent magnets are attached at uniformly spaced angular intervals to a central hub, which may be metal for example. The magnets and hub are encapsulated in an outer shell, which may be plastic for example. The inner magnet assembly 718, by coupling to the outer magnet assembly 34 of the adapter 20, rotates the driven assembly 716.

The forward portion of the driven assembly 716 includes a driven shaft 724 connected to and extending forward from the inner magnet assembly 718. The driven shaft 724 may be, for example, integral with the magnet assembly 718 for a one-piece construction. The inner magnet assembly 718 rotates within the cup 706 of the containment shell 704 and the driven shaft 724 rotates within the casing 730. A gasket 738, illustrated for example as an O-ring, seals the forward side of the containment shell 704 with the casing 730.

Within the casing 730, a stationary outer liner insert 740 is positioned within a cylindrical inner wall of the casing 730. The cylindrical inner wall of the casing 730, and the liner insert 740 therewith, are axially offset relative to the longitudinal axis defined by the shaft 710 and about which the driven shaft 724 rotates. The liner insert 740 sets the axially offset of other further interior components. A flexible vane impeller 760 is mounted on and rotates with the driven shaft 724.

The stationary liner insert 740 sets the axial position of a stationary inner back plate 750, which has a hole 752 in which the driven shaft 724 rotates. The impeller 760 is flanked from behind by the back plate 750 and from ahead by a stationary inner front plate 770, which has a hole 772 through which the forward portion 712 of the shaft 710 extends.

A stationary forward insert 780 engages the forward end of the shaft 710, and maintains the position of the front plate 770 adjacent the front of the impeller 760. The forward insert 780 can be constructed, for example, of plastic such as that of the encapsulation of the magnet assembly 718 and that of the liner insert 740.

The casing 730 has a lateral side opening first port 732 aligned with a first port 742 of the liner insert 740. Similarly, the casing 730 has an opposite lateral side opening second port 734 (FIG. 9G) aligned with a second port 744 of the liner insert 740. The first ports 732 and 742 serve as inlets in one rotational direction of the driven shaft 724 and impeller 760 (counter-clockwise in FIG. 9G) and as outlets in an opposite rotational direction thereof (clockwise). The second ports 734 and 744 serve correspondingly opposite roles with respect to the first ports.

The flexible vane impeller 760 has a hub 762 mounted on the driven shaft 724 and flexible vanes 764 that extend generally outward from the hub. In the illustrated embodiment, the impeller 760 is of unitary one-piece construction, with the vanes 764 being the same material contiguous with the hub 762. In other embodiments, the hub 762 (for example, a rigid material) and vanes 764 (flexible, resilient material) of joined component fabricated of different materials.

Figure 9A:
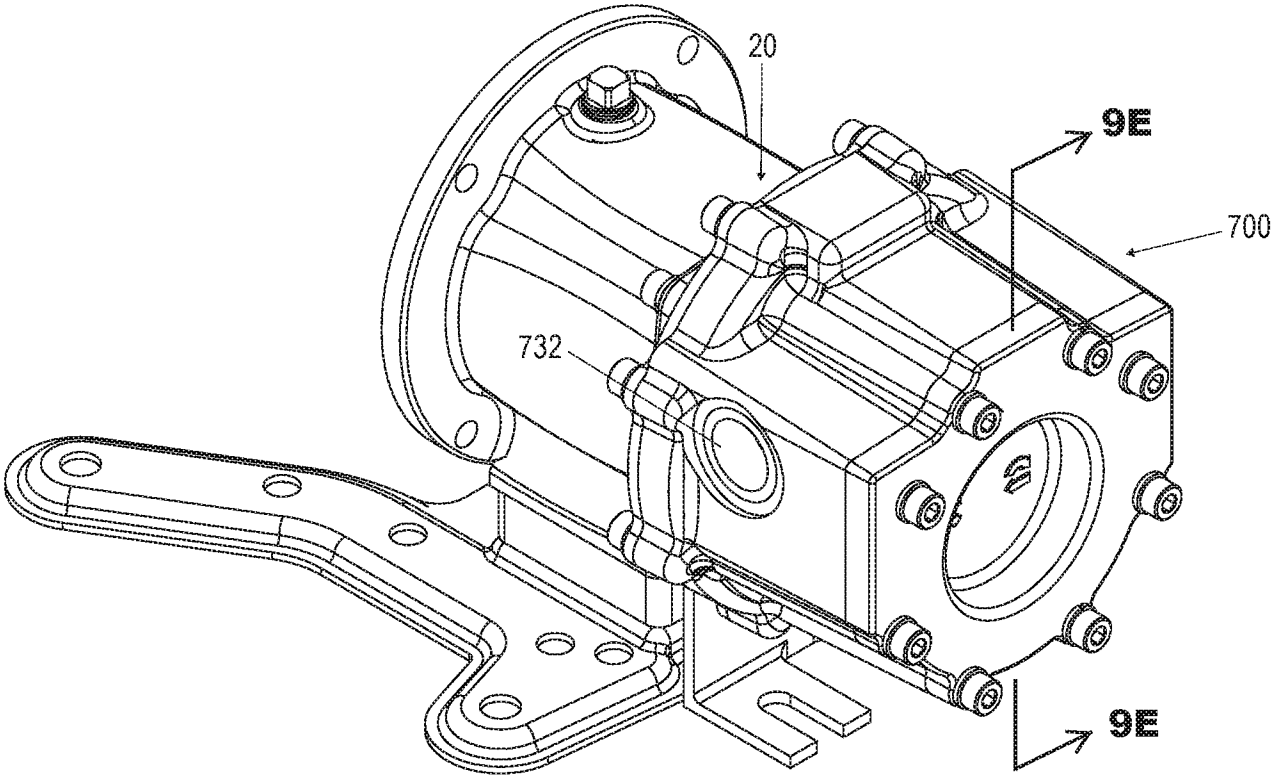
FIG. 9A is a front perspective view of a flexible-vane pump assembly according to the present disclosure mounted on the universal adapter of FIG. 1.
Figure 9B:
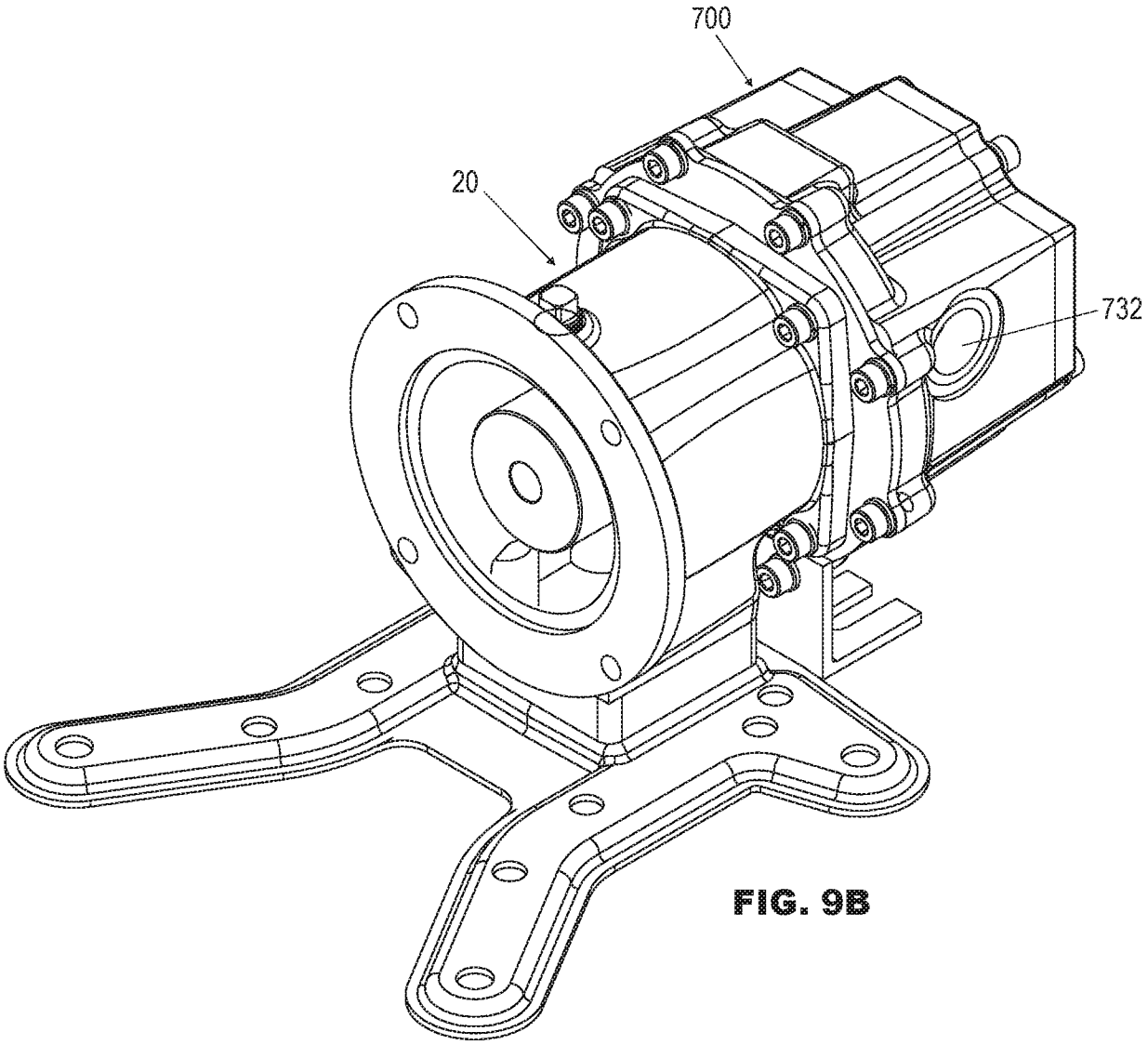
FIG. 9B is a back perspective view of the flexible-vane turbine pump assembly of FIG. 9A.
Figure 9C:
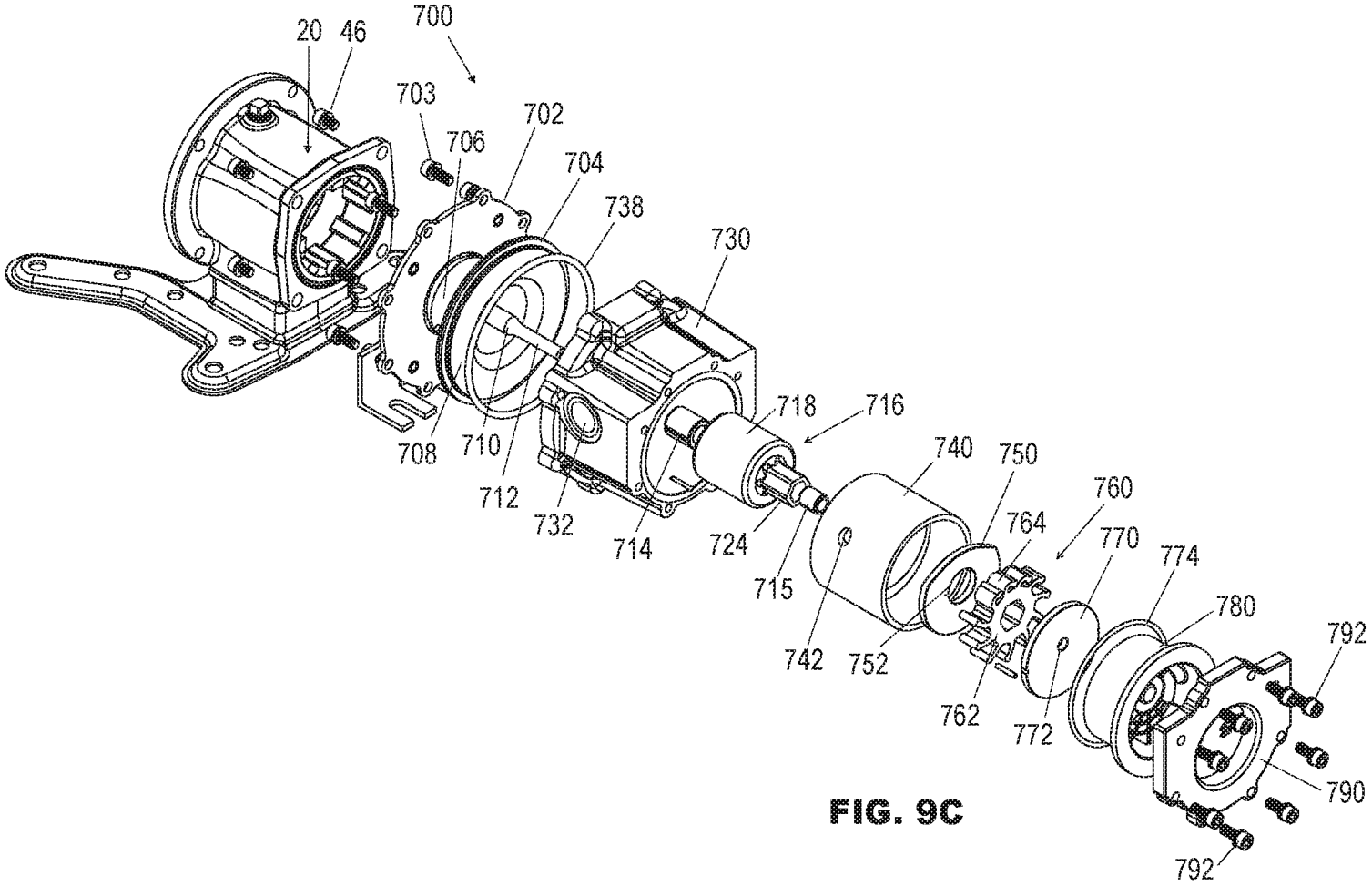
FIG. 9C is an exploded front perspective view of the flexible-vane pump assembly of FIG. 9A.
Figure 9D:
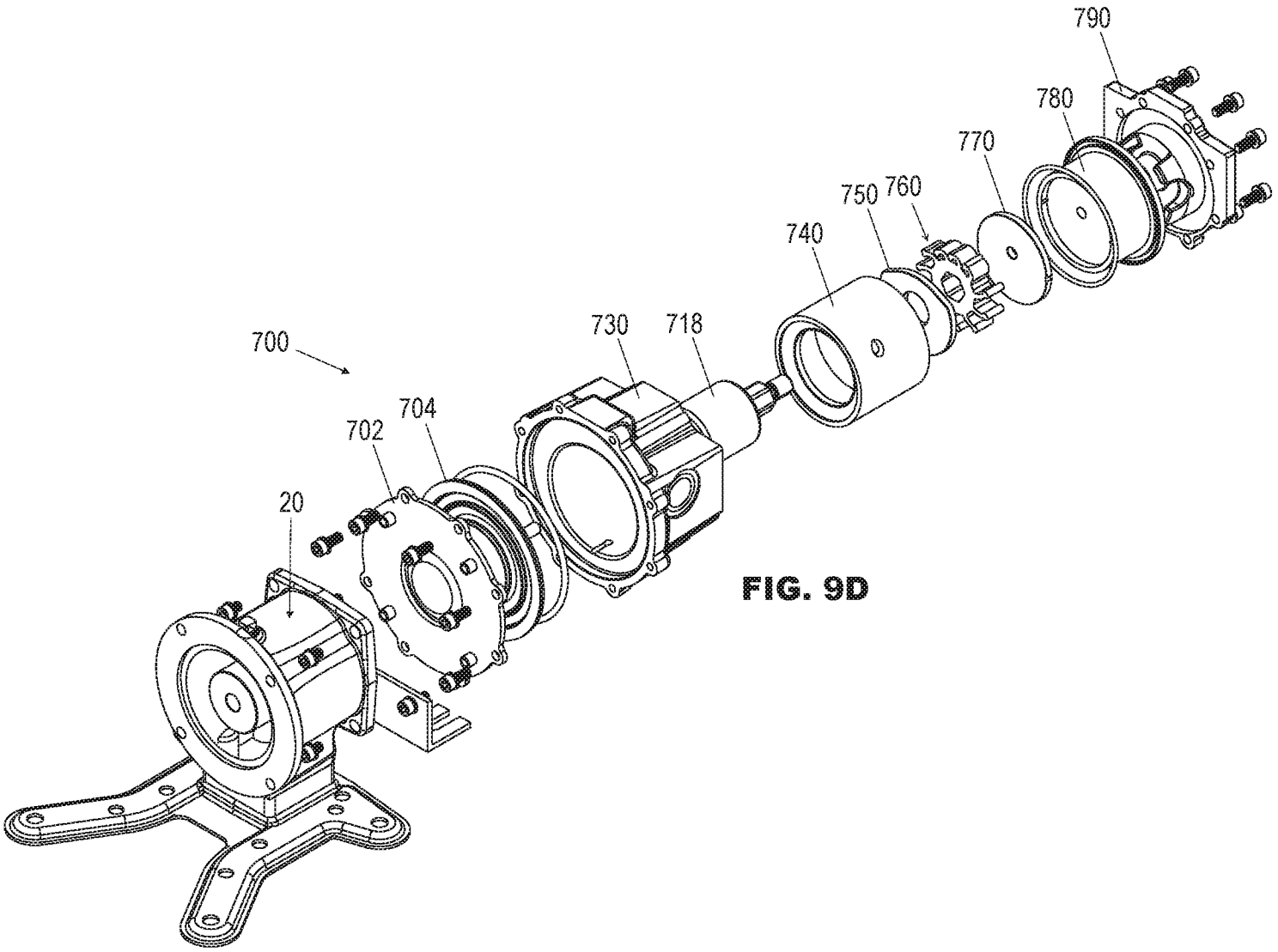
FIG. 9D is an exploded back perspective view of the flexible-vane pump assembly of FIG. 9A.
Figure 9E:
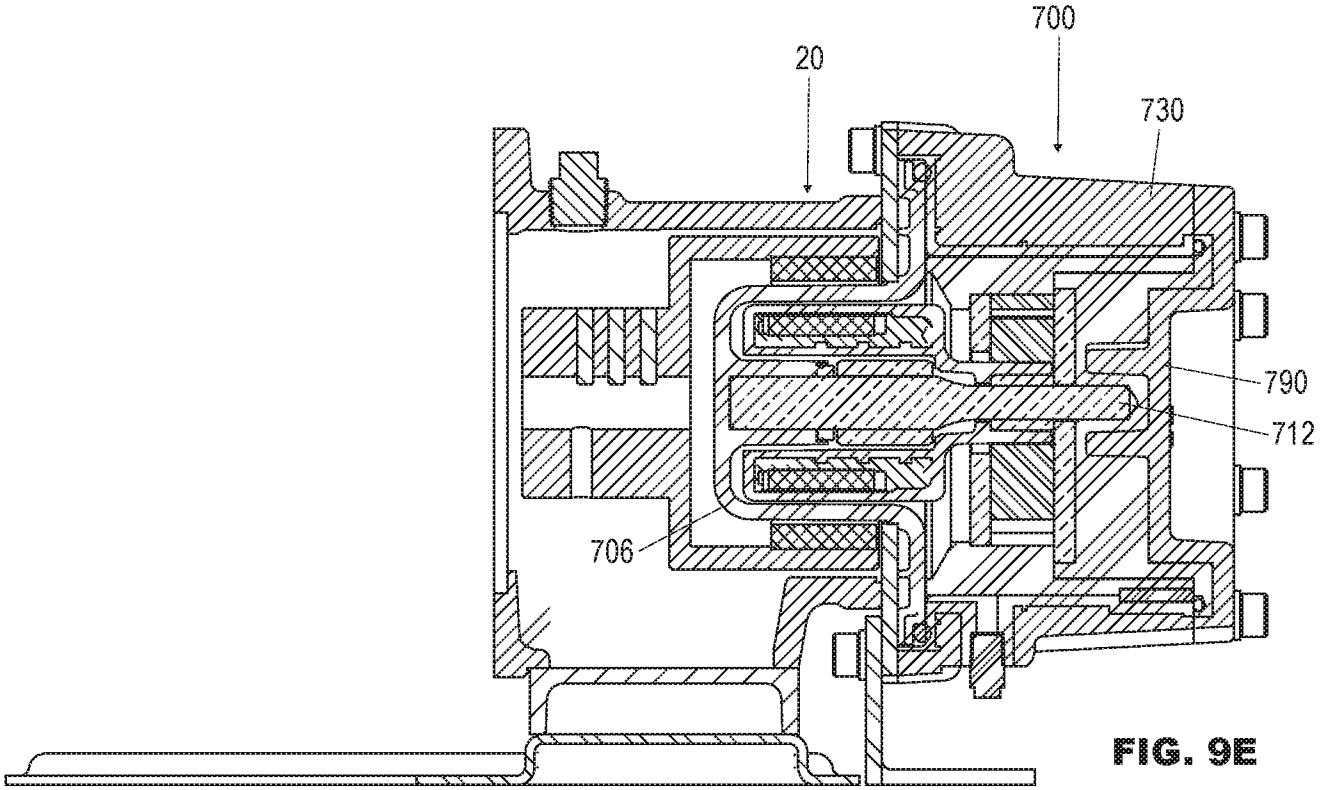
FIG. 9E is a cross-sectional view of the mounted flexible-vane assembly of FIG. 9A taken along the lines 9E-9E.
Figure 9F:
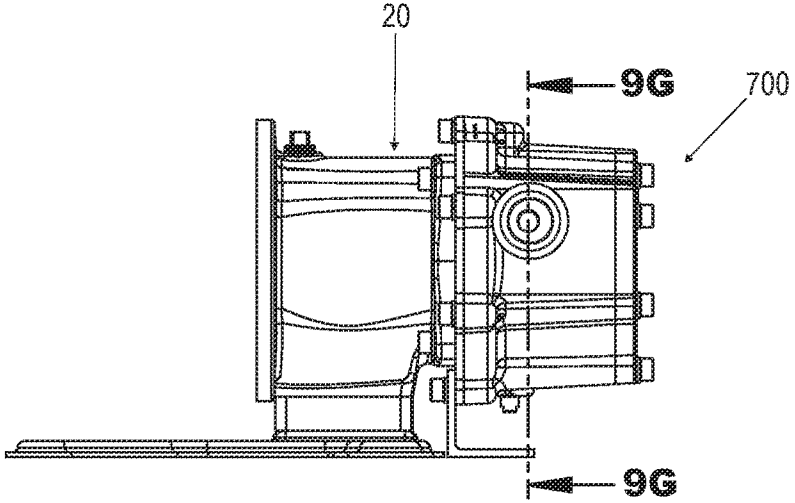
FIG. 9F is a side isometric view of the mounted flexible-vane assembly of FIG. 9A.
Figure 9G:
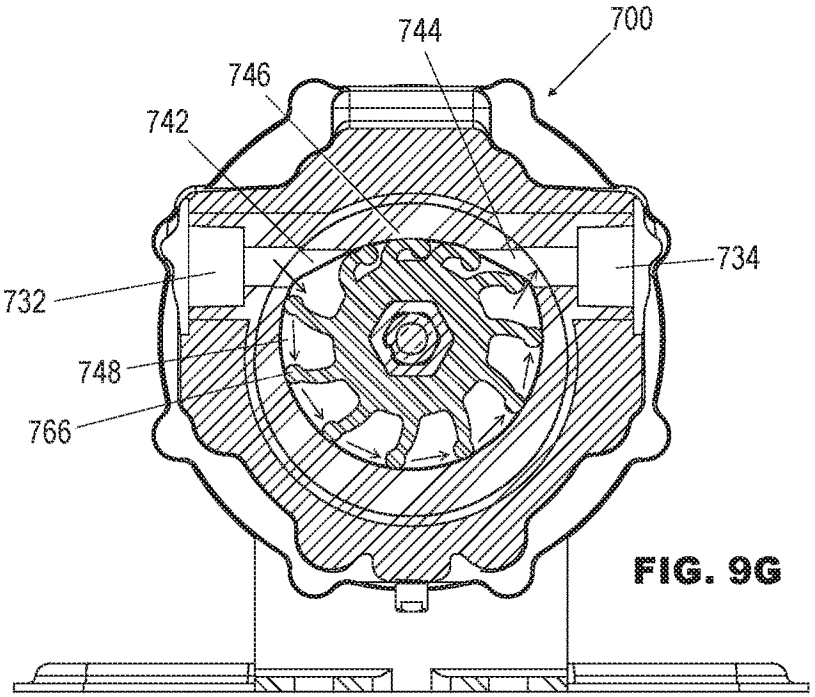
FIG. 9G is a cross-sectional view of the mounted flexible-vane assembly of FIG. 9F taken along the lines 9G-9G.
Figure 10A:
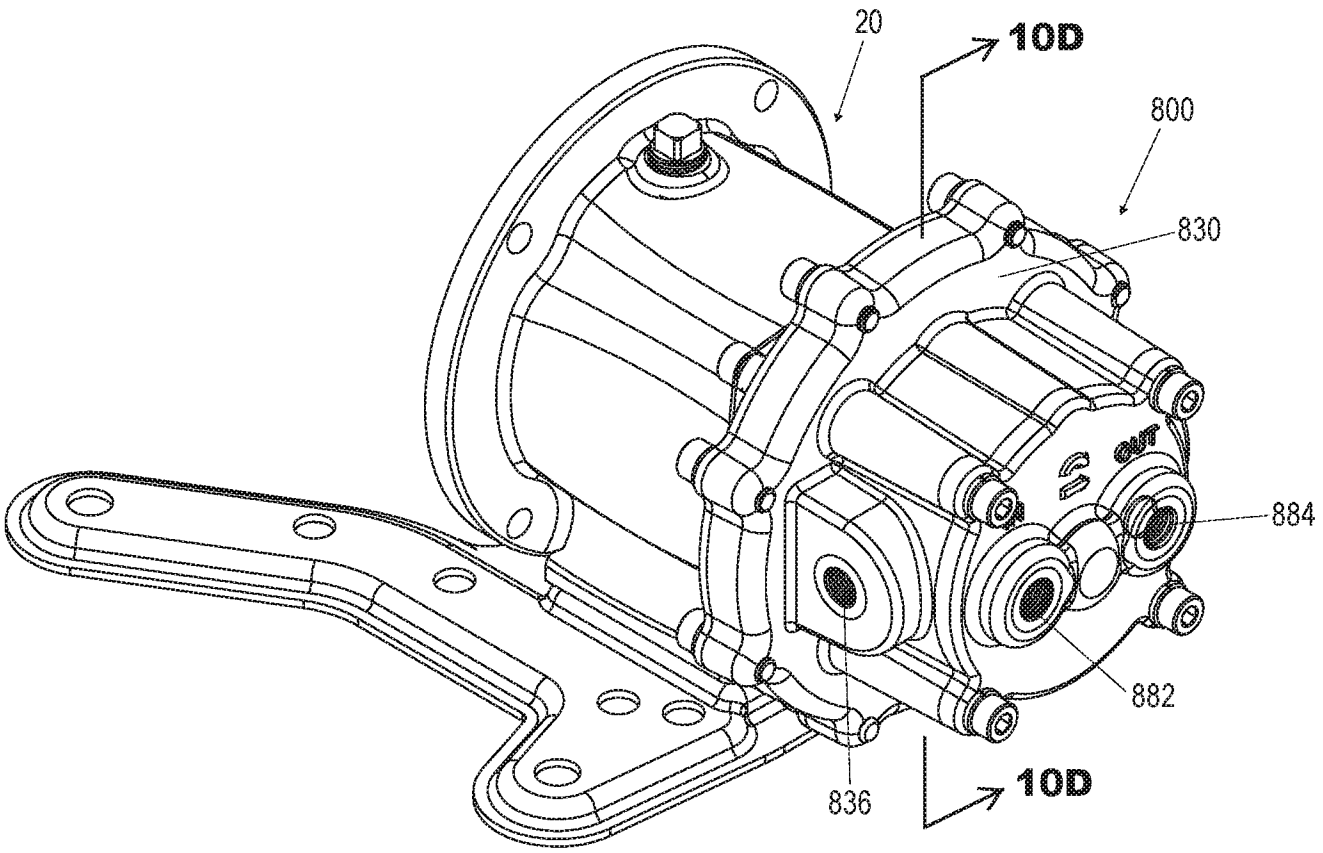
FIG. 10A is a front perspective view of a liquid-ring pump assembly according to the present disclosure mounted on the universal adapter of FIG. 1.
Figure 10B:
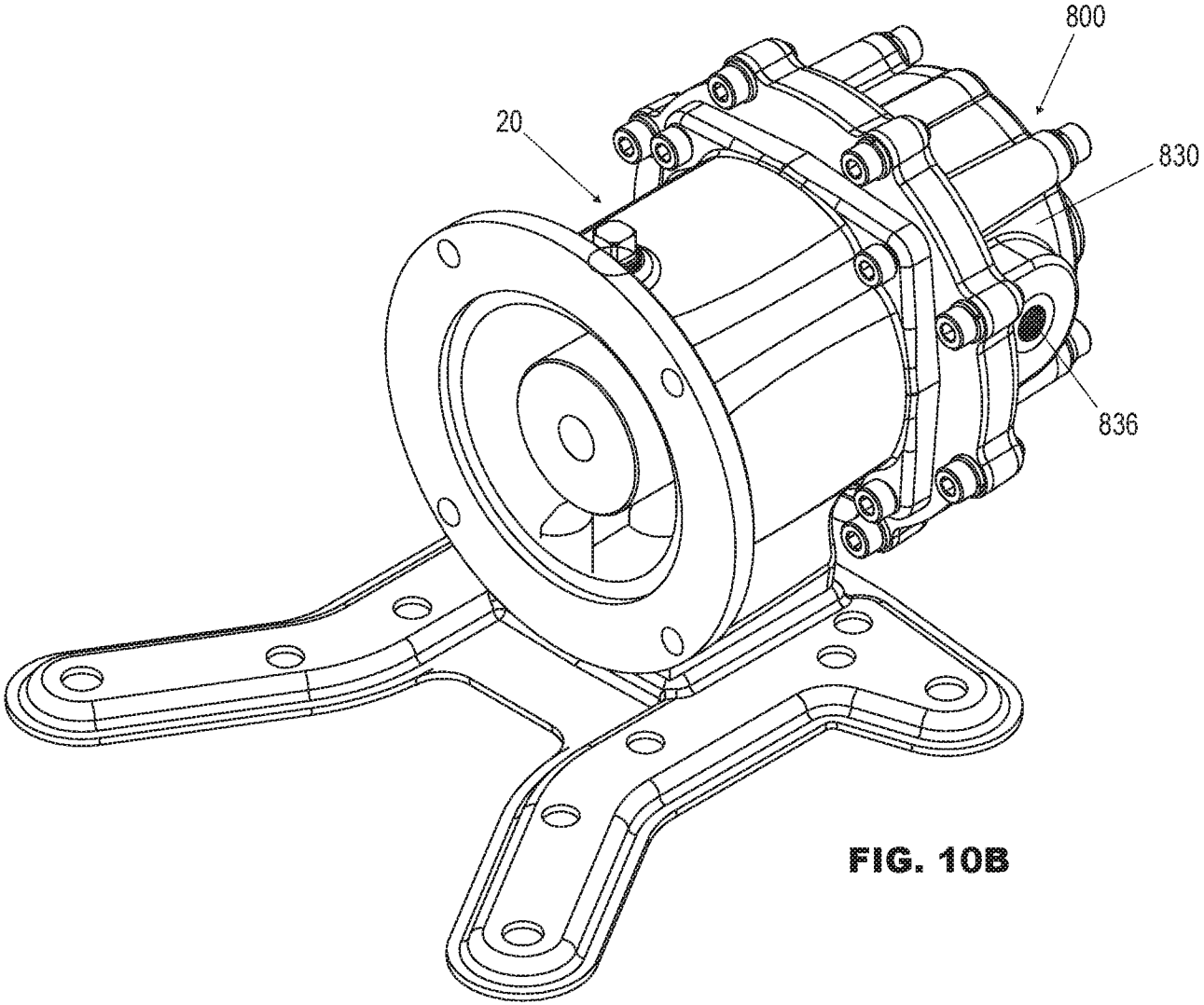
FIG. 10B is a back perspective view of the liquid-ring turbine pump assembly of FIG. 10A.
Figure 10C:
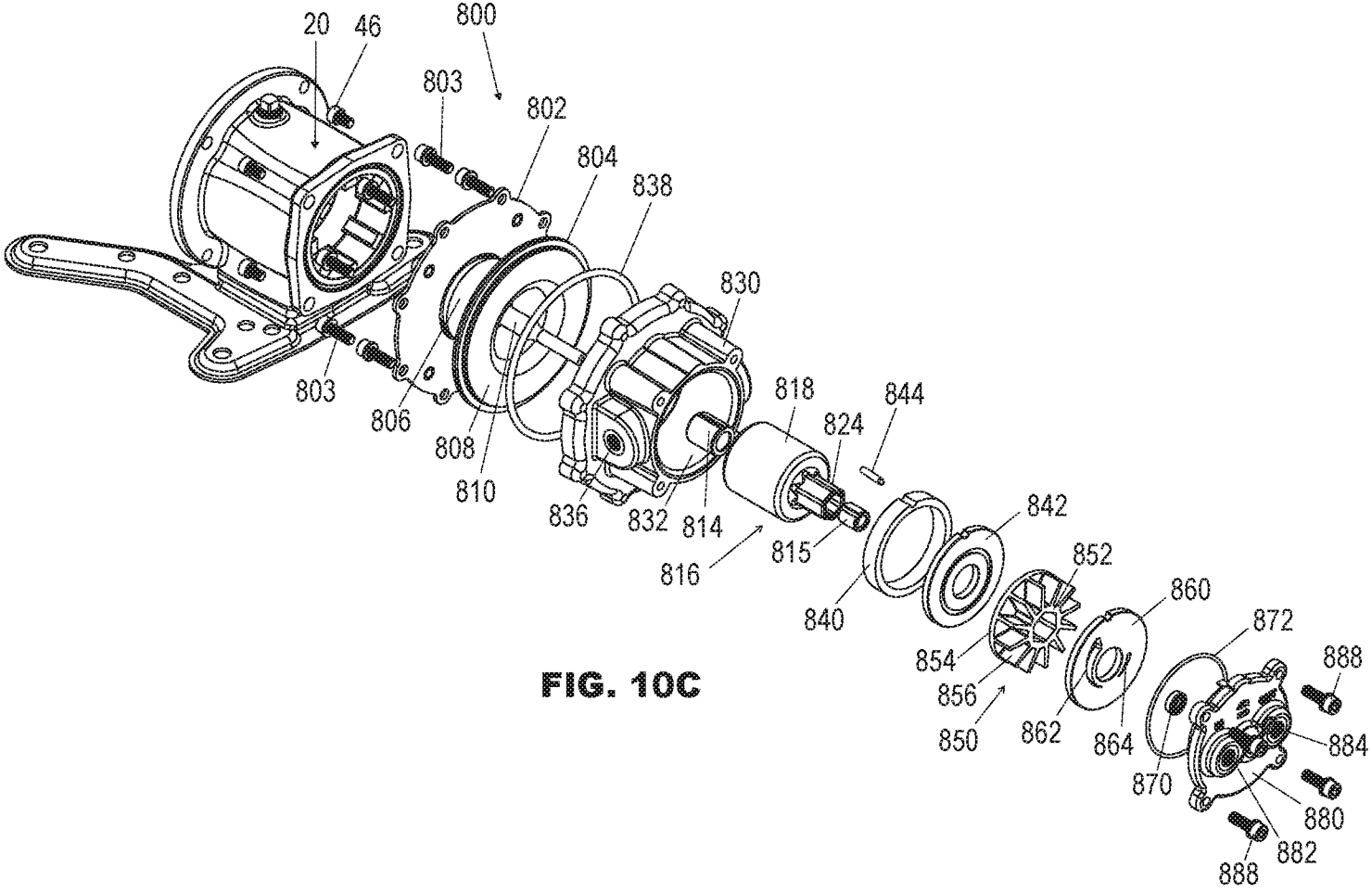
FIG. 10C is an exploded perspective view of the liquid-ring pump assembly of FIG. 10A.
Figure 10D:
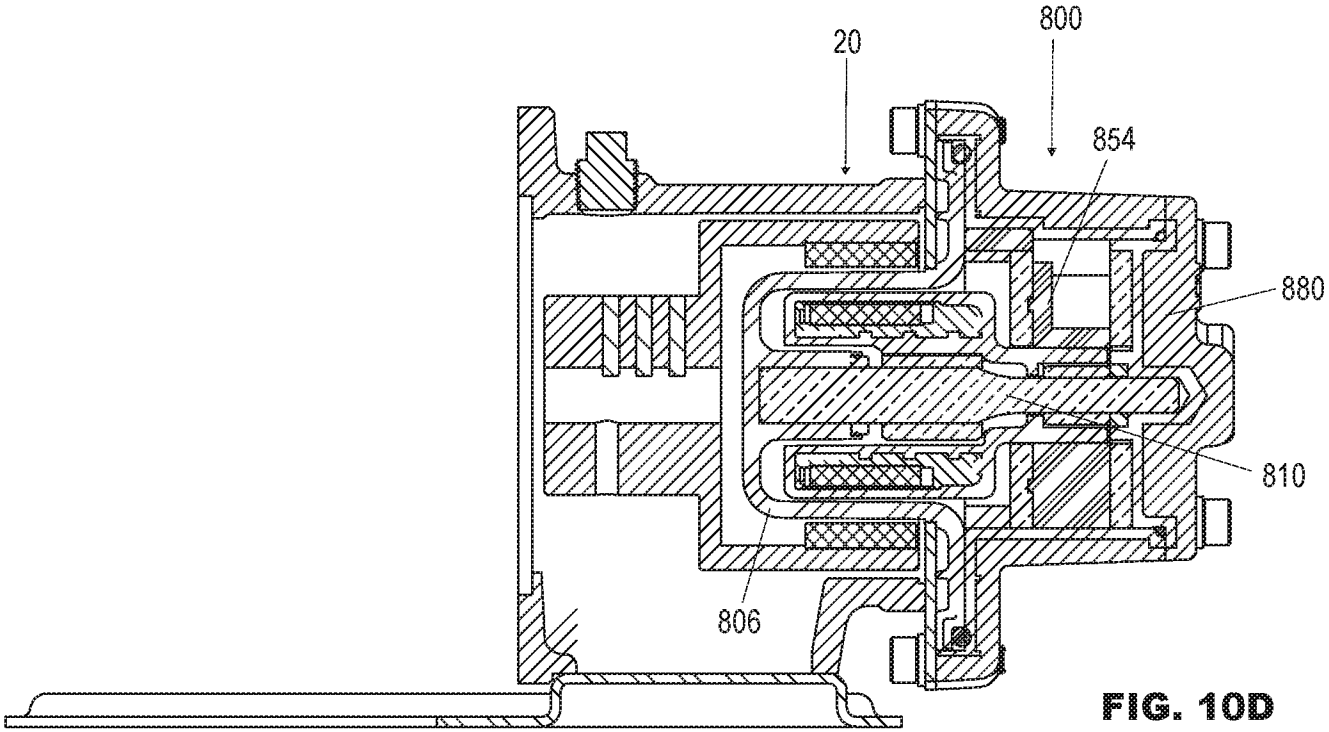
FIG. 10D is a cross-sectional view of the mounted liquid-ring assembly of FIG. 10A taken along the lines 10D-10D.
Figure 10E:
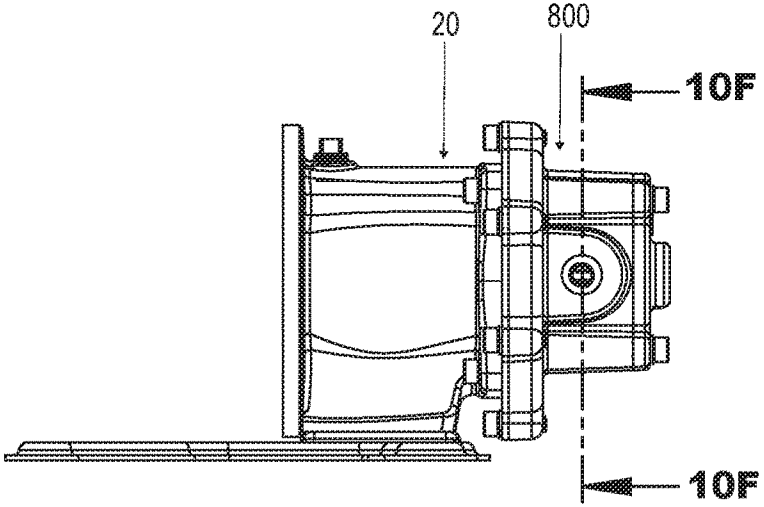
FIG. 10E is a side isometric view of the mounted liquid-ring assembly of FIG. 10A.
Figure 10F:
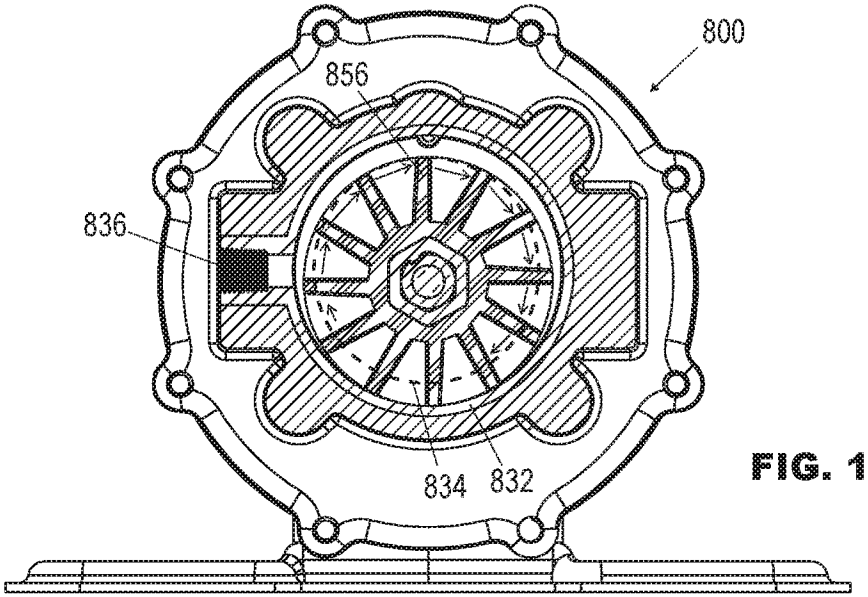
FIG. 10F is a cross-sectional view of the mounted liquid-ring assembly of FIG. 10E taken along the lines 10F-10F.

Upon rotation of the impeller within the offset liner insert 740, the flexible vanes 764, which trail upon rotation as shown for example in FIG. 9G, flex to deform, compress, or fold back as they approach an arcuate offset wall portion 746 of the liner insert 740, and re-extend as they depart the offset wall portion 746. Thus, the spaces that carry pumped liquid between the vanes 764 are expanding as they approach the inlet (first port 732) to draw fluids therein, and are reducing as they depart the outlet (second port 744) to eject fluids therefrom. Between the inlet and outlet, the pump fluid is carried (left to right in FIG. 9G for counter-clockwise rotation) between the vanes 764 along a travel path 748 within the liner insert 740 defined between the circumferential ends of the offset wall portion 746. The vanes 764 are shown as having bulbous terminal ends 766 opposite the hub 762 for improved centrifugal extension and sealing against the interior of the liner insert 740 upon rotation.

A gasket 774, illustrated for example as an O-ring, seals the front side of the casing 730 with the back side of an outer front cover 790. The assembly is maintained from the back by fasteners, shown as back assembly bolts 703, attaching the back cover 702 to the back end of the casing 730, and from the front by fasteners, shown as front assembly bolts 792, attaching a front cover 790 to the front of the casing 730.

The flexible impeller pump assembly 700 is useful as a self-priming positive displacement pump. Possible uses, as non-limiting examples, include those of the sliding vane sliding vane pump assembly 500. The casing 730 can be fabricated as a lined metal casing. The liner insert 740 and forward insert 780 can be plastic. The flexible vanes may be made of a flexible plastic or polymer. The front cover may be lined plastic. The back plate 750 and front plate 770 may be made of SIC for example. The containment shell 704 is two-layered in at least one example. The inner magnet assembly 718 may be encased in plastic. The shaft 710 and bushings may be made of SIC. These are all non-limiting examples.

Turning now to FIGS. 10A-10F, a particular pump assembly, referenced as a liquid ring pump assembly 800, is shown in FIG. 8A mounted on the universal adapter 20. An outer back cover 802 (FIG. 8C) abuts the flange portion of the containment shell 804. The containment shell 804, similar to the containment shell 54, has a cup 806 and a flange 808, and may have a single layer, layered or two-piece construction.

A stationary shaft 810 serves as an axle extending longitudinally from the interior of the cup 806. The shaft 810 has a rearward portion fixed to the cup 806, and a forward portion that may be diameter reduced relative to the rearward portion. A first rotating bushing 814 is mounted on the rearward portion of the shaft 810, and a smaller second rotating bushing 815, is mounted on the diameter reduced forward portion for rotation on the shaft 810. A rotatable driven assembly 816 has rearward and forward portions mounted respectively on the first rotating bushing 814 and second rotating bushing 815 for rotation on the shaft 810.

In particular, the rearward portion of the rotatable driven assembly 816 includes a rearward inner magnet assembly 818 in which permanent magnets are attached at uniformly spaced angular intervals to a central hub, which may be metal for example. The magnets and hub are encapsulated in an outer shell, which may be plastic for example. The inner magnet assembly 818, by coupling to the outer magnet assembly 34 of the adapter 20, rotates the driven assembly 816.

The forward portion of the driven assembly 816 includes a driven shaft 824 connected to and extending forward from the inner magnet assembly 818. The driven shaft 824 may be, for example, integral with the magnet assembly 818 for a one-piece construction. The inner magnet assembly 818 rotates within the cup 806 of the containment shell 804 and the driven shaft 824 rotates within the casing 830. A gasket 838, illustrated for example as an O-ring, seals the forward side of the containment shell 804 with the casing 830.

Within the casing 830, a stationary axial spacer 840 is positioned forward of the containment shell 804 to set the axial position of a stationary inner back plate 842, which has an offset hole in which the driven shaft 824 rotates. An impeller 850 is flanked from behind by the back plate 842 and from ahead by a stationary inner front plate 860, which has an offset hole in which the driven shaft 824 rotates. The impeller 850 has a hub 852 mounted on, and engaged with, the driven shaft 824. An annular back disc 854 and vanes 856 extend outward from the hub 852, with the vanes 856 extending forward from the back disc 854.

The casing 830 has an inner cylindrical wall 832 that is axially offset relative to the longitudinal axis defined by the shaft 810 and about which the driven shaft 824 rotates. Accordingly, as the impeller 850 rotates within the casing 830, the vane tips approach and depart the inner wall 832. A liquid within the casing is used to form a liquid ring 834 (FIG. 10F) by centrifugal force as the impeller 850 rotates. The liquid ring 834 serves as a seal between the vane tips and the inner wall 832. The offset between the impeller's axis of rotation and the casing inner cylindrical wall 832, along which the liquid ring 834 forms, causes a cyclic variation of the volumes of the spaces enclosed between the vanes. Gas is pumped as the spaces between the vanes 856 expand and diminish between the hub 852 and liquid ring 834 with each rotation of the hub. The expanding and diminishing spaces serve as compression chambers that pump gas. The sealing liquid that forms the liquid ring 834, some of which is evaporated or dissipated into the pumped gas or otherwise escapes the casing, can be replenished through a port 836. Water can be used as a non-limiting example. Water with some oil content may be used. A downstream separator may be used to separate the liquid carried from the pump assembly by pumped gas.

An outer front cover 880 has an inlet 882 through which pumped gas enters the pump assembly 800, and an outlet 884 through which the pumped gas exits. The front plate 860 has an inlet slot 862 through which gas from the inlet 882 enters the expanding spaces between the vanes 856 as the vanes rotate (clockwise in FIG. 10F). The front plate 860 has an outlet slot 864 through which gas compressed by the diminishing spaces between the vanes 856 is pumped to the outlet 884.

An axial wear spacer 870 fits within the front cover 880 and takes any axial loads from the rotating bushing 815. A forward gasket 872, illustrated as an O-ring, seals the forward end of the casing 830 with the back side of the front cover 880. A key 844 engages a keyway within the casing 830 and prevents rotation of the axial spacer 840 and back plate 842, each having a respective aligned keyway. The assembly is maintained from the back by fasteners, shown as back assembly bolts 803, attaching the back cover 802 to the back of the casing 830, and from the front by fasteners, shown as front assembly bolts 888, attaching the front cover 880 to the front of the casing 830.

Non-limiting examples of use for the liquid ring pump assembly 800 include use as a gas vacuum pump and use for the tank to tank gas transfer of gaseous fluid. The pumped gas may be corrosive, in which case appropriate liquid should be chosen. For the sealing liquid that forms the liquid ring 834, water can be used as a non-limiting example. A downstream separator may be used to separate the liquid carried from the pump assembly by pumped gas.

Turning now to FIGS. 11A-11I, a particular pump assembly, referenced as a high-pressure diaphragm pump assembly 900, is shown in FIG. 9A mounted on the universal adapter 20. An outer back cover 902 (FIG. 9C) abuts the flange portion of the containment shell 904. The containment shell 904, similar to the containment shell 54, has a cup 906 and a flange 908, and may have a single layer, layered or two-piece construction.

A stationary shaft 910 serves as an axle extending longitudinally from the interior of the cup 906. The shaft 910 has a rearward portion fixed to the cup 906, and a forward portion 912 that may be diameter reduced relative to the rearward portion. A first rotating bushing 914 is mounted on the rearward portion of the shaft 910, and a smaller second rotating bushing 916, is mounted on the diameter reduced forward portion 912 for rotation on the shaft 910. A rotatable driven assembly 920 has rearward and forward portions mounted respectively on the first rotating bushing 914 and second rotating bushing 916 for rotation on the shaft 910.

In particular, the rearward portion of the rotatable driven assembly 920 includes an inner magnet assembly 922 in which permanent magnets are attached at uniformly spaced angular intervals to a central hub, which may be metal for example. The magnets and hub are encapsulated in an outer shell, which may be plastic for example. The inner magnet assembly 922, by coupling to the outer magnet assembly 34 of the adapter 20, rotates the driven assembly 920.

The forward portion of the driven assembly 920 includes a driven shaft 924 connected to and extending forward from the inner magnet assembly 922. The driven shaft 924 may be, for example, integral with the inner magnet assembly 922 for a one-piece construction. The inner magnet assembly 922 rotates within the cup 906 of the containment shell 904 and the driven shaft 924 rotates within the casing 954. A gasket 926, illustrated for example as an O-ring, seals the forward side of the containment shell 904 with the casing 954.

Figure 11A:
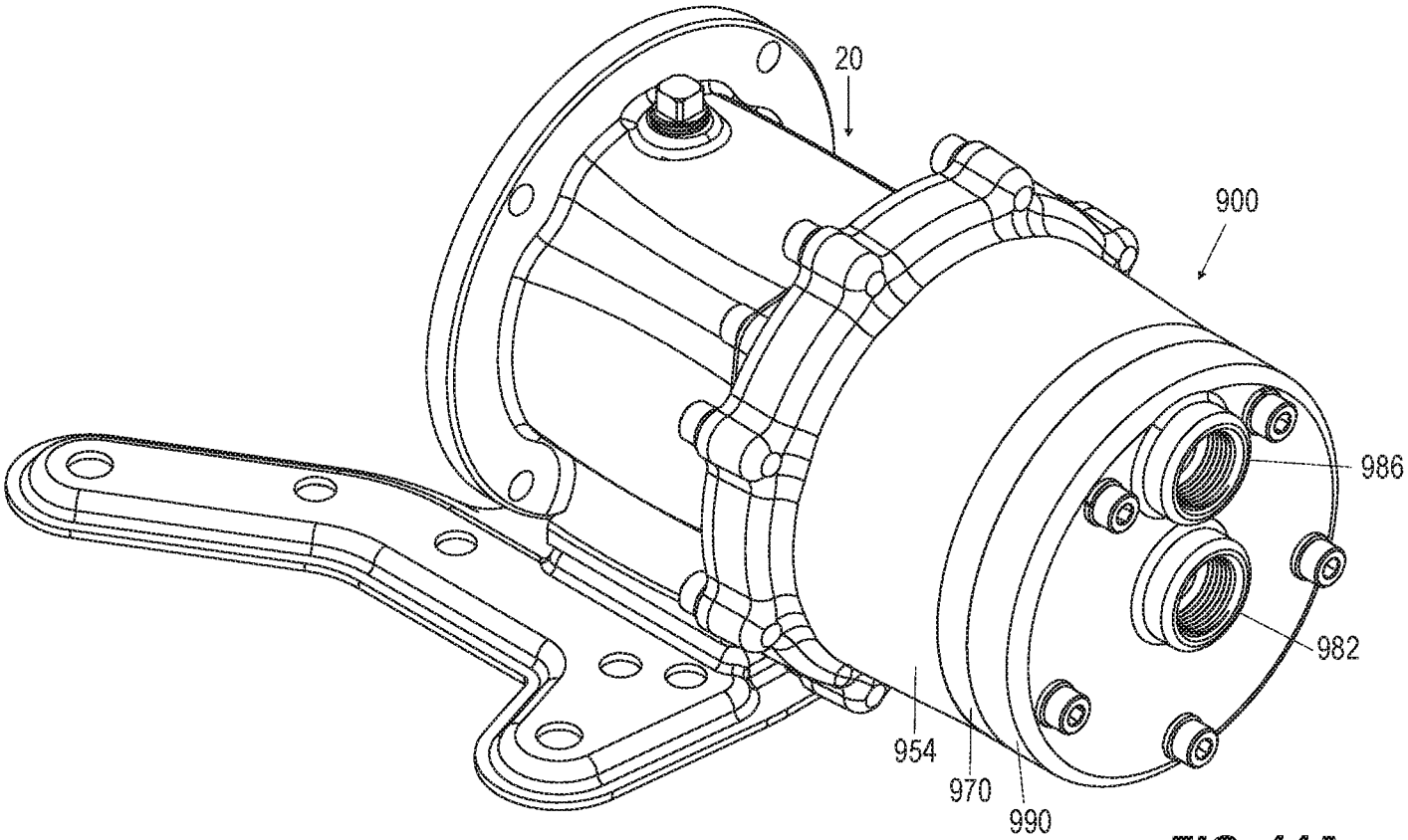
FIG. 11A is a front perspective view of a diaphragm pump assembly according to the present disclosure mounted on the universal adapter of FIG. 1.
Figure 11B:
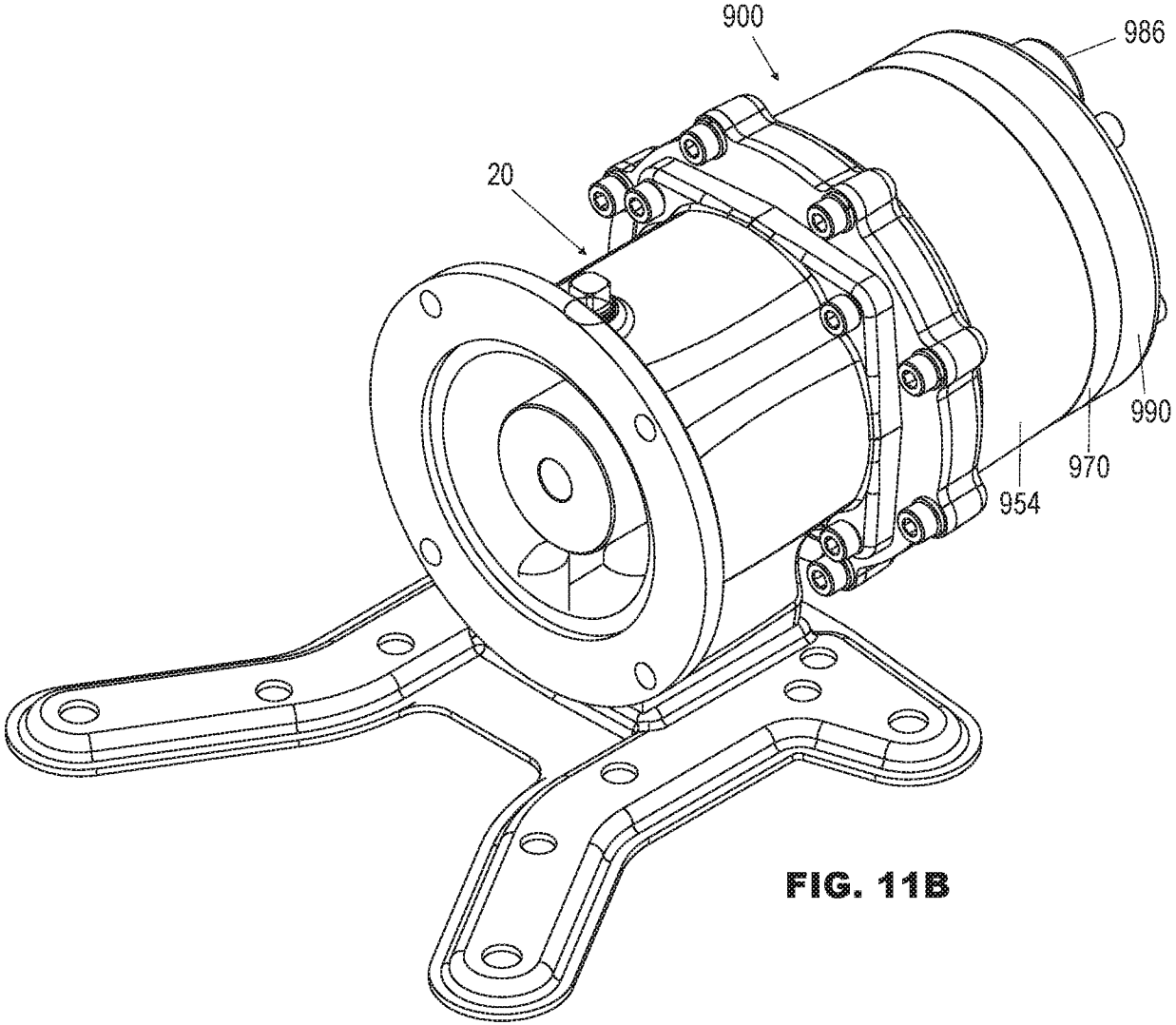
FIG. 11B is a back perspective view of the mounted diaphragm pump assembly of FIG. 11A.
Figure 11C:
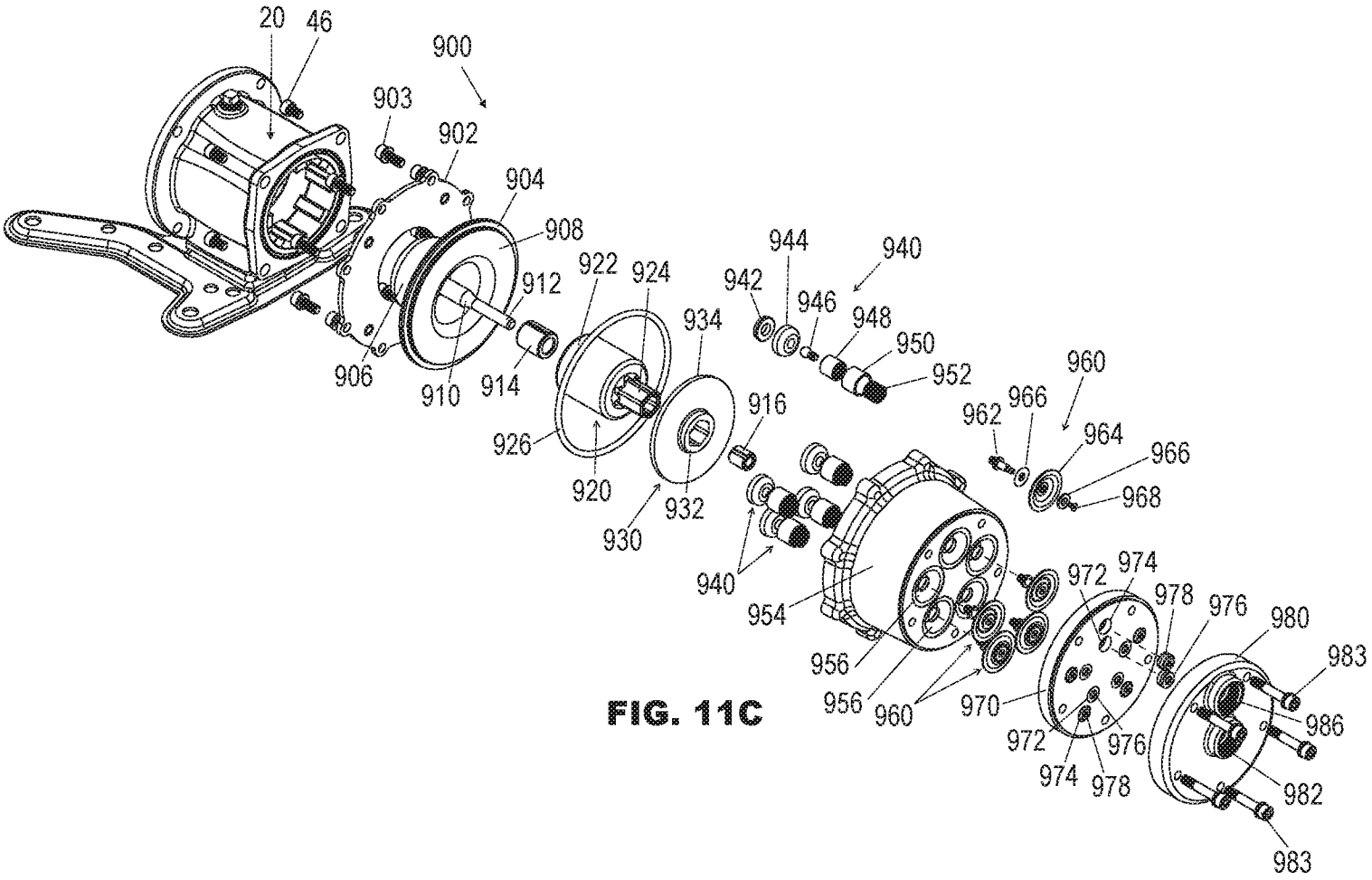
FIG. 11C is an exploded perspective view of the mounted diaphragm pump assembly of FIG. 11A.
Figure 11E:
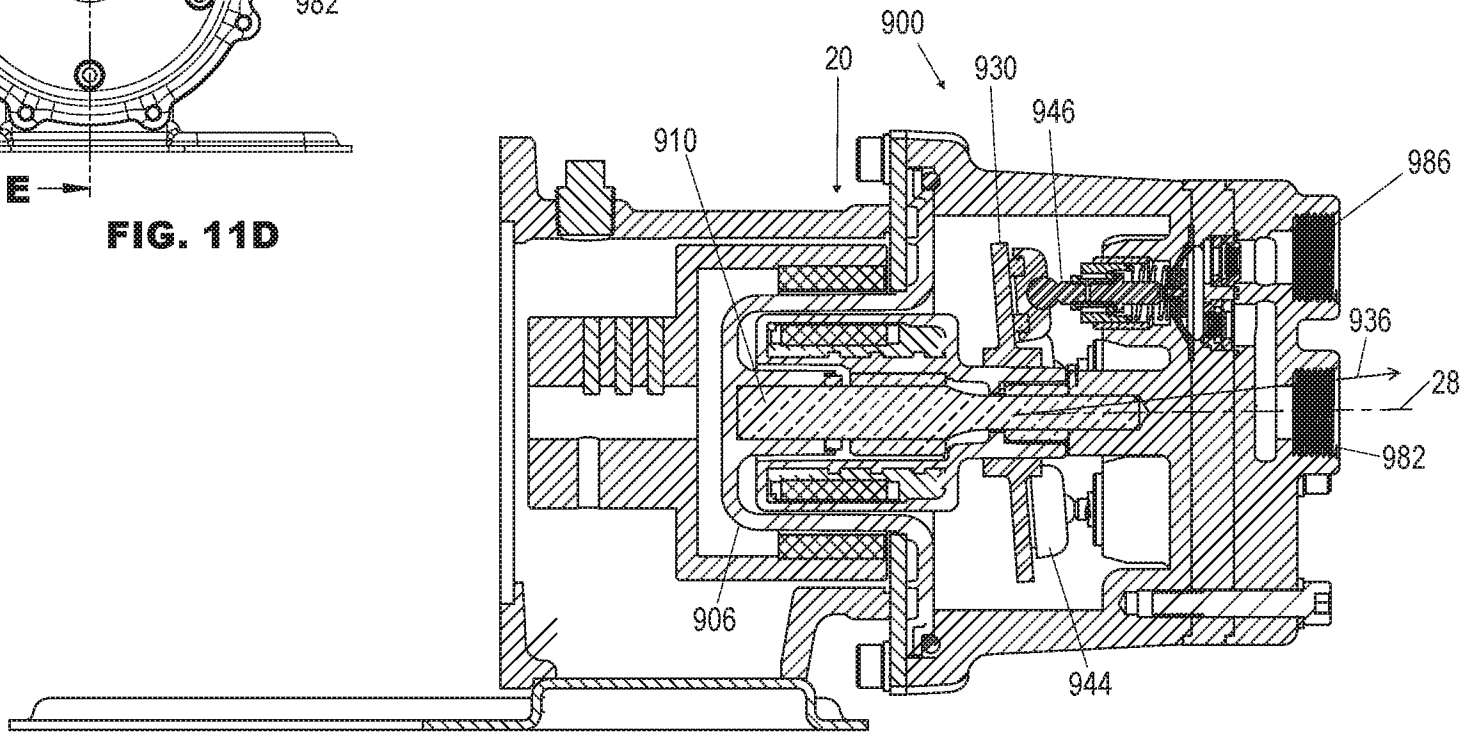
FIG. 11E is a cross-sectional view of the mounted diaphragm assembly of FIG. 11D taken along the lines 11E-11E.
Figure 11D:
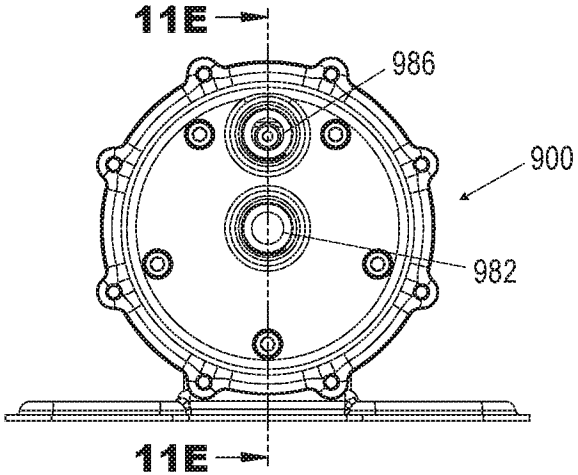
FIG. 11D is a front isometric view of the mounted diaphragm assembly of FIG. 11A.
Figure 11G:
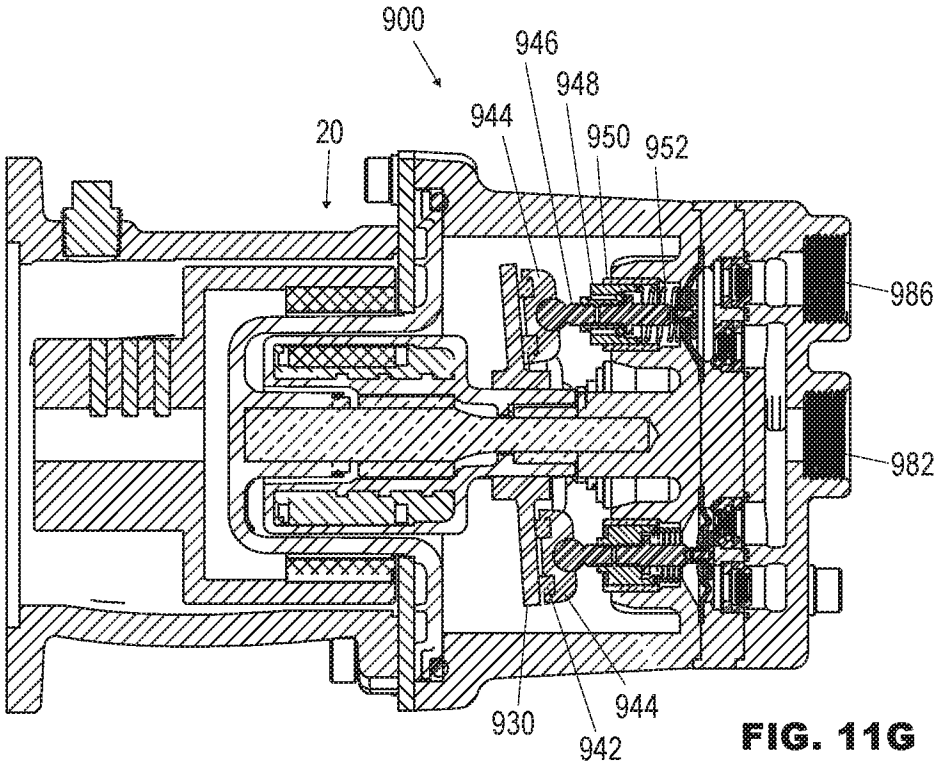
FIG. 11G is a compound cross-sectional view of the mounted diaphragm assembly of FIG. 11F taken along the lines 11G-11G.
Figure 11F:
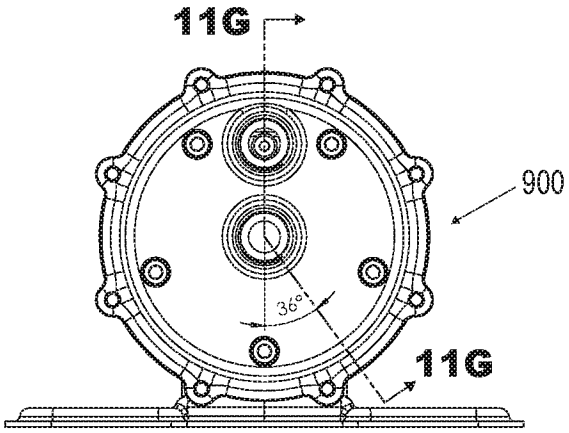
FIG. 11F is a front isometric view of the mounted diaphragm assembly of FIG. 11A, showing lines by which the compound cross-sectional view of FIG. 11F is taken.
Figure 11H:
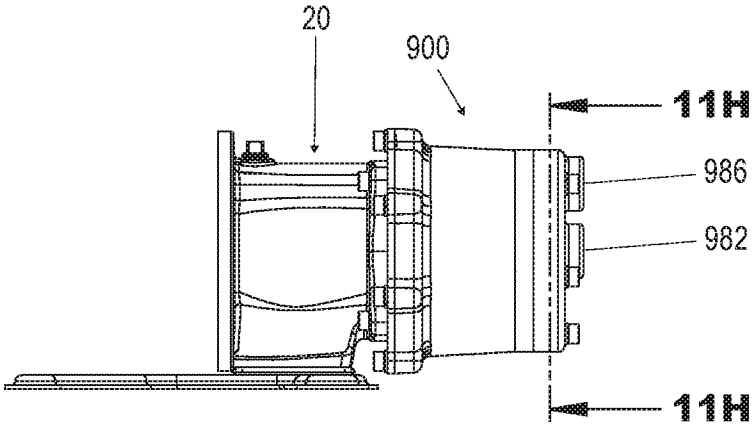
FIG. 11H is a side isometric view of the mounted diaphragm assembly of FIG. 11A.
Figure 11I:
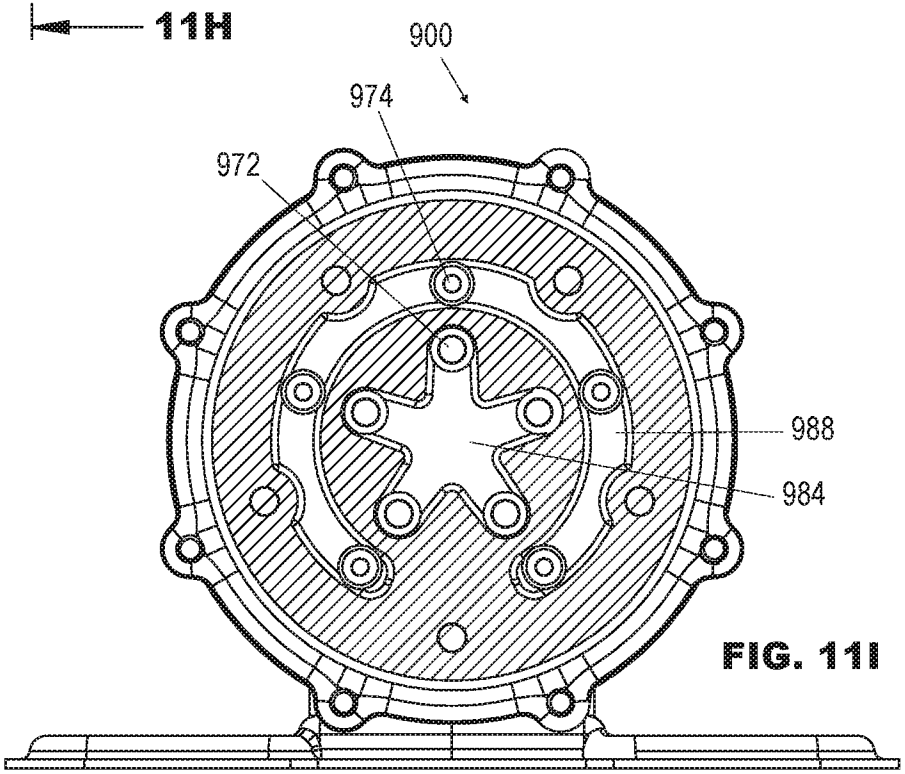
FIG. 11I is a cross-sectional view of the mounted diaphragm assembly of FIG. 11H taken along the lines 11I-11I.

A wobble driver 930 rotates on the driven shaft 924. The wobble driver 930 has a hub 932 mounted on the driven shaft and a planar wobble plate 934. As shown in FIG. 11G, the normal vector 936 (perpendicular to the plane of the plate) of the planar wobble plate 934 is tilted as non-parallel to the longitudinal axis 28 defined by the shaft 910 and about which the driven shaft 924 rotates.

Multiple spring-loaded reciprocating piston devices 940 are mounted to an interior of the casing 954 forward of the wobble plate 934. The piston devices 940 are mounted at uniformly spaced angular intervals around the longitudinal axis 28. The piston devices 940 extend rearward to contact the wobble plate 934, and are reciprocated in a rotational sequence as the wobble plate 934 rotates.

Each piston device 940 has a sliding ring 942, mounted on the rearward side of a circular shoe 944, to slide along the rotating wobble plate 934 and transfer force to a gimble post 946 through the shoe 944. The sliding ring 942 can be made of ceramic material as a non-limiting example to slide along the wobble plate. The shoe 944 has a forward socket mounted on the rearward ball of the gimble post 946 for a ball-and-socket engagement. The shoe 944 wobbles with the corresponding contact area of the wobble plate 934, and transfers linear longitudinal force to the gimble post 946, converting rotational motion of the wobble plate 934 to linear motion of the gimble post 946.

The externally threaded forward end of the gimble post 946 is connected to the rearward end of an internally threaded coupler 948. The coupler 948 reciprocates longitudinally with the gimble post 946 as the wobble plate 934 rotates. The coupler 948 slides, within a bushing 950, relative to the casing 954. A spring 952 trapped between the casing 954 and coupler 948 persistently presses the coupler 948 and gimble post 946 rearward. The gimble post 946 transfers the linear force of the spring to the shoe 944 to maintain the sliding ring 942 in contact with the wobble plate 934.

The piston devices 940 are in one-to-one correspondence with respectively aligned reciprocating diaphragm devices 960. Each diaphragm device 960 includes a push rod 962 and a flexible circular diaphragm 964, which is concentrically mounted on the forward end of the push rod 962, between front and back washers 966, by a screw 968. The externally threaded rearward end of the push rod 962 is connected to the forward end of the internally threaded coupler 948 and is thereby connected to the gimble post 946 of the respective piston device 940.

Each push rod 962 extends through the front wall of the casing 954, in which forward opening recesses 956, aligned with the respective diaphragms 964, accommodate movement of the diaphragms 964 as the push rods 962 reciprocate with the respective piston devices 940. Forward of the front wall of the casing 954, a stationary valve plate 970 has, in one-to-one correspondence with the diaphragm devices, paired inlets and outlets, such that each diaphragm 964 acts on a respective inlet/outlet pair. Each inlet 972 and outlet 974 is formed as a valved hole passing longitudinally through the valve plate 970. In each inlet 972, a one-way inlet check valve 976 permits pumped fluid to pass rearward through the valve plate as the corresponding diaphragm expands rearward with each push rod 962 reciprocation cycle. This fills the space between the diaphragm 964 and valve plate 970 with pumped fluid as the diaphragm is received in the corresponding recess 956 in the front wall of the casing. In each outlet 974, a one-way outlet check valve 978 permits pumped fluid to pass forward through the valve plate 970 as the corresponding diaphragm 964 is compressed forward with each push rod 962 reciprocation cycle.

Forward of the valve plate 970, the back side of the front cover 980 seals with the front side of the valve plate 970. The front cover 980 has a forward inlet 982 that leads to an internal shared inlet flow channel 984 (FIG. 11I), through which pumped fluid enters the inlets 972. The front cover 980 has an internal shared outlet flow channel 988 (FIG. 11I) that leads from the outlets 974 to a forward outlet 986 (FIG. 11C) of the pump assembly 900.

With each rearward stroke in the reciprocation cycle of each piston device 940 acted upon by the wobble plate 934, the corresponding respective diaphragm device 960 draws pumped fluid through the forward inlet 982, shared inlet flow channel 984, and corresponding respective inlet check valve 976. Subsequently, with the forward stroke, the diaphragm device 960 expels the drawn fluid through the outlet check valve 978, shared outlet flow channel 988, and forward outlet 986. Pumped fluid thus enters the pump assembly 900 through the forward inlet 982, and exits through the forward outlet 986. Thus, the wobble plate 934 rotates and thereby actuates the diaphragms 964 via the piston devices 940. The wobble plate 934 thus serves as an effective impeller.

The accumulated effect of multiple piston devices 940 and corresponding reciprocating diaphragm devices 960 is that the output pressure at the forward outlet 986 is moderated against pulsations, thus delivering a more constant pressure and flow relative to, for example, fewer piston devices 940 and diaphragm devices 960, such as just one. Five piston devices 940 and corresponding diaphragm devices 960 are shown in the drawings as a non-limiting example. A high-pressure diaphragm pump assembly according to these descriptions can have any number of piston devices 940 and corresponding diaphragm devices 960.

The assembly is maintained from the back by fasteners, shown as back assembly bolts 903, attaching the back cover 902 to the back of the casing 954, and from the front by fasteners, shown as front assembly bolts 983, attaching the front cover 980 to the front of the casing 954.

Non-limiting examples of use include: gases or liquids; hydrocarbons; clean liquids. The casing can be metal, however, plastics could be used for use with corrosive liquid. The casing can be metal lined with plastic. In expected use, the output capability includes high pressure, for example at lower flow rates. The high-pressure diaphragm pump assembly 900 is a low maintenance assembly. Flow rates can be adjusted by size of the diaphragms and other dimensions of the pump assembly.

Figure 12A:
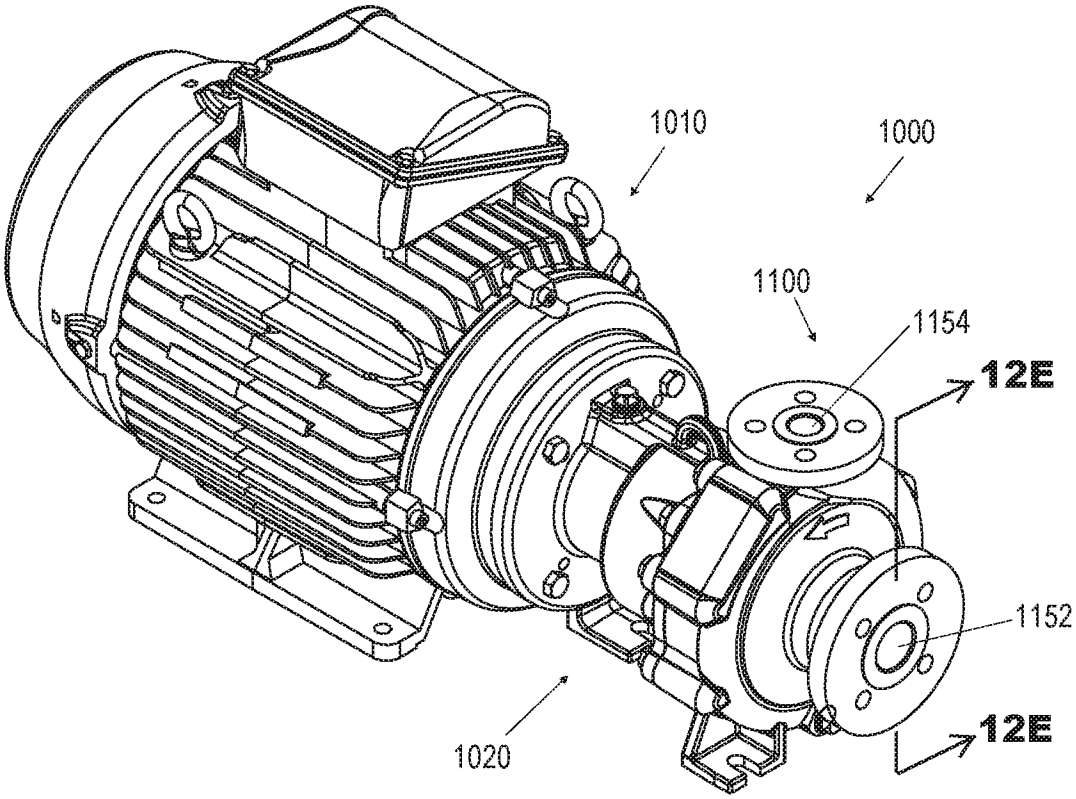
FIG. 12A is a front perspective view of a universal centrifugal pump assembly, according to the present disclosure, mounted on an exchangeable adapter and electric motor combination.
Figure 12B:
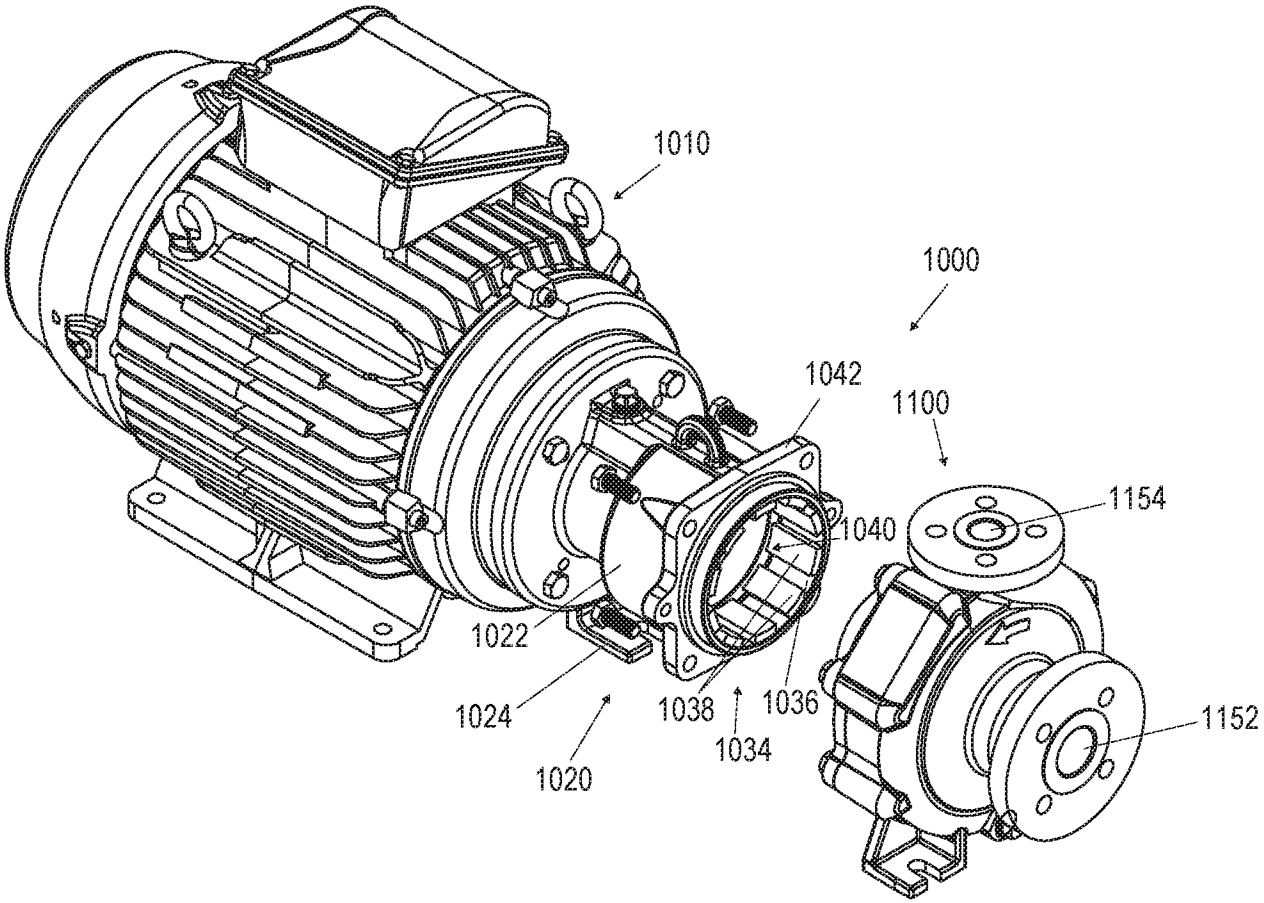
FIG. 12B is front perspective view of the centrifugal pump assembly of FIG. 12A, shown dismounted from the adapter and electric motor.
Figure 12C:
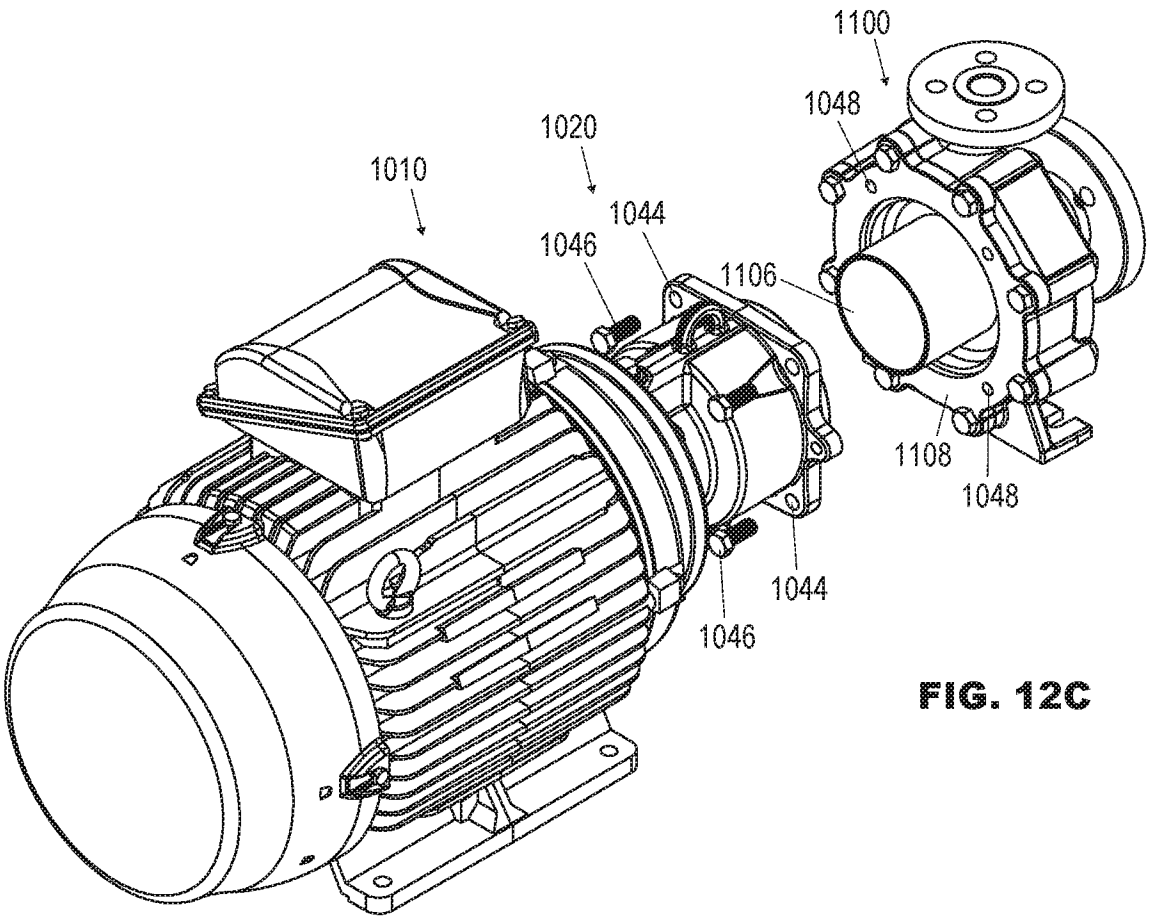
FIG. 12C is back perspective view of the centrifugal pump assembly as in FIG. 12B.
Figure 12D:
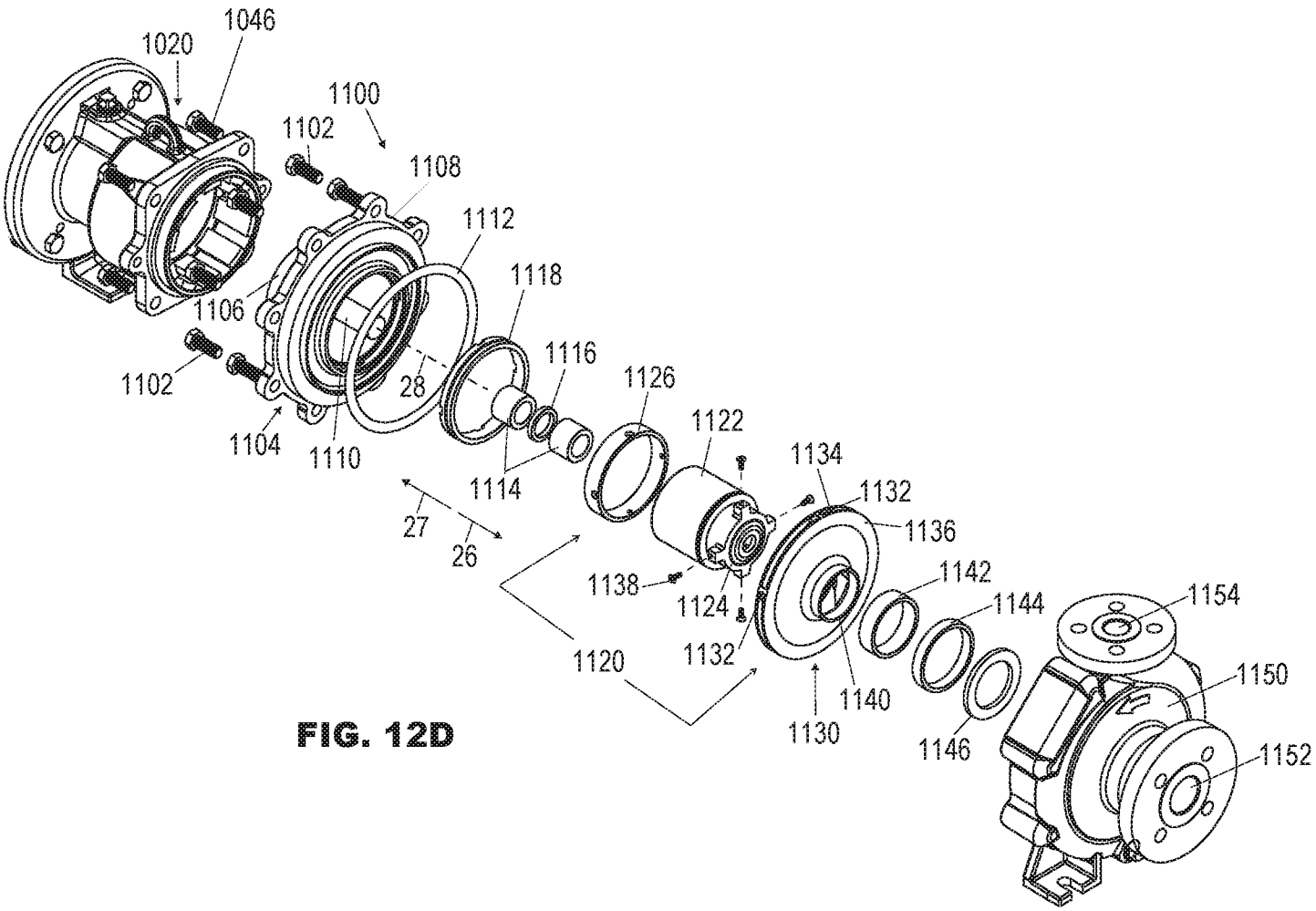
FIG. 12D is an exploded perspective view of the centrifugal pump assembly of FIG. 12A.

Turning now to FIGS. 12A-12E, an electric-motor pumping system 1000 is shown to include a universal pump assembly 1100, according to the present disclosure, and an exchangeable adapter 1020 and electric motor 1010 combination. In the various views, the pump assembly 1100 is shown mounted upon, and dismounted from, the exchangeable adapter 1020 and electric motor 1010 combination. The pump assembly 1100 is universal with respect to exchanging the adapter and electric motor combination of FIG. 12A with the canned motor of FIG. 13A.

Accordingly, the universal pump assembly 1100 is useful with multiple motor configurations. In the non-limiting example of the drawings, the pump assembly 1100 has a centrifugal impeller as further described particularly with reference to FIG. 12D. Accordingly, the explicitly illustrated example can be described as a universal centrifugal pump assembly 1100, with similarities in performance and function as the above-described centrifugal pump assembly 50. However, the universal pump assembly 1100 can have any type of impeller, according, for example, to the many impeller types of the other above-described pump assemblies.

Figure 12E:
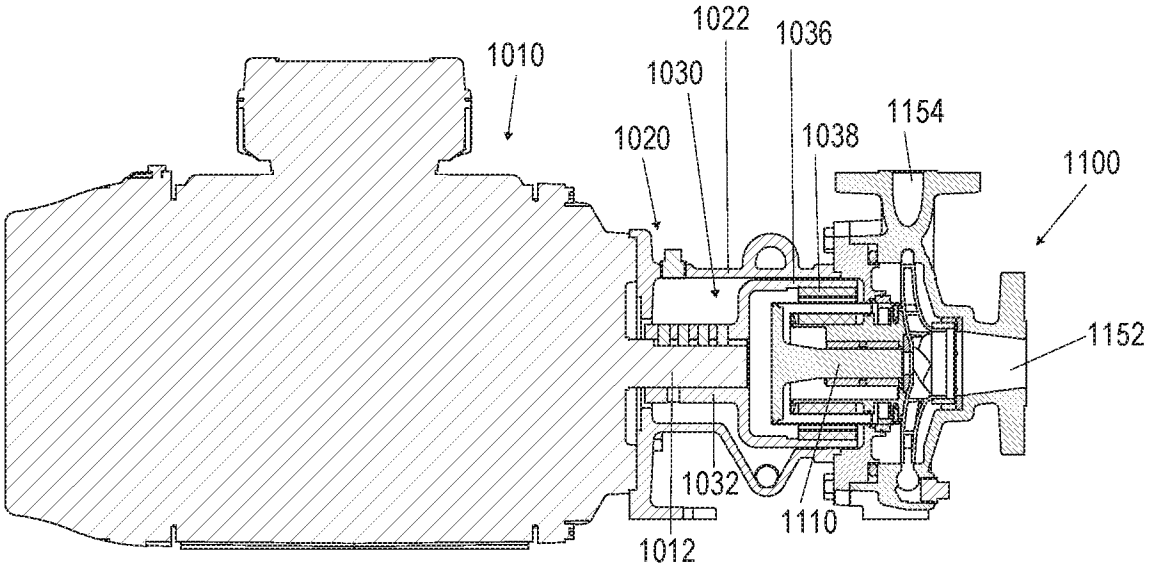
FIG. 12E is a cross-sectional view of the centrifugal pump assembly of FIG. 12A taken along the lines 12E-12E.
Figure 13A:
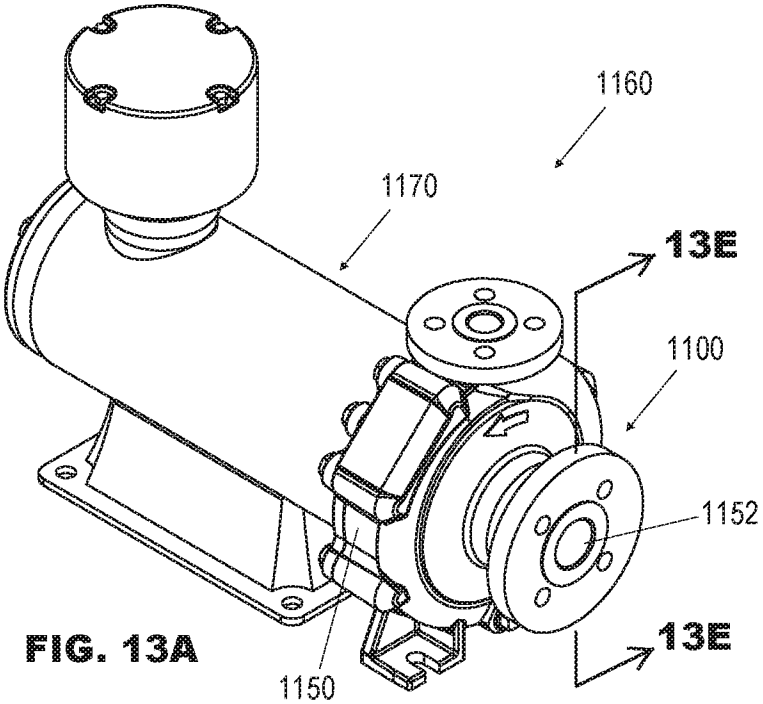
FIG. 13A is a front perspective view of the universal centrifugal pump assembly of FIG. 12A, mounted on an exchangeable canned motor.

The cross-sectional view of FIG. 12E shows the electric motor as a whole without illustration of its internal components. An electrically powered motor 1010, suited for use with the adapter and universal pump assembly 1100 as disclosed herein, is within the understanding of those of ordinary skill in arts related to these descriptions, particularly with the benefits of this disclosure in view.

The adapter 1020 has a housing 1022 (FIG. 12B) mounted upon the motor 1010, and thus is stationary in typical use. The adapter housing 1022 can be constructed of metal for durability, as a non-limiting example. The housing can be further affixed to a host structure by a foot 1024 attached to a lower side of the housing 1022.

The motor 1010 and adapter 1020 have respective components that rotate around a longitudinal axis 28 (FIG. 12D), along which the forward direction 26 and rearward direction 27 are defined. In particular, the adapter 1020 has a rotating assembly 1030 (FIG. 12E) mounted within the housing 1022. The rotating assembly 1030 has a rearward barrel 1032 for engaging a rotary drive shaft 1012 of the motor 1010 (see FIG. 12E for example). The rotating assembly 1030 has a forward outer magnet assembly 1034 connected to and rotated by the barrel 1032. The magnet assembly 1034 has a forward opening cylinder 1036 and permanent magnets 1038 attached at uniformly spaced angular intervals to the interior wall of the cylinder. The magnets 1038 are carried by the cylinder 1036 to rotate around the longitudinal axis 28 when the motor 1010 is active. The magnet assembly 1034 of the adapter 1020 magnetically couples with an inner magnet assembly of the universal pump assembly 1100.

A forward opening receiving area 1040, around the longitudinal axis 28, is defined within the rotating cylinder 1036 and arrangement of magnets 1038 at the forward end of the adapter 1020. The adapter has a front plate 1042 surrounding the receiving area 1040. The front plate 1042 has holes 1044 (FIG. 12C) for alignment with corresponding mounting features of the pump assembly 1100 by use of mounting fasteners, such as externally threaded mounting bolts 1046 as illustrated in FIGS. 12B-12C.

In the implementation of the universal pump assembly 1100 of FIGS. 12A-12E, the corresponding mounting features are shown as internally threaded holes 1048 (FIG. 12C) in the back of the containment shell 1104 to receive and retain the mounting bolts 1046. The back containment shell 1104 serves as a combined "back cover plate" and "containment shell," which are terms used in the preceding descriptions of other pump assemblies, all of which use magnetic coupling in the explicitly illustrated implementations. The back containment shell 1104 accordingly has a rearward extending cup 1106 and a surrounding mounting ring 1108 in which the threaded holes 1048 are formed.

The cup 1106 and ring 1108 may be welded together or otherwise integrated as one piece, for example integrally formed of contiguous material, to be hermetically sealed together to define the rearward boundary of the wet end of the pumping system 1000. The cup 1106, and several other components shown in FIGS. 12D-12E, are omitted in the implementation of FIGS. 13A-13E, in which a mechanical coupling is used to rotate an impeller.

As shown in FIG. 12D, a forward extending stationary shaft 1110 serves as an axle extending longitudinally from the interior of the cup 1106. Bushings 1114 are mounted on the shaft, with an axial spacer 1116 therebetween. A rotatable driven assembly 1120 is mounted on the bushings 1114 for rotation on the shaft 1110.

The rotatable driven assembly 1120 has a rearward inner magnet assembly 1122 and a forward hub 1124 from which radial arms extend. A centrifugal impeller 1130 is mounted on the hub 1124 by way of the radial arms. The impeller 1130 has radially spiraled vanes 1132 between a back shroud or plate 1134 and a front shroud or plate 1136. A ring boss that extends rearward from the back plate 1134 is mounted on the arms of the hub 1124, thereby connecting the impeller 1130 to the magnet assembly 1122 for rotation therewith. The inner magnet assembly 1122, by coupling to the outer magnet assembly 1034 of the adapter 1020, rotates the driven assembly 1120.

A rotating wear ring 1126 is also mounted on the arms of the hub 1124. Fasteners, illustrated as assembly screws 1138, maintain the wear ring 1126, impeller 1130, and hub 1124 with the magnet assembly 1122 as a one-piece rotatable driven assembly 1120. A stationary wear ring 1118 irrotationally engages anti-rotation keys and a groove in the front of the containment shell 1104. The stationary wear ring 1118 and rotating wear ring 1126 mutually rotationally engage.

The centrifugal impeller 1130 has a rotating cylindrical inlet 1140 that extends forward from the front plate 1136. A rotating wear ring 1142 is pressed onto the rotating cylindrical inlet 1140. A stationary wear ring 1144 and an annular thrust collar 1146 fit into the back of the casing 1150. The rotating wear ring 1142 and stationary wear ring 1144 mutually rotationally engage, and the thrust collar 1146 takes any axial load from the rotating wear ring 1144.

For durability, the casing 1150 can be constructed of metal as a non-limiting example. The thrust collar 1146 can be fabricated of or include Teflon or bearing bronze, as non-limiting examples. The various wear rings can be fabricated of or include bearing bronze, ceramics, fiber reinforced plastics, carbon, as non-limiting examples. The impeller 1130 can fabricated of or include metal, such as stainless steel, or carbon steel, as non-limiting examples.

The inner magnet assembly 1122 can be fabricated of or include the same or similar materials as the casing. As non-limiting examples, this can be steel, stainless steel, or an alloy. Chemically resistant material can be used. The bushings can be fabricated of or include bearing bronze, as a non-limiting example. The O-rings can be selected of materials suitable for the liquid being pumped. The O-rings can be rubber, neoprene, or chemically resistant Teflon. The back containment shell 1104 can fabricated of or include the same or similar materials as the casing. The shaft 1110 can be hardened to resist wear. A coating such as chrome oxide can be used as a hard and low-friction surface coating. The magnets may be neodymium magnets, or samarium cobalt magnets, as non-limiting examples.

The inner magnet assembly 1122 is positioned within the cup 1106 of the containment shell 1104 upon assembly and the centrifugal impeller 1130 is positioned within the casing 1150. Upon rotation of the driven assembly 1120, a pumped fluid enters the interior of the impeller via the stationary central front inlet 1152 and rotating inlet 1140, which are concentric with the longitudinal axis 28 about which the impeller 1130 rotates. The pumped fluid is cast radially outward through centrifugal force by the vanes 1132 to be ejected through a peripheral top outlet 1154 of the casing.

The assembly is maintained from the back by fasteners, shown as back assembly bolts 1102, attaching the mounting ring 1108 of the back containment shell 1104 to the back of the casing 1150. A gasket 1112, illustrated for example as an O-ring, seals the front side of the containment shell 1104 with the back of the casing 1150.

Turning now to FIGS. 13A-13E, a canned-motor pumping system 1160 is shown to include the universal pump assembly 1100 and a canned motor 1170. The universal pump assembly 1100 is generally detailed in the preceding descriptions of the implementation of FIGS. 12A-12E. Some modifications by way of conversion parts are made in the implementation of FIGS. 13A-13E to configure the pump assembly 1100 to mount the canned motor 1170. Where same reference numbers are used, same parts can be used in both implementations. For example, the casing 1150 is used in both implementations. Other similarities and differences will be apparent in view of the following descriptions and referenced drawings.

In the canned motor pumping system 1160, wet end components of the pump assembly 1100 are directly connected to the drive rotor of a canned motor 1170. A cylindrical containment sleeve 1172 (FIG. 13E) is positioned in the magnetically-bridged gap between a dry stationary stator 1174 having outer windings 1176, and an internal rotating drive rotor 1180. In terminology used in the related industries, the containment sleeve 1172 is sometimes called a "can." The drive rotor 1180 is mounted on a drive shaft 1182 that rotates when the canned motor 1170 is active. These and other features of a canned motor 1170 are within the understanding of those of ordinary skill in arts related to these descriptions, particularly with the benefits of this disclosure in view.

The containment sleeve 1172 separates the drive rotor 1180, which may be exposed to fluid pumping conditions in use, from the non-wetted stator 1174. Neither the above-described electric-motor pumping system 1000, nor the canned motor system 1160 requires a drive shaft extending through a shaft aperture from a dry end to a wet end, and thus a seal-less pump is provided utilizing low maintenance and reliable stationary interfaces at the motor to pump assembly interface in lieu of dynamic seals. This is accomplished, in the implementation of FIGS. 12A-12E, by sealing the rotating inner magnet assembly 1122 within the containment shell 1104 in fluid communication with the casing 1150, and by sealing the motor's drive rotor 1180 within the containment sleeve 1172 in fluid communication with the casing 1150 in the implementation of FIGS. 13A-13E.

Figure 13B:
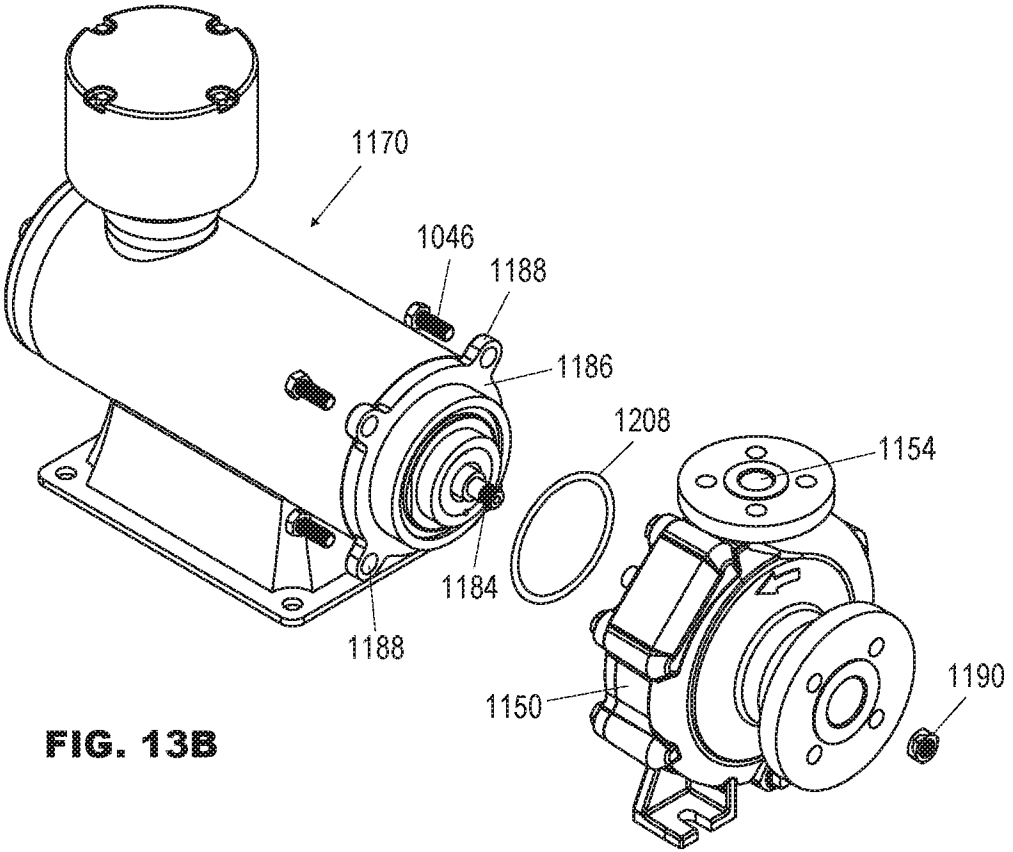
FIG. 13B is front perspective view of the centrifugal pump assembly of FIG. 13A, shown dismounted from the canned motor.
Figure 13C:
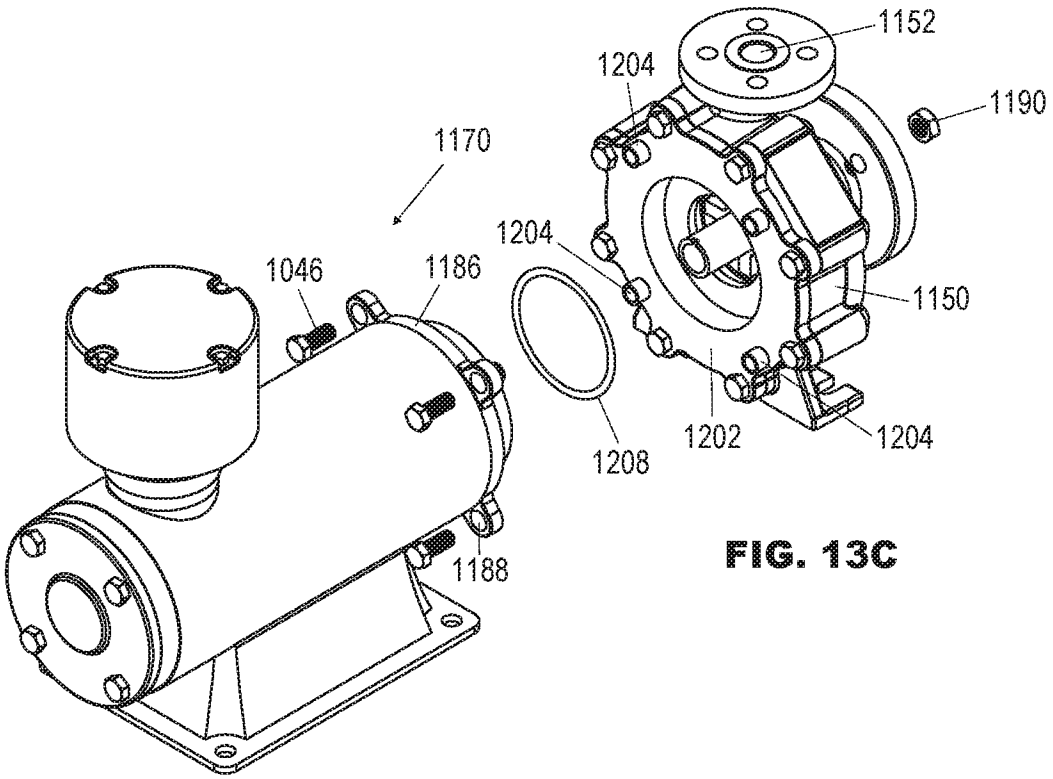
FIG. 13C is back perspective view of the centrifugal pump assembly as in FIG. 13B.
Figure 13D:
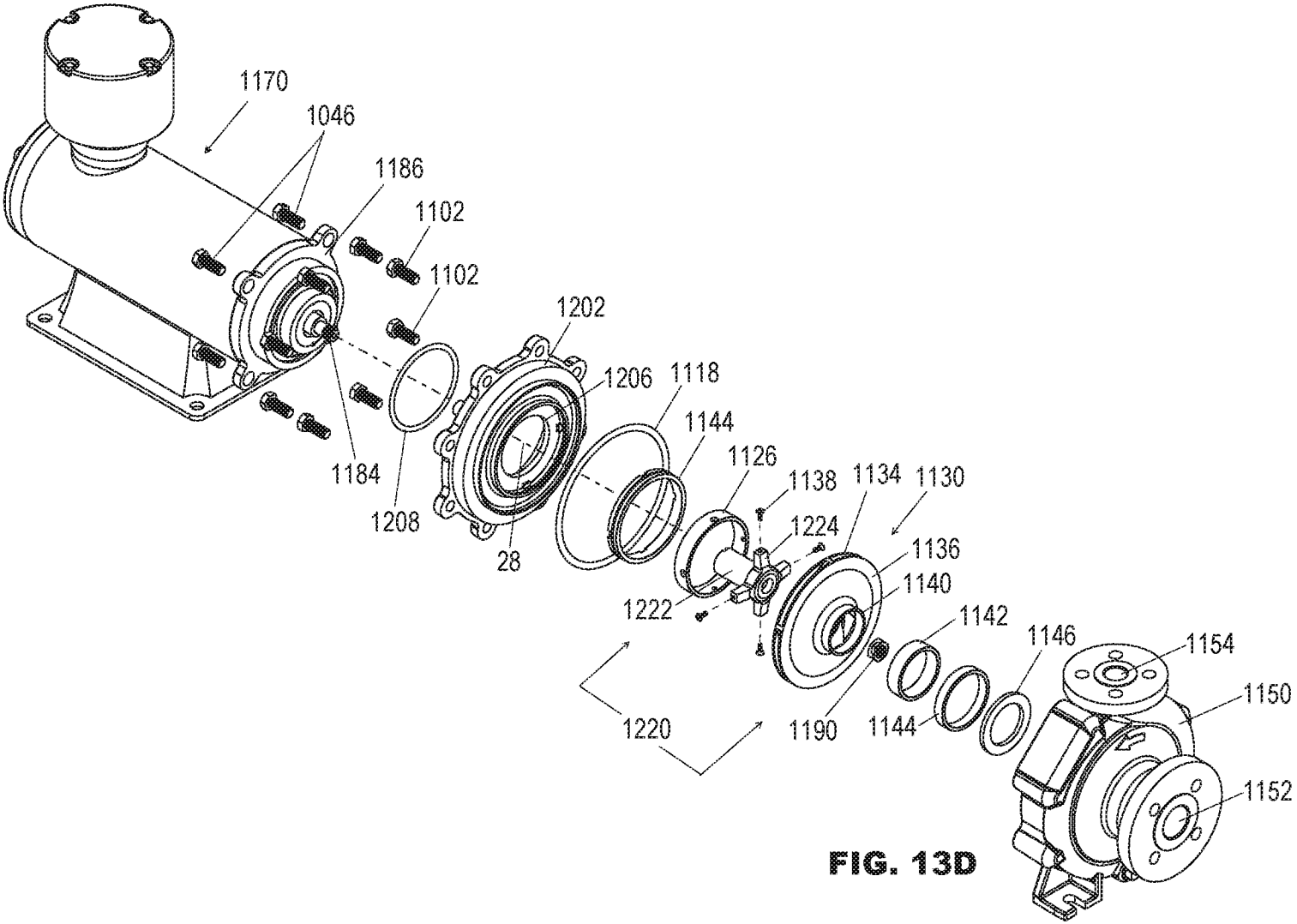
FIG. 13D is an exploded perspective view of the centrifugal pump assembly of FIG. 13A.
Figure 13E:
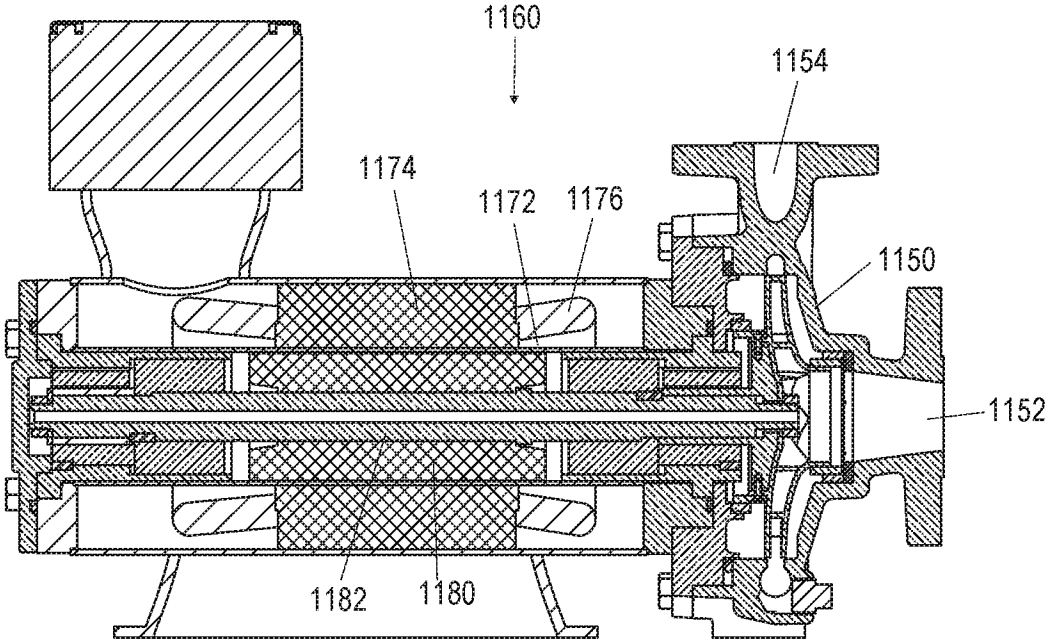
FIG. 13E is a cross-sectional view of the centrifugal pump assembly of FIG. 13A taken along the lines 13E-13E.

The canned motor has a front mounting ring 1186 (FIG. 13B) having holes 1188 for alignment with corresponding mounting features of the pump assembly 1100 by use of mounting fasteners, such as externally threaded mounting bolts 1046 as illustrated in FIGS. 13B-13C. In the implementation of the universal pump assembly 1100 of FIGS. 13A-13E, the corresponding mounting features are shown as internally threaded posts 1204 (FIG. 13C) extending from the back of the mounting ring 1202 to receive and retain the mounting bolts 1046. In this implementation, an impeller is rotated by mechanical coupling to the drive shaft 1182. Thus, the cup 1106 and inner magnet assembly 1122, which are used in the implementation of FIGS. 12A-12E to facilitate magnetic coupling, are not used in this implementation. Instead, the mounting ring 1202 has a central opening 1206 (FIG. 13D) concentric with the longitudinal axis 28. A gasket 1208 between the mounting ring 1186 and the mounting ring 1202 seals the interior of the containment sleeve 1172 of the canned motor 1170 with the interior of the casing 1150.

In the implementation of FIGS. 13A-13D, a rotatable driven assembly 1220 is mounted on the forward longitudinal end 1184 (FIG. 13B) of the drive shaft 1182 of the canned motor 1170 and secured thereto by a fastener, illustrated as an assembly nut 1190. The rotatable driven assembly 1220 has a hub 1222, the rearward end of which engages the end 1184 of the drive shaft of the motor 1170. At the forward end of the hub 1222, radial arms 1224 extend outward. The centrifugal impeller 1130 is mounted on the hub 1222 by way of the radial arms 1224. The impeller 1130, as previously described, has radially spiraled vanes between a back shroud or plate 1134 and a front shroud or plate 1136. A ring boss that extends rearward from the back plate 1134 is mounted on the arms 1224 of the hub 1222, thereby connecting the impeller 1130 to the hub 1222, and mechanically coupling the impeller 1130 to the drive shaft 1182 of the motor 1170 for rotation therewith.

The rotating wear ring 1126 is also mounted on the arms 1224 of the hub 1222. Fasteners, illustrated as assembly screws 1138, maintain the wear ring 1126, impeller 1130, and hub 1222 as a one-piece rotatable driven assembly 1220.

The stationary wear ring 1118 irrotationally engages anti-rotation keys and a groove in the front of the mounting ring 1202.

The cylindrical inlet 1140, rotating wear ring 1142, stationary wear ring 1144, annular thrust collar 1146 and casing 1150 serve as previously described with reference to the implementation of FIGS. 12A-12E. The assembly is maintained from the back by fasteners, shown as back assembly bolts 1102, attaching the mounting ring 1202 to the back of the casing 1150. The gasket 1118 seals the front side of the mounting ring 1202 with the back of the casing 1150.

While the foregoing description provides embodiments of the invention by way of example only, it is envisioned that other embodiments may perform similar functions and/or achieve similar results. Any and all such equivalent embodiments and examples are within the scope of the present invention and are intended to be covered by the appended claims.

What is claimed is:

1. A pumping system, comprising:

a universal adapter, comprising:

a housing forming a longitudinal axis and including a forward end forming a cup-shaped forward opening receiving area, a forward mounting plate surrounding the cup-shaped forward opening receiving area, a rearward end forming a rearward opening receiving area, and a rearward mounting plate for attachment to a motor;

a rotatable assembly disposed in the housing and rotatable around the longitudinal axis, the rotatable assembly including a rearward barrel for engaging a rotary drive shaft of the motor and an outer magnet assembly connected to and rotated by the barrel, the outer magnet assembly including a forward opening cylinder and permanent magnets attached at uniformly spaced angular intervals to an interior wall of the forward opening cylinder, the outer magnet assembly rotatable around the cup-shaped forward opening; and a base attached to housing, the base including a first part extending away from the housing and a second part extending coextensive with the housing toward the rearward end of the housing;

wherein each of the forward mounting plate and the rearward mounting plate includes a plurality of spaced-apart openings;

a plurality of interchangeable pump assemblies, each of the plurality of pump assemblies comprising a casing, a back cover including a rearward extending cup receivable in the cup-shaped forward opening, and a pump mounting plate surrounding the rearward extending cup and including a plurality of spaced-apart, rearward extending posts for alignment with and insertion into the plurality of spaced-apart openings of the forward mounting plate to mount the respective interchangeable pump assembly to the universal adapter, wherein each of the pump mounting plates of the plurality of interchangeable pump assemblies are equally sized, and wherein the pump mounting plate of each of the plurality of pump assemblies further includes a plurality of spaced-apart openings positioned radially outward of the plurality of spaced-apart, rearward extending posts;

first fasteners, for each of the plurality of pump assemblies, received through the plurality of spaced-apart openings of the pump mounting plate and into corresponding spaced- apart openings formed in the casing for attaching the pump mounting plate to the casing; and second fasteners receivable through the plurality of spaced-apart openings of the forward mounting plate and into the plurality of spaced-apart, rearward extending posts of the mounting plate for removably attaching one of the plurality of interchangeable pump assemblies to the universal adapter.

2. The pumping system according to claim 1, wherein each rearward extending cup of each of the interchangeable pump assemblies comprises an inner magnet assembly rotatable within the rearward extending cup by magnetic coupling to the outer magnet assembly through the rearward extending cup.

3. The pumping system according to claim 2, wherein the casing of each of the plurality of pump assemblies comprises an inlet and an outlet, and an impeller rotatable within the casing by the inner magnet assembly to pump fluid from the inlet to the outlet.

4. The pumping system according to claim 3, wherein the impeller comprises a spaced pair of plates between which the fluid is centrifugally forced radially outward to be ejected through the outlet upon rotation of the impeller.

5. The pumping system according to claim 3, wherein the impeller defines at least one of a centrifugal impeller and a disc impeller.

6. The pumping system according to claim 2, wherein each rearward extending cup extends through a central hole of its respective back cover.

7. The pumping system according to claim 2, wherein each rearward extending cup extends rearward from a containment shell having a forward flange extending outward from a forward end of the rearward extending cup.

8. The pumping system according to claim 7, wherein the flange is integrally formed with the rearward extending cup.

9. The pumping system according to claim 7, wherein the flange is trapped between its respective back cover and the casing by the first fasteners.

10. The pumping system according to claim 7, wherein the containment shell comprises a single layer shell.

11. The pumping system according to claim 7, wherein the containment shell comprises a multi-layer shell including an outer shell component and an inner shell component, wherein the inner shell component separates the outer shell component from fluid exposure.

* * * * *